US005250402A

United States Patent [19]

Okada et al.

[11] Patent Number: 5,250,402

[45] Date of Patent: Oct. 5, 1993

[54] PHOTOGRAPHIC BLEACHING COMPOSITION AND A PROCESSING METHOD THEREWITH

[75] Inventors: Hisashi Okada; Tadashi Inaba; Morio Yagihara, all of Kanagawa, Japan

[73] Assignee: Fuji Photo Film Co., Ltd., Kanagawa, Japan

[21] Appl. No.: 904,334

[22] Filed: Jun. 25, 1992

[30] Foreign Application Priority Data

Jun. 26, 1991 [JP] Japan ..... 3-180524
Jul. 4, 1991 [JP] Japan ..... 3-189555

[51] Int. Cl.[5] ..... G03C 7/00; G03C 5/99; G03C 5/38; G03C 5/42

[52] U.S. Cl. ..... 430/393; 430/430; 430/460; 430/461

[58] Field of Search ..... 430/393, 430, 460, 418, 430/461

[56] References Cited

U.S. PATENT DOCUMENTS

| | | | |
|---|---|---|---|
| 2,892,867 | 6/1959 | Williams et al. | 71/115 |
| 3,615,508 | 10/1971 | Stephen et al. | 430/460 |
| 3,701,662 | 10/1972 | Piccotti | 430/393 |
| 4,537,856 | 8/1985 | Kurematsu et al. | 430/430 |
| 4,563,405 | 1/1986 | Ishikawa et al. | 430/460 |
| 5,009,985 | 4/1991 | Kunitz et al. | 430/460 |

FOREIGN PATENT DOCUMENTS

| | | | |
|---|---|---|---|
| 3912551 | 10/1990 | Fed. Rep. of Germany . | |
| 1050140 | 3/1986 | Japan | 430/430 |

*Primary Examiner*—Charles L. Bowers, Jr.

*Assistant Examiner*—James Pasterczyk

*Attorney, Agent, or Firm*—Sughrue, Mion, Zinn, Macpeak & Seas

[57] ABSTRACT

A photographic processing composition for processing a silver halide photographic light-sensitive material. The composition contains at least one metal chelating compound formed from a metal salt of Fe(III) and a monoamine compound or salt thereof represented by formula (I-a') or (I-b'):

(I-a')

(I-b')

wherein R represents a substituent; Q represents a group of non-metal atoms necessary to form a heterocyclic ring; X and Y each represents a carbon atom or a nitrogen atom; $L_1'$ and $L_2'$ each represents an alkylene group; $M_1$, $M_2$, $M_3$ each represents a hydrogen atom or a cation; and u represents 0, 1, 2, 3, or 4.

9 Claims, No Drawings

PHOTOGRAPHIC BLEACHING COMPOSITION AND A PROCESSING METHOD THEREWITH

FIELD OF THE INVENTION

The present invention relates to processing composition for a silver halide photographic light-sensitive material and a processing method using the same. More specifically, the present invention relates to a processing composition containing a chelating agent for masking metal ions harmful to photographic processing, and a processing method using the same, and to a processing composition containing a novel bleaching agent for use in a bleaching step following color development, and a processing method using the same.

BACKGROUND OF THE INVENTION

In general, processing of a silver halide black-and-white photographic light-sensitive material includes black-and-white developing after imagewise exposing, fixing and rinsing and the processing of a silver halide color photographic light-sensitive material (hereinafter referred to as a color light-sensitive material) includes a color developing after imagewise exposing, desilvering, rinsing and stabilizing. Processing of a silver halide color reversal light-sensitive material includes black-and-white developing after imagewise exposing, color developing after reversal processing, desilvering, rinsing and stabilizing.

In a color developinq step, exposed silver halide grains are reduced to silver by a color developing agent. At the same time, the oxidation product of the color developing agent reacts with a coupler to form a dye image.

In a subsequent desilvering step, the developed silver obtained in the developing step is oxidized by a bleaching agent to obtain a silver salt (bleaching), and is further removed from a light-sensitive layer together with unexposed silver halide by a fixing agent which forms a soluble silver salt therewith (fixing). The bleaching and fixing may be carried out independently in a separate bleaching and fixing steps, or may be carried out simultaneously in a bleach-fixing step. The details of these processing steps and the compositions thereof are described in James, *The Theory of Photographic Process,* 4th Edition (1977), and *Research Disclosure* No. 17643, pp. 28 to 29, No. 18716, 651, from the left column to right column, and RD No.307105, pp. 880 to 881.

In addition to the above fundamental processing steps, various auxiliary steps may be carried out supplementally for maintaining the photographic and physical quality of a dye image or to promote processing stability. Such auxiliary steps include, for example, a rinsing step, a stabilizing step, a hardening step and a terminating step.

In general, the above processing steps are carried out in an automatic developing machine. Photographic processing is carried out in various places ranging from a large size processing laboratory, equipped with a large size automatic developing machine, to a retail photo store called a mini lab equipped with a small size automatic developing machine. Such versatility tends to be accompanied by a reduction in processing performance. The presence of metal ions in the processing solution is a major cause thereof. Various metal ions are introduced into the processing solution in a number of different ways. For example, calcium and magnesium may be introduced through water used to prepare a processing solution. Iron in some cases, and calcium contained in gelatin may leach into the processing solution. Furthermore, a bleach-fixing solution containing an iron chelate may be splashed into the preceeding developing bath. In some cases, the processing solution absorbed by a film contaminates a succeeding bath. The effect of carry over depends on the kind of involved ion and processing solution.

Calcium and magnesium ions introduced into a developing solution react with carbonate salt contained herein for use as a buffer agent to generate a precipitate and sludge, which clogs the filter of a circulating system of a developing machine and results in process staining of the film. Furthermore, when a transition metal salt such as iron ion is introduced into the developing solution, a marked deterioration of a photographic property results due to decomposition of paraphenylenediamine type color developing agents, black-and-white developing agents such as hydroquinones, and preservatives such as hydroxylamines and sulfate.

Also, introduction of a transition metal such as iron ion into a bleaching solution containing hydrogen peroxide and persulfate markedly deteriorates stability of the solution and results in a diminished bleaching capacity.

Also, in a fixing solution typically containing thiosulfate, the introduction of a transition metal salt deteriorates the stability of the fixing solution to generate turbidity and sludge therein. As a result, the circulating flow amount is reduced due to clogging of the filter of an automatic developing machine to reduce fixing capacity and generate processing stain on the film. Such phenomena as described for the fixing solution also occurs in rinsing water following the fixing solution. Especially, reduction in the amount of rinsing water reduces the solution exchange rate in the rinsing tank, to remarkably decompose thiosulfate (called sulfurization) with the resulting precipitation of silver sulfide. Under such circumstances, the film surface is liable to be stained to the extent that it loses its commercial value.

In a stabilizing solution prepared using hard water containing calcium and magnesium in large quantity, bacteria proliferate by consuming these elements as a nutrient to generate turbidity in the solution and cause film staining.

Transition metal ions introduced into the processing solution including iron ion cause various adverse effects and accordingly, there is a demand of an effective masking agent for metal ions.

A chelating agent for masking metal ions has hitherto been proposed as a method for solving the above problems. Examples thereof include, for example, aminocarboxylic acids (for example, ethylenediaminetetracetic acid and ethylenetriaminepentacetic acid) described in JP-B-48-30496 and 44-30232 (the term "JP-B" as used herein means an examined Japanese patent publication), organic phosphonic acids described in JP-A-56-97347 (the term "JP-A" as used herein means an unexamined published Japanese patent application), JP-B-56-39359, and German Patent 2,227,639, phosphonocarboxylic acids described in JP-A-52-102726, 53-42730, 54-121127, 55-126241, and 55-65956, and other compounds described in JP-A-58-195845 and 58-203440, and JP-B-53-40900.

The above described compounds are inadequate, although some are of practical use. For example, while ethylenediaminetetraacetic acid has a large masking ability against calcium ion, the subject chelating agent accelerates decomposition of a developing agent and preservative therefor in the presence of iron ion when added to the developing solution. This results in deterioration of photographic properties, such as reduction of image density and an increase in fog. Also, for example, while alkylidenediphosphonic acid exerts no such adverse effects even in the presence of iron ion, the subject chelating agent undesirably generates solid materials in a processing solution prepared with hard water containing calcium in large quantity to cause machine malfunction.

Especially in recent years, and in view of environmental considerations, the replenishing amount of photographic processing solutions has been progressively decreased with an accompanying increase in the residence time of the processing solutions in an automatic processor. Accordingly, the preservability of processing solutions is becoming increasingly more important. For this reason, the development of a technology has been desired in which the metal ions are effectively masked without otherwise adversely affecting the processing solution.

Furthermore, with the greater availability of mini labs for processing color light-sensitive materials, rapid processing service at the retail level is becoming popular. However, satisfactory rapid bleaching has not yet been achieved despite the use of a bleach accelerating agent (for example, the addition of the mercapto compounds described in U.S. Pat. No. 1,138,842), because ethylenediaminetetracetic acid ferric complex salt widely used as a bleaching agent in the bleaching step and bleach-fixing step disadvantageously has a weak oxidizing power.

While red prussiate, iron chloride and bromate are known as bleaching agents which achieve rapid bleaching, red prussiate is unsatisfactory in view of environmental conservation, iron chloride poses handling problems such as metal corrosion, and bromate forms an unstable solution.

Accordingly, there is a demand for a bleaching agent which is easy to handle and achieves rapid bleaching, and which does not pose a problem in disposing of a waste solution thereof. Recently, 1,3-diaminopropanetetracetic acid ferric complex salt has been proposed as a bleaching agent capable of satisfying these conditions. However, the proposed bleaching agent causes bleaching fog. The addition of a buffer agent to the bleaching solution has been proposed as a method for reducing this bleaching fog (for example, JP-A-1-213657). However, the improvement in bleaching fog is not adequate. Particularly in rapid processing in which color development is carried out in three minutes or less, bleaching fog is generated to even a greater extent because a developing solution having a high activity is used.

Furthermore, the use of a processing solution having a bleaching ability comprising this 1,3-diaminopropanetetraacetic acid ferric complex salt, results in increased stain during the storage after processing.

Furthermore, the desilvering property is considerably reduced in continuous processing carried out with a processing solution having a bleaching ability comprising a 1,3-diaminopropanetetracetic acid ferric complex salt, in comparison with the initial stage of the continuous processing. A precipitate is also formed.

Accordingly, there is a demand for a processing composition having a bleaching ability and processing method using the same which solves the above described problems.

Furthermore, in view of environmental considerations, the ability to convert a photographic processing waste solution to a non-hazardous form, and especially one that is readily subjected to biodegradation, is highly desired. The polycarboxylic acid derivatives derived from o-aminophenol are proposed as such a compound in German Patent Publication 3,912,551. However, it has been found that the desilvering property is considerably reduced in continuous processing carried out with a processing solution having a bleaching ability comprising a ferric complex salt of this compound, in comparison with the initial stage of the continuous processing. Also, bleaching fog and stain are still present.

Furthermore, in view of environmental conservation, there has been a demand for a reduction in the concentration of the metal chelating compound. However, sufficient desilvering property is not obtained with conventional bleaching agents of a diluted concentration.

SUMMARY OF THE INVENTION

Accordingly, a first object of the present invention is to provide a photographic processing composition in which a precipitate and sludge are not generated even with the mixing therein of metal ions, and a processing method for use with the same.

A second object of the present invention is to provide a stable processing composition in which the active ingredients are not deteriorated and components exerting photographically adverse effects are not formed even with the mixing therein of metal ions, and a processing method for use with the same.

A third object of the present invention is to provide a processing composition in which image preservability due to metal ions of the components contained therein and remaining in a processed light-sensitive material is improved, and a processing method for use with the same.

Furthermore, a fourth object of the present invention is to provide an easily handled photographic processing composition, the waste solution of which is environmentally acceptable, and a processing method for use with the same.

A fifth object of the present invention is to provide a processing composition for bleaching having an excellent desilvering property even in a particularly diluted concentration thereof, and a processing method for use with the same.

A sixth object of the present invention is to provide a processing composition having a bleaching ability which generates less bleaching fog, and a processing method for use with the same.

A seventh object of the present invention is to provide a processing composition having a bleaching ability which results in less fog of the processed photographic material upon storage, and a processing method for use with the same.

An eighth object of the present invention is to provide a processing composition which maintains the above described properties even in continuous processing, and a processing method for use with the same.

A ninth object of the present invention is to provide a processing composition which is preferable particularly from the viewpoint of biodegradation and environmental conservation, and a processing method for use with the same.

The above objects have been achieved by the following methods, namely:

(1) a photographic processing composition containing at least one monoamine compound represented by formula (I) or salt thereof, and a processing method for use with the same; and (2) a photographic processing composition for processing a silver halide light-sensitive material, containing a Fe (III), Mn (III), Co (III), Rh (II), Rh (III), Au (II), Au (III), or Ce (IV) chelating compound of the monoamine compound represented by formula (I) or salt thereof, and a processing method for use with the same:

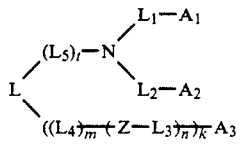

(I)

where L represents an arylene group or a divalent heterocyclic group; $L_1$, $L_2$, $L_3$, $L_4$ and $L_5$ each represents a divalent aliphatic group, a divalent aromatic group, or a divalent linkage group comprising a combination of these groups; $A_1$, $A_2$ and $A_3$ each represents a carboxy group, a sulfo group or a hydroxy group; Z represents an oxygen atom or a sulfur atom; k, t, m and n each represents 0 or 1; provided that when L is an arylene group to which a residue containing a $—N(L_1—A_1)(L_2—A_2)$ group and a residue containing a $—A_3$ group are bonded at a position ortho to each other, and k and n are 1, Z is not an oxygen atom and that when L is an arylene or divalent heterocyclic group to which a residue containing a $—N(L_1—A_1)(L_2—A_2)$ group and a residue containing $—A_3$ are bonded at a position ortho to each other and k is 0, $A_3$ is not a hydroxy group.

DETAILED DESCRIPTION OF THE INVENTION

First, the monoamine compound represented by formula (I) is described in detail below.

The arylene group represented by L is a monocyclic or bicyclic arylene group which is a hydrocarbon and the two linking sites thereof may be at an ortho, meta or para position to each other. L preferably has 6 to 20 carbon atoms, and includes, for example, a phenylene group and a naphthylene group.

The arylene group represented by L may be substituted, and useful substituents include, for example, an alkyl group (for example, methyl and ethyl), an aralkyl group (for example, phenylmethyl), an alkenyl group (for example, allyl), an alkynyl group, an alkoxy group (for example, methoxy and ethoxy), an aryl group (for example, phenyl and p-methylphenyl), an acylamino group (for example, acetylamino), a sulfonylamino group (for example, methanesulfonylamino), a ureido group, a urethane group, an aryloxy group (for example, phenyloxy), a sulfamoyl group (for example, methylsulfamoyl), a carbamoyl group (for example, carbamoyl and methylcarbamoyl), an alkylthio group (for example, methylthio and carboxylmethylthio), an arylthio group (for example, phenylthio), a sulfonyl group (for example, methanesulfonyl), a sulfinyl group (for example, methanesulfinyl), a hydroxy group, a halogen atom (for example, a chlorine atom, a bromine atom and a fluorine atom), a cyano group, a sulfo group, a carboxy group, a phosphono group, an aryloxycarbonyl group (for example, phenyloxycarbonyl), an acyl group (for example, acetyl and benzoyl), an alkoxycarbonyl group (for example, methoxycarbonyl), an acyloxy group (for example, acetoxy), a carbonamide group, a sulfonamide group, a nitro group, and a hydroxamic acid group. The compound of the present invention is a monoamine compound, and accordingly, the substituent does not include an unsubstituted amino group and an aliphatic, aromatic or heterocyclic amino group. Furthermore, a hydroxy group is not substituted at a position ortho to a residue containing a $—N(L_1—A_1)(L_2—A_2)$ group. The above substituents having a carbon atom preferably have 1 to 4 carbon atoms.

The arylene group represented by L is preferably represented by the following formula (a):

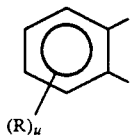

(a)

wherein R represents a substituent and u represents 0, 1, 2, 3 or 4.

The above described substituents for the arylene group represented by L can also be applied as the substituent represented by R. Preferred as the substituent represented by R include an alkyl group, an alkoxy group, an acylamino group, a sulfonylamino group, a ureido group, a urethane group, a sulfamoyl group, a carbamoyl group, an alkylthio group, a sulfonyl group, a sufinyl group, a hydroxy group, a halogen atom, a cyano group, a sulfo group, a carboxy group, a phosphono group, an acyl group, an alkoxycarbonyl group, an acyloxy group, a carbonamide group, a sulfonamide group, a nitro group, and a hydroxamic acid group. More preferred are an alkyl group, an alkoxy group, a sulfamoyl group, an alkylthio group, a sulfonyl group, a hydroxy group, a halogen atom, a sulfo group, a carboxy group, a phosphono group, and a nitro group.

Furthermore, where u is 2 or more, the two or more R groups may be the same or different and the R groups may be combined with one another to form a ring. Examples of the ring formed by combining R groups with one another includes, for example, a benzene ring.

The heterocyclic group represented by L is a 3 to 10-membered hetercyclic group containing at least one of a nitrogen atom, an oxygen atom and a sulfur atom. The heterocyclic group represented by L may be a monocyclic ring or may further form a condensed ring with the an aromatic or heterocyclic ring. The heterocyclic ring for L is preferably a 5 to 6-membered unsaturated heterocyclic ring. Examples of the heterocyclic ring represented by L include, for example, pyridine, pyrazine, pyrimidine, pyridazine, triazine, tetrazine, thiophene, furan, pyran, pyrrole, imidazole, pyrazole, thiazole, isothiazole, oxazole, isoxazole, oxadiazole, thiadiazole, thianthrene, isobenzofuran, cumene, xanthene, phenoxathiin, indolizine, isoindole, indole, triazole, triazolium, tetrazole, quinilizine, isoquinoline, quinoline, phthalazine, naphthyridine, quinoxaline, quinazoline, cinnoline, pterindine, carbazole, carboline, phenantridine, acridine, pteridine, phenanthroline, phenazine, phenothiazine, phenoxazine, chroman, pyrroline, pyrazoline, indoline, and isoindoline. Preferred are pyridine, pyrazine, pyrimidine, pyridazine, thiophene, furan, pyrrole, imidazole, pyrazole, thiazole, isothiazole, oxazole, and isoxazole.

The heterocyclic group may be combined with the residue containing a $-N(L_1-A_1)(L_2-A_2)$ group and the residue containing a $A_3$ group via a carbon atom or a nitrogen atom at the ring positions selected for substitution by these residues. These residues are preferably substituted at adjacent ring positions of the heterocyclic group. Accordingly, the heterocyclic group represented by L is preferably represented by the following formula (b):

(b)

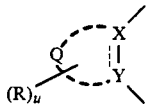

where Q represents a group of non-metal atoms necessary to form a heterocyclic ring; X and Y each represents a carbon atom or a nitrogen atom; and R and u have the same meanings as in formula (a). The bond X Y means a single bond or a double bond, and is preferably a double bond.

$A_1$, $A_2$ and $A_3$ each represents a carboxy group, a sulfo group or a hydroxy group, provided that when L is an arylene group or a divalent heterocyclic group to which a residue containing a $-N(L_1-A_1)(L_2-A_2)$ group and a residue containing $-A_3$ are bonded at a position ortho to each other (that is, where L is represented by formula (a) or (b)), and k is 0, $A_3$ is not a hydroxy group. $A_1$, $A_2$ and $A_3$ each preferably represents a carboxy group, or a sulfo group, more preferably a carboxy group. The groups for $A_1$, $A_2$ and $A_2$ may form an ammonium salt or a salt with an alkali metal as described below.

The divalent aliphatic group represented by $L_1$, $L_2$, $L_3$, $L_4$ and $L_5$ is a linear, branched or cyclic alkylene group (having preferably 1to 6 carbon atoms), an alkenyl group (having preferably 2 to 6 carbon atoms), or an alkynylene group (having preferably 2 to 6 carbon atoms).

The divalent aromatic group represented by $L_1$, $L_2$, $L_3$, $L_4$ and $L_5$ is preferably a divalent aromatic hydrocarbon group (having preferably 6 to 20 carbon atoms), more preferably a phenylene group or a naphthalene group.

$L_1$, $L_2$, $L_3$, $L_4$ and $L_5$ may also be a divalent linkage group comprising a combination of the above-described groups, such as an aralkylene group.

The divalent group for $L_1$, $L_2$, $L_3$, $L_4$ and $L_5$ may be substituted. Useful substituents include, for example, the above described substituents for the arylene group represented by L. Among them, preferred are a carboxy group, a hydroxy group and an aryl group, and more preferred is a carboxy group. Furthermore, $L_1$, $L_2$, $L_3$, $L_4$ and $L_5$ may combine to form a ring such as a pyrrolidine ring.

Preferred as $L_1$, $L_2$, $L_3$, $L_4$ and $L_5$ is an alkylene group, particularly preferably methylene or ethylene.

Z represents an oxygen atom or a sulfur atom, provided that when L is an arylene group to which a residue containing a $-N(L_1-A_1)(L_2-A_2)$ group and a residue containing a $-A_3$ group are bonded at a position ortho to each other, that is, where L is represented by Formula (a), and k and n are 1, Z is not an oxygen atom.

In the present invention, L is preferably an arylene group. The compound in this case has fewer nitrogen atoms per molecule, such that the nitrogen component in a waste solution thereof is reduced.

The monoamine compound of formula (I) which can be used in the present invention may be in the form of an ammonium salt or a salt with an alkali metal such as lithium, potassium, sodium, and the like.

Preferred monoamine compounds of formula (I) and salts thereof are those represented by formula (I-a) or (I-b), with those of formula (I-a) being particularly preferred:

(I-a)

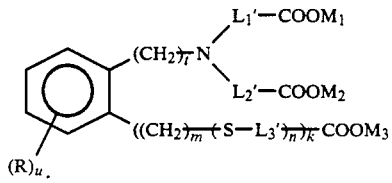

(I-b)

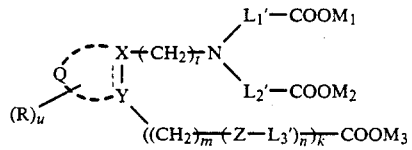

wherein $L_1'$, $L_2'$ and $L_3'$ each represents an alkyl group, $M_1$, $M_2$ and $M_3$ each represents a hydrogen atom or a cation, R and u have the same meanings as in formula (a) and (b), X, Y and Q have the same meanings as in formula (b), and Z, t, m, n and k have the same meanings as in formula (I).

Examples of the alkylene group for $L_1'$, $L_2'$ and $L_3'$ are those described for the alkylene group for $L_1$ to $L_5$ in formula (I). Examples of the cation for $M_1$, $M_2$ and $M_3$ includes an alkali metal (e.g., lithium, sodium and potassium), an ammonium (e.g., ammonium and tetraethylammonium), pyridinium, and the like.

In the present invention, t, k, m, and n are preferably 0.

Useful examples of the compound represented by formula (I) are given below, but the present invention should not be constructed as being limited thereto.

1.

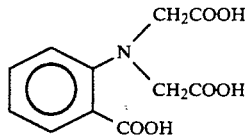

2.

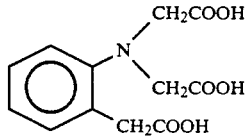

3.

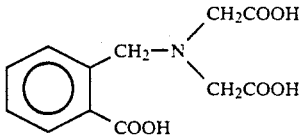

-continued
4.
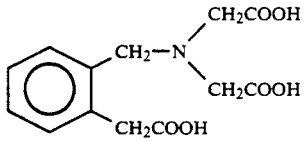
5.
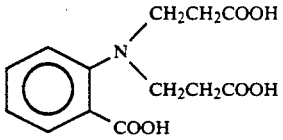
6.
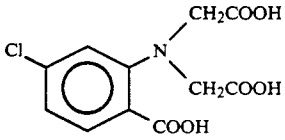
7.
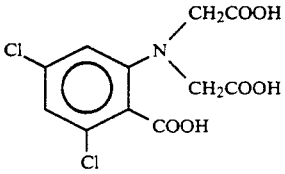
8.
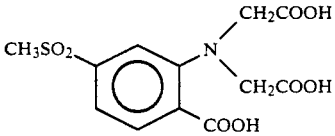
9.
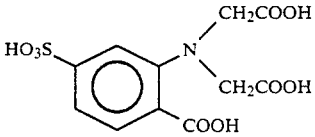
10.
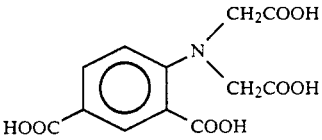
11.
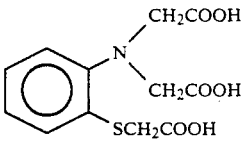
12.
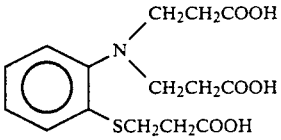
13.
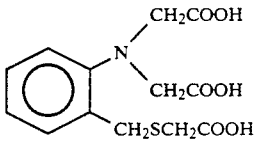
14.
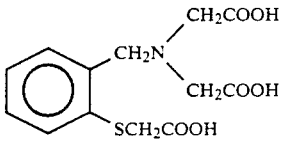
-continued
15.
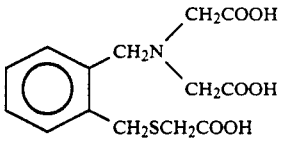
16.
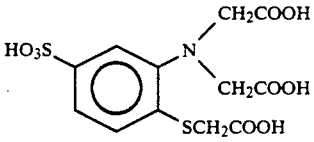
17.
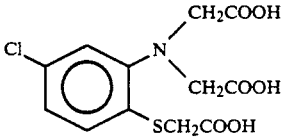
18.
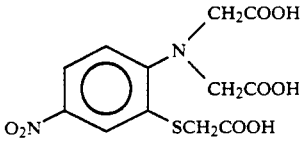
19.
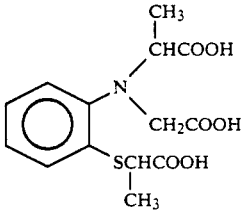
20.
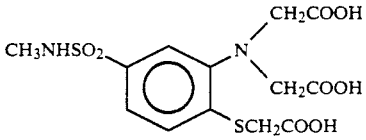
21
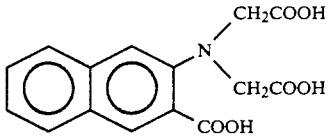
22
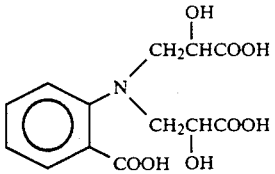
23
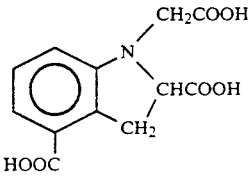

-continued
24
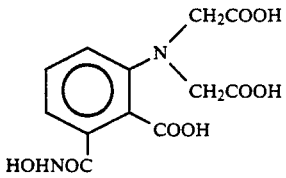
25
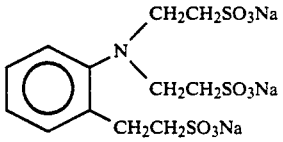
26
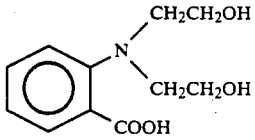
27
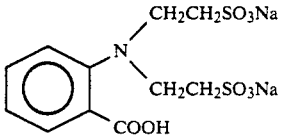
28
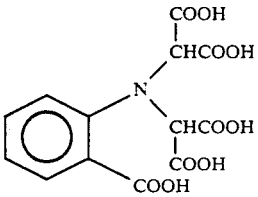
29
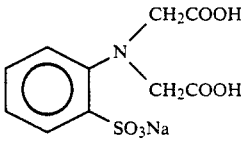
30
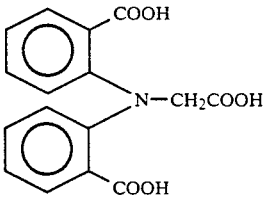
31
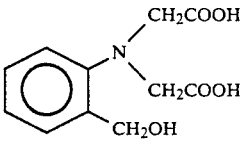
32
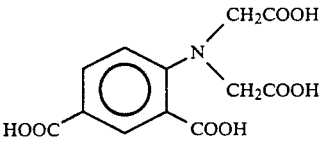
33
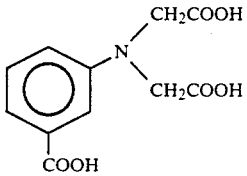
-continued
34
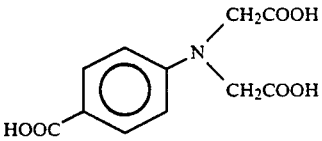
35
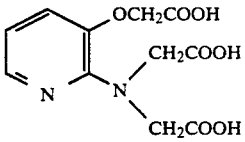
36
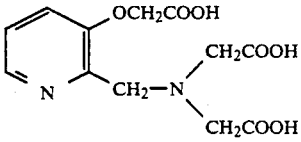
37
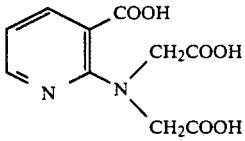
38
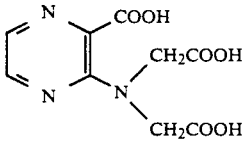
39
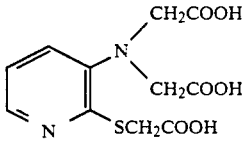
40
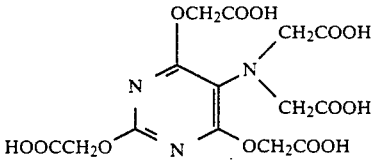
41
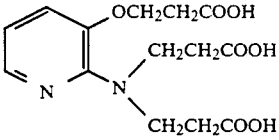
42
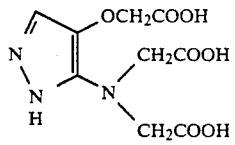
43
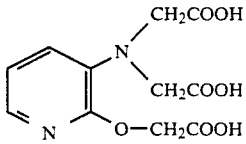

-continued
44
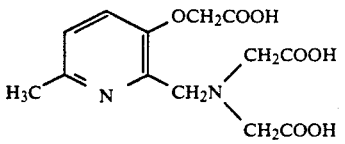
45
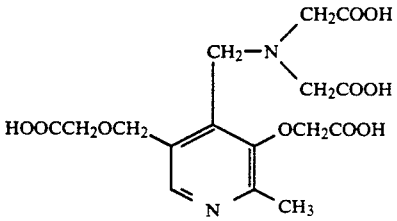
46
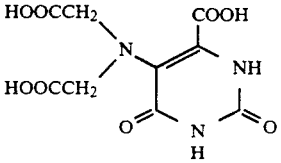
47
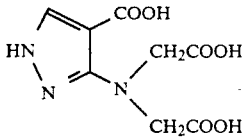
48
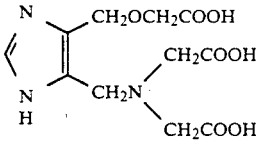
49
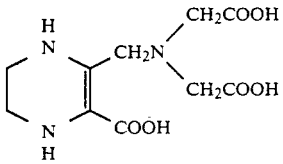
50
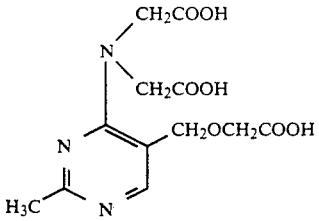
51
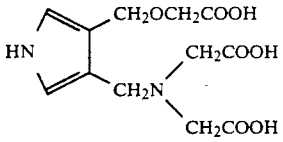
52
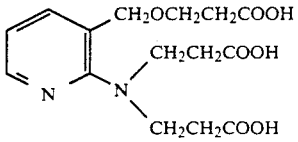
-continued
53
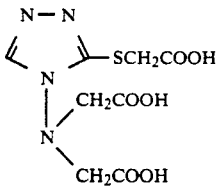
54
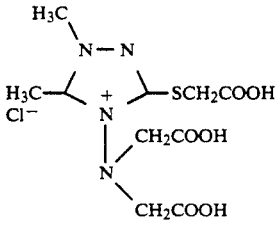
55
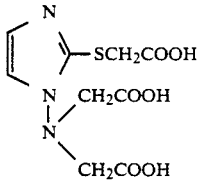
56
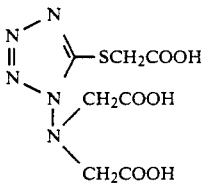
57
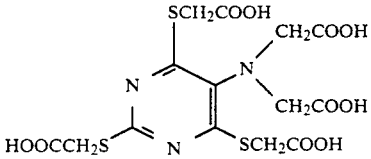
58
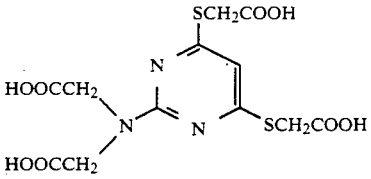
59
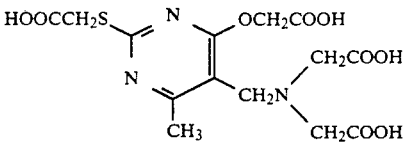
60
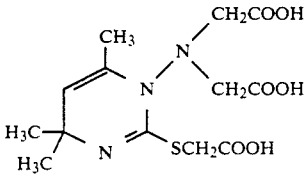

-continued
61
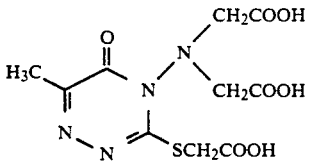
62
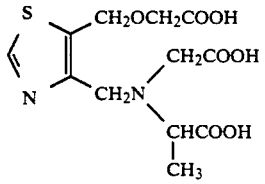
63
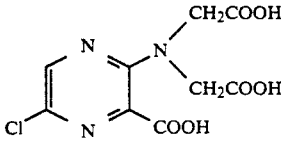
64
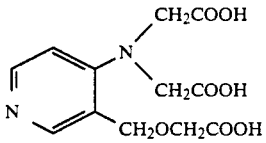
65
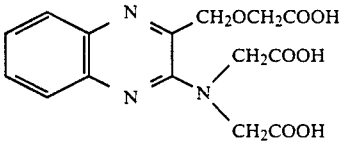
66
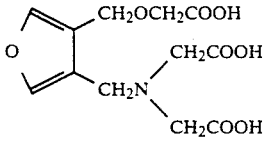
67
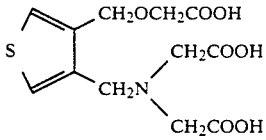
68
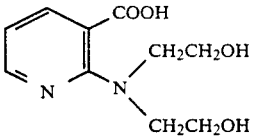
69
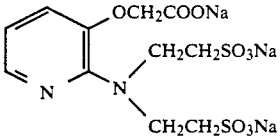
70
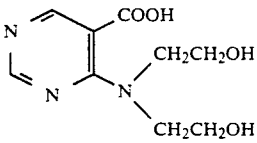
-continued
71
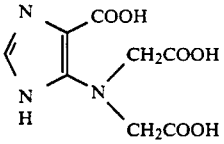
72
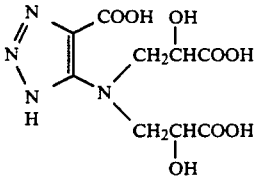
73
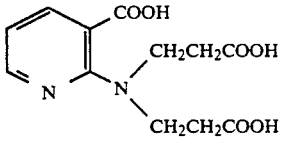
74
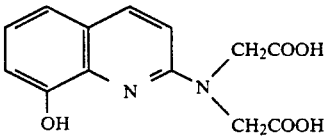
75
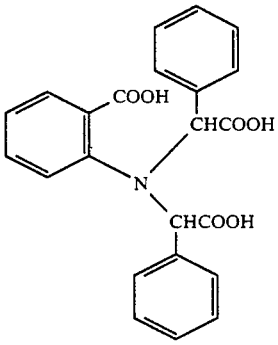
76
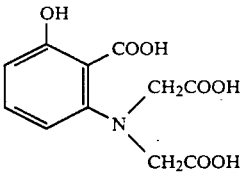
77
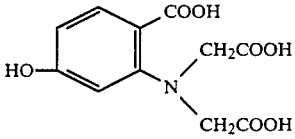
78
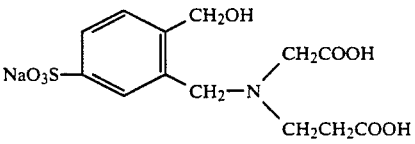
79
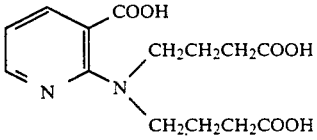

-continued

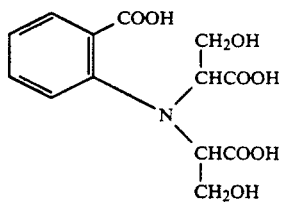

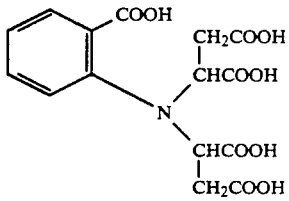

Next, the representative examples of the synthesis of the compounds of the present invention are shown below.

SYNTHETIC EXAMPLE 1

Synthesis of Compound 1

Anthranilic acid 20.0 g (0.146 mole) and water 20 ml were placed in a three neck flask and a 5N sodium hydroxide aqueous solution 29.2 ml (0.146 mole) was added thereto while stirring well in an ice bath. After dissolving the anthranilic acid, the temperature of the solution was raised to room temperature and chloroacetic acid 52.3 g (0.449 mole) was added thereto. The solution was heated to 60° C. in an oil bath while stirring and a 5N sodium hydroxide aqueous solution 85 ml was added dropwise (thereto in such a manner as to maintain the reaction solution at pH 9 to 11).

After heating and stirring for twenty hours, the temperature was lowered to room temperature, and concentrated hydrochloric acid 45.6 g (0.450 mole) was added thereto. The deposited crystals were filtered off and washed with water. The crystals were placed in a beaker and water 300 ml was added thereto, followed by adjusting the pH to 1.6 to 1.7 with concentrated hydrochloric acid. After stirring for one hour, the solid matter was filtered and washed well with water. The solid matter was recrystallized with water to thereby obtain the desired Compound 1 as a $\frac{1}{3}$ hydrate in an amount of 25.7 g (0.0991 mole). Yield 68%.

Melting point: 214° to 216° C. (decomposition).

Elemental analysis as $C_{11}H_{11}NO_6 \cdot \frac{1}{3} H_2O$:

| | H (%) | C (%) | N (%) |
|---|---|---|---|
| Calculated value | 4.53 | 50.97 | 5.40 |
| Measured value | 4.46 | 51.13 | 5.44 |

SYNTHETIC EXAMPLE 2

Synthesis of Compound 11

Ortho-aminothiophenol 50.0 g (0.399 mole) was dissolved in water 300 ml under a nitrogen atmosphere. Then, an aqueous solution 300 ml of sodium chloroacetic acid 153 g (1.31 mole) was added while heating and stirring at 80 to 85° C. After the temperature was raised to 90 to 95° C., an aqueous solution 100 ml of sodium hydroxide 52.4 g (1.31 mole) was slowly dropwise added thereto. After continuing the reaction at the same temperature for 5 hours, the solution was cooled to room temperature and the pH was adjusted to about 1.7 with 5N hydrochloric acid. The deposited solid matter was filtered and then washed with water to thereby obtain the desired Compound 11 as a $\frac{1}{3}$ hydrate in an amount of 84.7 g (0.283 mole). Yield 71%.

The structure thereof was confirmed by NMR spectroscopy and elemental analysis.

Elemental analysis:

| | H (%) | C (%) | N (%) | S (%) |
|---|---|---|---|---|
| Calculated value | 4.38 | 48.16 | 4.68 | 10.71 |
| Measured value | 4.46 | 48.01 | 4.52 | 10.53 |

SYNTHETIC EXAMPLE 3

Synthesis of Compound 21

3-Amino-2-naphthoic acid 23.4 g (0.10 mole) and sodium hydroxide 4.0 g (0.10 mole) were dissolved in water 65 ml and then, an aqueous solution 15 ml of sodium chloroacetate 39.3 g (0.32 mole) was slowly dropwise added while heating and stirring at 100° C. to maintain the pH at 7 to 10. After completing the addition, the reaction was continued at 100° C. for an additional 4 hours and then, the solution was cooled to a room temperature, followed by adding 2 g of active carbon. The active carbon was filtered off, and the filtrate was added to a solution of concentrated hydrochlorc acid (37 ml) and water (86 ml). The precipitated solids were filtered and recrystallized with acetonitrile to thereby obtain the desired compound in an amount of 22.4 g (0.074 mole). Yield: 74%.

The structure thereof was confirmed by NMR spectroscopy and elemental analysis.

Melting point: 214° to 215° C. (decomposition).

Elemental analysis:

| | H (%) | C (%) | N (%) |
|---|---|---|---|
| Calculated value | 4.32 | 59.41 | 4.62 |
| Measured value | 4.50 | 59.18 | 4.51 |

SYNTHETIC EXAMPLE 4

Synthesis of Compound 35

2-Amino-3-hydroxypyridine 43.9 g (0.399 mole) was dissolved in water 300 ml under a nitrogen atmosphere and then, an aqueous solution 300 ml of sodium chloroacetate 153 g (1.31 mole) was added while heating and stirring at 80° to 85° C. After the temperature was raised to 90° to 95° C., an aqueous solution 00 ml of sodium hydroxide 52.4 g (1.31 mole) was slowly dropwise added thereto. After continuing the reaction at the same temperature for 7 hours, the solution was cooled to room temperature, and concentrated hydrochloric acid 133 g (1.31 mole) was added thereto. The solution was allowed to stand for one day and then, the precipitated solid matter was filtered, followed by washing with water to thereby obtain 65.8 g (0.232 mole) of the desired compound 35. Yield 58%.

The structure thereof was confirmed by NMR spectroscopy and elemental analysis.

Elemental analysis:

| | H (%) | C (%) | N (%) |
|---|---|---|---|
| Calculated value | 4.26 | 46.48 | 9.86 |
| Measured value | 4.38 | 46.31 | 9.74 |

The compounds represented by formula (I) can be applied to every processing composition for use in processing a silver halide photographic light-sensitive material. Examples thereof include a general purpose black-and-white developing solution, an infectious developing solution for a lith film, a color developing solution, a bleaching solution, a fixing solution, a bleach-fixing solution, a controlling solution, a stopping solution, a hardening solution, a stabilizing solution, a rinsing solution, (sometimes herein referred to as "rinsing water" or "washing water"), a fogging solution, a color toning solution, and the replenishing solutions thereof. However, application of the compound represented by formula (I) is not limited thereto. These processing compositions can be provided as a powder composition but they are used in the form of an aqueous solution when applied to the light-sensitive material.

An addition amount of the compound of formula (I) or salt thereof depends on the type of processing composition added, and is generally in the range of 10 mg to 50 g per liter of the processing solution.

More particularly, when the compound of formula (I) or salt thereof is added, for example, to a black-and-white developing solution or a color developing solution, a preferred addition amount thereof is 0.5 to 10 g per liter of the processing solution, particularly preferably 0.5 to 5 g per liter of a processing solution.

Also, when the compound of formula (I) or salt thereof is added to a bleaching solution (for example, a solution containing hydrogen peroxide, persulfuric acid and bromic acid), a preferred addition amount thereof is 0.1 to 20 g per liter of the bleaching solution, particularly preferably 0.1 to 5 g per liter of the bleaching solution.

When the compound of formula (I) or salt thereof is added to a fixing solution or a bleach-fixing solution, a preferred addition amount thereof is 1 to 40 g per liter of the processing solution, particularly preferably 1 to 20 g per liter of the processing solution.

When the compound of formula (I) or salt thereof is added to a rinsing solution or a stabilizing solution, a preferred addition amount thereof is 50 mg to 1 g per liter of the processing solution, particularly preferably 50 to 300 mg per liter of the processing solution.

The processing solution may contain a single kind of compound of formula (I) or salt thereof, or a combination of two or more kinds thereof.

The monoamine compound represented by formula (I) is converted to the form of a metal chelating compound prepared from a salt of metal selected from Fe (III), Mn (III), Co (III), Rh (II), Rh (III), Au (II), Au (III), and Ce (IV) for use as a bleaching agent in processing a silver halide color photographic light-sensitive material. In one embodiment, after color developing, the imagewise exposed silver halide color photographic light-sensitive material is processed with a processing composition containing at least one metal chelating compound of the present invention. As a result, the developed silver is very rapidly bleached and a marked bleaching fog caused by a conventional bleaching agent having a rapid bleaching capability is prevented. This effect of the present invention is pronounced when processing is carried out with a processing composition containing a metal chelating compound of the present invention following a rapid color development having a processing time of three minutes or less. Furthermore, good image preservability and handling characteristics after processing are obtained in accordance with the above described embodiment of the invention.

The metal of the metal chelating compound of the present invention is selected from the group consisting of Fe (III), Mn (III), Co (III), Rh (II), Rh (III), Au (II), Au (III), and Ce (IV). More preferred are Fe (III), Mn (III) and Ce (IV), and particularly preferred is Fe (III).

The metal chelating compounds of the present invention may be prepared by reacting the compounds represented by formula (I) with the salts of the above metals in aqueous solution (for example, a ferric sulfate salt, a ferric chloride salt, a ferric nitrate salt, a ferric ammonium sulfate salt, and a ferric phosphate salt).

Similarly, the metal chelating compound of the present invention may be prepared by reacting the ammonium salts and alkali metal salts (for example, a lithium salt, a sodium salt and a potassium salt) of the compounds of formula (I) with the salts of the above metals in aqueous solution.

The compound represented by formula (I) is used in a mole ratio of 1.0 or more to the metal ion. This ratio is preferably large where the stability of the metal chelating compound is low, and is generally in the range of 1 to 30.

Furthermore, a previously prepared and isolated metal chelating compound of the present invention may be used (as opposed to forming the metal chelate compound in the processing solution).

Useful examples and synthetic examples of the metal chelating compounds of the present invention are shown below, but the present invention should not be construed as being limited thereto.

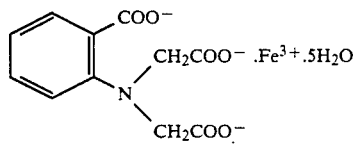

K-1

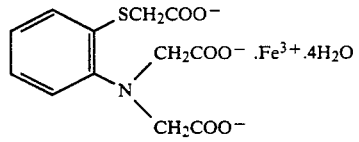

K-2

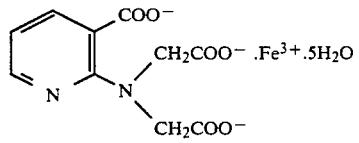

K-3

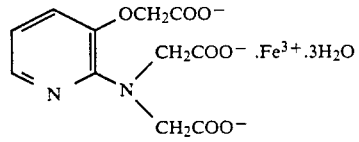

K-4

-continued

K-5

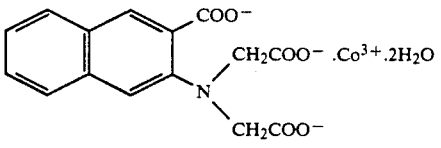

K-6

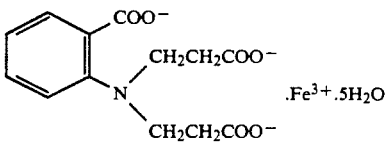

K-7

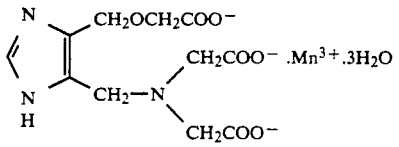

K-8

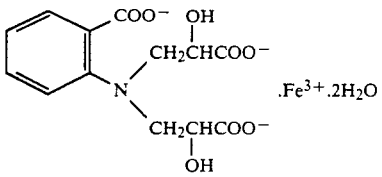

K-9

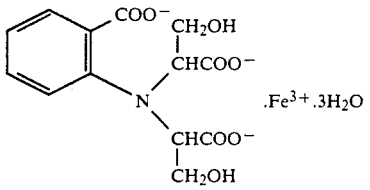

K-10

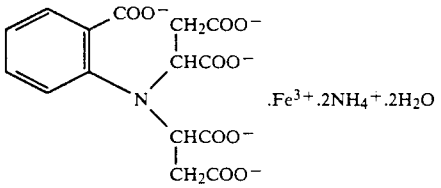

SYNTHETIC EXAMPLE 5

Synthesis of Compound K-1

46.4 g (0.179 mole) which was synthesized in Synthetic Example 1 was suspended in water 46 ml, and a 29 wt % aqueous ammonia solution 10.5 g (0.179 mole) was added to dissolve the compound. An aqueous solution 72 ml containing dissolved iron (III) nitrate nonahydrate 72.3 g (0.179 mole) was added thereto and then, a 29 wt % aqueous ammonia solution was added to adjust the pH to 4.6. After filtering the solution, a 1N $HNO_3$ aqueous solution was added to adjust the pH to 2.9. The precipitated crystals were filtered and then washed with water and acetone, followed by drying to thereby obtain Compound K-1 65.8 g (0.166 mole) as a yellow solid substance.

Yield: 93%.

Melting point: ≧130° C. (decomposition).

IR spectrum KBr): $V_{cvo}$ 1610 $cm^{-1}$

Elemental analysis $C_{11}H_8NO_6.Fe.5H_2O$ (molecular weight: 396.11):

| | H (%) | C (%) | N (%) |
|---|---|---|---|
| Calculated value | 4.58 | 33.35 | 3.53 |
| Measured value | 4.59 | 33.20 | 3.56 |

The metal chelating compound is effective as a bleaching agent for a bleaching solution or a bleach-fixing solution in an amount of 0.005 to 1 mole per liter of the processing solution. The metal chelating compound of the present invention may also be incorporated into a fixing solution and an intermediate bath between a color developing step and a desilvering step in a small amount (e.g., less than 0.005 mole per liter of the processing solution).

A processing solution having a bleaching ability (a general term for a bleaching solution or a bleach-fixing solution) in a preferred embodiment of the present invention is described below.

The metal chelating compound of the present invention is effectively contained as a bleaching agent in a processing solution having a bleaching ability in an amount of 0.005 to 1 mole per liter of the processing solution, more preferably 0.01 to 0.5 mole, and particularly preferably 0.05 to 0.5 mole per liter of the processing solution. In the case of a metal chelating compound where t and k in formula (I) are 0, excellent performance can be obtained even with a diluted solution of the compound the concentration of which is 0.005 to 0.2 mole, preferably 0.01 to 0.2 mole and more preferably 0.05 to 0.15 mole per liter of the processing solution.

When used as a bleaching agent in a processing solution having a bleaching ability, the metal chelating compound of the present invention may be used in combination with other bleaching agents as long as the effects of the present invention are obtained. The addition amount of bleaching agents other than the metal chelating compound of the present invention is preferably 0.01 mole or less, more preferably 0.005 mole or less per liter of the processing solution. Examples of such bleaching agents include Fe (III , Co (III) and Mn (III) chelating type bleaching agents of the following compounds, persulfates (for example, peroxo disulfate), hydrogen peroxide, and bromates.

Examples of compounds for forming the above chelating type bleaching agents include ethylenediaminetetracetic acid, diethylenetriaminepentacetic acid, ethylenediamine-N-(β-oxyethyl)-N,N',N'-triacetic acid, 1,2-diaminopropanetetraacetic acid, 1,3-diaminopropanetetracetic acid, nitrilotriacetic acid, cyclohexanediaminetetracetic acid, iminodiacetic acid, dihydroxyethyl glycine, ethyl ether diaminetetracetic acid, glycol ether diaminetetracetic acid, ethylenediaminetetrapropionic acid, phenylenediaminetetracetic acid, 1,3-diaminopropanol-N,N, ethylenediamine-N,N,N',N'-tetramethylenephosphonic acid, 1,3-propylenediamine-N,N,N',N'-tetramethylenephosphonic acid, nitrilodiacetic acid monopropionic acid, nitrilomonoacetic acid dipropionic acid, 2-hydroxy-3-aminopropionic acid-N,N-diacetic acid, serine-N,N-diacetic acid, 2-methyl-serine-N,N-diacetic acid, 2-hydroxymethyl-serine-N,N-diacetic acid, hydroxyethyliminodiacetic acid, methyliminodiacetic acid, N-(2-acetamide)iminodiacetic acid, nitrilotripropionic acid, ethylenediaminediacetic acid, ethylenediaminedipropionic acid, 1,4-diaminobutanetetracetic acid, 2-methyl-1,3-diaminopropanetetracetic acid, 2-dimethyl-1,3-diamino-propanetetracetic acid, citric acid, and the alkali metal salts (for example, a lithium salt, a sodium salt and a potassium salt) and ammonium salts thereof. However, the present invention is not limited thereto.

The processing solution containing the metal chelating compound of the present invention and having a bleaching ability preferably contains a halide such as a chloride, bromide or iodide as a rehalogenizing agent as well as the metal chelating compound. Also, the halides may be substituted with an organic ligand to form a sparingly soluble silver salt. The halide can be added in the form of an alkali metal salt, an ammonium salt, a guanidine salt, and an amine salt. Useful examples include sodium bromide, ammonium bromide, potassium chloride, guanidine hydro-chlorate, potassium bromide, and potassium chloride. In general, ammonium bromide is preferred as a rehalogenizing agent with respect to bleaching ability. However, in view of environmental considerations (e.g., reduced nitrogen discharge), it is desired that the processing solution substantially contains no ammonium ion. In a processing solution containing the metal chelating compound of the present invention as a bleaching agent, good bleaching ability is obtained with sodium bromide and potassium bromide and without using ammonium bromide. Thus, sodium bromide and potassium bromide are preferably used as a rehalogenizing agent. In a processing solution having a bleaching ability of the present invention, the addition amount of the rehalogenizing agent is 2 mole/liter or less, preferably 0.01 to 2.0 mole/liter, and more preferably 0.1 to 1.7 mole/liter.

In the present invention, the expression "substantially containing no ammonium ion" means a concentration of ammonium ion of 0.1 mole/liter or less, preferably 0.08 mole/liter or less, more preferably 0.01 mole/liter or less, and most preferably not containing ammonium ion.

A bleach-fixing solution containing a metal chelating compound of the present invention contains a fixing agent described below) as well as the metal chelating compound and further, can contain the above rehalogenizing agent as needed. When a rehalogenizing agent is used in the bleach-fixing solution, the addition amount thereof is 0.001 to 2.0 mole/liter, preferably 0.001 to 1.0 mole/liter. In addition, the bleaching solution or a bleach-fixing solution of the present invention may contain a bleaching accelerator, a corrosion inhibitor for preventing corrosion of a processing bath, a buffer agent for maintaining the pH of a processing solution, a fluorescent whitening agent, and a defoaming agent as needed.

Useful bleaching accelerators include, for example, the compounds having a mercapto group or a disulfide group, described in U.S. Pat. No. 3,893,858, German Patent 1,290,812, British Patent 1,138,842, JP-A-53-95630, and Research Disclosure No. 17129 (1978); the thiazolidine derivatives described in JP-A-50-140129; thiourea derivatives described in U.S. Pat. No. 3,706,561; iodides described in JP-A-58-16235; polyethylene oxides described in German Patent 2,748,430; the polyamine compounds described in JP-B-45-8836; and the imidazole compounds described in JP-A-49-40493. Of the above compounds, preferred are the mercapto compounds described in British Patent 1,138,842.

Furthermore, nitrate is preferably used as a corrosive inhibitor, and ammonium nitrate and potassium nitrate are practically used. The addition amount thereof is 0.01 to 2.0 mole/liter, preferably 0.05 to 0.5 mole/liter.

The pH of the bleaching solution or bleach-fixing solution of the present invention is generally 2.0 to 8.0, preferably 3.0 to 7.5. Where bleaching or bleach-fixing is carried out immediately after color development in processing a light-sensitive material for photographing, the processing solution is used at a pH of 7.0 or lower, preferably 6.4 or lower in order to suppress bleaching fog. Particularly, the bleaching solution pH is preferably 3.0 to 5.0. At a pH of 2.0 or lower the metal chelating agent of the present invention becomes unstable, and accordingly, a pH of 2.0 to 6.4 is preferred. The preferred pH range is 3 to 7 for a color printing material.

The pH buffer agent for use in the processing solution of the present invention is not particularly limited, as long as it is not susceptible to oxidation by a bleaching agent and has a buffer action in the above pH range. Useful buffer agents include, for example, organic acids such as acetic acid, glycolic acid, lactic acid, propionic acid, butyric acid, malic acid, chloroacetic acid, levulinic acid, ureidopropionic acid, formic acid, monobromoacetic acid, monochloropropionic acid, pyruvic acid, acrylic acid, isobutyric acid, pavaric acid, aminolactic acid, valeric acid, isovaleric acid, asparagine, alanine, arginine, ethionine, glycine, glutamine, cysteine, serine, methionine, leucine, histidine, benzoic acid, chlorobenzoic acid, hydroxybenzoic acid, nicotinic acid, oxalic acid, malonic acid, succinic acid, tartaric acid, maleic acid, fumaric acid, oxalo acid, glutaric acid, adipic acid, aspartic acid, glutamic acid, cystine, ascorbic acid, phthalic acid, and terephthalic acid, organic bases such as pyridine, dimethylpyrazole, 2-methyl-o-oxazoline, aminoacetonitrile, and imidazole. The buffer agents may be used in a combination of two or more. In the present invention, organic acids having a pKa of 2.0 to 5.5 are preferred as the buffer agent. Particularly preferred is acetic acid, glycolic acid or the combined use of acetic acid and glycolic acid.

The above described organic acids can be used in the form of an alkali metal salt (for example, a lithium salt, a sodium salt and a potassium salt) and an ammonium salt.

The addition amount of the buffer agent is suitably 3.0 mole or less, preferably 0.1 to 2.0 mole, and more preferably 0.4 to 1.5 mole per liter of the processing solution of the present invention having a bleaching ability.

In order to the control pH of a processing solution of the present invention having a bleaching ability, the above acids and alkali agents (for example, aqueous ammonia, KOH, NaOH, potassium carbonate, sodium carbonate, imidazole, monoethanolamine, and diethanolamine) may be used in combination. Of them, preferred are aqueous ammonia, KOH, NaOH, potassium carbonate, and sodium carbonate.

During processing, the processing solution of the present invention having a bleaching ability is preferably aerated to oxidize iron (III) salt generated in the bleaching reaction. This procedure regenerates the bleaching agent, to thereby provide stable photographic properties.

Conventional means known in the art can be applied to the aeration. For example, air may be blown into a processing solution having a bleaching ability, or air may be absorbed utilizing an ejector. As to the first means, air is preferably discharged in a solution through a diffusion tube having fine pores. Such diffusion tubes are widely used for aeration tanks and other types of vessels in an active sludge treatment. Details of the aeration technique are described in Z-121, *Using Process* published by Eastman Kodak Co., Ltd., C-41 the 3rd edition (1982), pp. BL-1 to BL-2.

The bleaching or bleach-fixing step can be carried out within a temperature range of 30° to 60° C., preferably 35° to 50° C. The processing time for the bleaching or bleach-fixing step is in the range of 10 seconds to 7 minutes, and preferably 10 seconds to 4 minutes in case of a light-sensitive material for photographing. Also, the processing time is 5 to 70 seconds, preferably 5 to 60 seconds, and more preferably 10 to 45 seconds in case of a light-sensitive material for printing. Rapid processing and excellent results without an increase in staining have been achieved using these preferred processing conditions.

A fixing agent is added to a bleach-fixing solution or a fixing solution. Useful fixing agents include thiosulfates, thiocyanates, thioethers, amines, mercaptos, thiones, thioureas, iodides, and mesoion type compounds. Examples thereof include ammonium thiosulfate, sodium thiosulfate, potassium thiosulfate, guanidine thiosulfate, ammonium thiocyanate, sodium thiocyanate, potassium thiocyanate, dihydroxyethylthioether, 3,6-dithia-1,8-octanediol, and imidazole. Among them, thiosulfates and mesoion type compounds are preferred. For rapid fixing, ammonium thiosulfate is preferred but thiosulfates and mesoion type compounds are further preferred as substantially excluding ammonium ion from the processing solution due to the above described environmental considerations. Furthermore, two or more kinds of the fixing agents can be used in combination to accelerate processing.

In addition to ammonium thiosulfate and sodium thiosulfate, for example, above ammonium thiocyanate, imidazole, thiourea, and thioether are preferably used in combination. In this case, the second fixing agent is added preferably within the range of 0.01 to 100 mole % based on the ammonium thiosulfate and sodium thiosulfate content.

The addition amount of the fixing agent is 0.1 to 3.0 mole, preferably 0.5 to 2.0 mole per liter of the bleach-fixing solution or a bleaching solution.

The pH of the fixing solution depends on the kind of a fixing agent employed, and is generally 3.0 to 9.0. Especially when thiosulfates are used, the pH is preferably 5.8 to 8.0 for obtaining stable bleaching performance.

A preservative can be added to the bleach-fixing solution and fixing solution of the present invention to increase storage stability of a solution. In case of a bleach-fixing solution or fixing solution, effective preservatives include sulfite, hydroxylamine, hydrazine, and a bisulfite adduct of aldehyde (for example, a bisulfite adduct of acetaldehyde, particularly preferably a bisulfite adduct of aromatic aldehyde described in JP-A-1-298935). Furthermore, the sulfinic acid compounds described in JP-A-62-143048 also are preferably used.

Also, a buffer agent is preferably added to a bleach-fixing solution and a fixing solution in order to maintain a constant pH. Examples thereof include phosphate, imidazole, imidazoles such as 1-methyl-imidazole, 2-methyl-imidazole and 1-ethyl-imidazole, triethanolamine, N-allylmorpholine, and N-benzoyl-piperazine.

Furthermore, in the fixing solution, various chelating agents can be added to mask iron ion carried over from a bleaching solution to improve the stability thereof. Preferred chelating agents for this purpose include 1-hydroxy-ethylidene- 1,1-diphosphonic acid, nitrilomethylenephosphonic acid, 2-hydroxy-1,3-diaminopropanetetracetic acid, ethylenediaminetetracetic acid, diethylenetriaminepentacetic acid, ethylenediamine-N-(β-oxyethyl)-N,N',N'-triacetic acid, 1,2-diaminopropanetetracetic acid, 1,3-diaminopropanetetracetic acid, nitrilotriacetic acid, cyclohexanediaminetetracetic acid, iminodiacetic acid, dihydroxyethyl glycine, ethyl ether diaminetetracetic acid, glycol ether diaminetetracetic acid, ethylenediaminetetrapropionic acid, phenylenediaminetetracetic acid, 1,3-diaminopropanol-N,N,N',N'-tetramethylenephosphonic acid, ethylenediamine-N,N,N',N'-tetramethylenephosphonic acid, 1,3-propylene-N,N,N',N'-tetramethylenephosphonic acid, serine-N,N-diacetic acid, 2-methyl-serine-N,N-diacetic acid, 2-hydroxymethyl-serine-N,N-diacetic acid, hydroxyethyliminodiacetic acid, methyliminodiacetic acid, N-(2-acetamide)-iminodiacetic acid, nitrilotripropionic acid, ethylenediaminediacetic acid, ethylenediaminedipropionic acid, 1,4-diaminobutanetetracetic acid, 2-methyl-1,3-diaminopropanetetracetic acid, 2-dimethyl-1,3-diaminopropanetetracetic acid, alanine, tartaric acid, hydrazidediacetic acid, and N-hydroxyiminodipropionic acid, the compounds of the present invention represented by formula (I) and the metal salts (for example, a lithium salt, a sodium salt and a potassium salt) and ammonium salts thereof.

The fixing step can be carried out within a temperature range of 30° to 60 ° C., preferably 35° to 50 ° C. The processing time for the fixing step is 15 seconds to 2 minutes, preferably 25 seconds to 1 minute and 40 seconds in the case of a light-sensitive material for photographing, and 8 to 40 seconds, preferably 10 to 45 seconds in the case of a light-sensitive material for printing.

In the present invention, a desilvering step comprises various combinations of a bleaching step, a fixing step and a bleach-fixing step, and representative examples thereof are shown below:

(1) bleaching-fixing,
(2) bleach-bleach/fixing,
(3) bleaching-bleach/fixing-fixing,
(4) bleaching-rinsing-fixing,
(5) bleach/fixing, and
(6) fixing-bleach/fixing.

A preferred desilvering process for a light-sensitive material for photographing is (1), (2), (3) or (4), more preferably (1), (2) or (3). Preferred for a light-sensitive material for printing is (5). The present invention can be applied to a desilvering processing in which, for example, a stopping bath and a rinsing bath are included after color development processing.

In the desilvering processing step such as bleaching, bleach-fixing and fixing in accordance with the present invention, the processing bath is vigorously agitated (stirred) to the extent possible to enhance the effects of the present invention. Useful methods for increasing agitation include jetting a stream of the processing solution against an emulsion layer surface, as described in JP-A-62-183460 and 62-183461; employing a rotating means, as described in JP-A-62-183461; moving a light-sensitive material immersed in the processing solution while contacting the emulsion surface with a wiper blade to result in a turbulent flow at the emulsion layer surface; and increasing the circulation rate of the entire processing solution. Particularly preferred is the above described jet stirring method. Furthermore, the jetting means is more effective where a bleach accelerating agent is used. The above stirring means are preferably applied to a color developing solution and a rinsing or stabilizing solution.

The processing method in accordance with the present invention is preferably carried out using an automatic developing machine. A transporting method for use in such an automatic developing machine is described in JP-A-60-191257, 60-191258, and 60-191259. Furthermore, a crossover time is preferably shortened in an automatic developing machine adopted for rapidly processing. An automatic developing machine having a crossover time of 5 seconds or less is described in JP-A-1-319038.

When a continuous processing is carried out using an automatic development machine in accordance with the processing method of the present invention, a replenishing solution is preferably added to the processing bath in an amount depending on the quantity of the light-sensitive material processed. The replenishing solution replenishes to active components consumed in processing, and controls the accumulation of undesirable components eluted from a light-sensitive material into the processing solution.

Two or more processing baths may be provided for carrying out any of the processing steps. In this case, a countercurrent system is preferably used wherein a replenishing solution is introduced into a later bath and the overflow is introducted into a prior bath. Particularly in the rinsing step and a stabilizing step, a cascade of 2 to 4 stages is preferably used.

The amount of a replenishing solution is preferably reduced as long as the composition change in the respective processing solutions does not diminish photographic properties or result in staining.

The amount of replenishing solution for a color developing solution is 50 to 3000 ml, preferably 50 to 2200 ml per $m^2$ for a color photographic material, and is 15 to 500 ml, preferably 20 to 350 ml per $m^2$ for a color printing material.

The amount of replenishing solution for a bleaching solution is 10 to 1000 ml, preferably 50 to 550 ml per $m^2$ for a color photographic material, and is 15 to 500 ml, preferably 20 to 300 ml per $m^2$ for a printing material.

The amount of replenishing solution for a bleach-fixing solution is 200 to 3000 ml, preferably 250 to 1300 ml per $m^2$ for a color photographic material, and is 20 to 300 ml, preferably 50 to 200 ml/$m^2$ for a printing material. The bleach-fixing solution may be replenished as a single solution, as a bleaching composition and a fixing composition, or as a bleach-fixing replenishing solution prepared by mixing the overflow solutions from a bleaching bath and a fixing bath.

The amount of a replenishing solution for a fixing solution is 300 to 3000 ml, preferably 300 to 1200 ml per $m^2$ for a color photographic material, and 20 to 300 ml, preferably 50 to 200 ml per $m^2$ for a printing material.

The replenishing amount for a rinsing solution or a stabilizing solution is 1 to 50 times, preferably 2 to 30 times and more preferably 2 to 15 times the amount carried over from a preceding bath per unit area of the photographic material processed.

In order to further reduce the amount of the foregoing replenishing solutions and waste solutions for environmental conservation, various regeneration methods can be used. Regeneration may be carried out while circulating the processing solution in an automatic developing machine, or the processing solution may be removed from its processing bath, subjected to a suitable regeneration processing, and returned to the processing bath as a replenishing solution.

A metal chelating bleaching agent contained in a bleaching solution and/or a bleach-fixing solution is converted to a reduced form while carrying out the bleaching processing. Accordingly, a continuous regeneration method is preferably employed to keep step with the processing. Particularly, aeration is preferred. Such regeneration is carried out by blowing air into the bleaching solution and/or bleach-fixing solution to reoxidize the metal chelating agent in a reduced form with oxygen. In addition to aeration oxidizing agents such as hydrogen peroxide, persulfate and bromate may be added for the regeneration.

Furthermore, a processing solution of the present invention having a bleaching ability can be reused for processing after recovering the overflowed solution, and adding consumed active components to adjust their composition. Details thereof are described in Processing Manual, Fuji Color Negative Film CN-16 Processing (revised in August 1990), pp. 39 to 40, published by Fuji Photo Film Co., Ltd.

A kit used for preparing a processing solution having a bleaching ability may be either in liquid form or powder form. The powder form is preferred since almost all the raw materials are supplied in a powder form and are less hygroscopic when ammonium salt is removed. Also in the above kit for regeneration, the powder form is preferred as well for reducing the amount of waste solution, since the kit components can be directly added to the processing bath without using extra water.

In addition to the above described aeration, the methods described in "The Fundamentals of Photographic Engineering-Silver Salt Photography" edited by the Japan Photographic Academy, published by Corona Co., Ltd. can be used for regeneration of a processing solution having a bleaching ability. Specifically, in addition to electrolytic regeneration, the bleaching solution may be regenerated using bromic acid, chlorous acid, bromine, a bromine precursor, persulfate, hydrogen peroxide, hydrogen peroxide together with a catalyst, bromous acid, and ozone. In regeneration by electrolysis, an anode and a cathode are placed in the same bleaching bath, or the regeneration is carried out using an anode bath and a cathode bath separated by a diaphragm. In addition thereto, a bleaching solution and a developing solution and/or a fixing solution can be concurrently and independently regenerated with a diaphragm during the course of continuous processing.

The bleaching solution and bleach-fixing solution may be regenerated by subjecting the accumulated silver ions to electrolytic reduction. For stable performance, accumulated halogen ions are preferably removed with an anionic ion exchange resin.

Ion exchange or ultrafiltration are used to reduce the amount of rinsing water, and ultrafiltration is preferably used.

The color developing solution for use in the present invention contains a known aromatic primary amine color developing agent. A preferred example is a p-phenylenediamine derivative, and representative examples thereof include 4-amino-N-ethyl-N-(β-hydroxyethyl)-3-methylaniline, 4-amino-N-ethyl-N-( 3-hydroxypropyl)-3-methylaniline, 4-amino-N-ethyl-N-(4-hydroxybutyl)-3-methylaniline, 4-amino-N-ethyl-N-(β-methanesulfonamidoethyl)-3-methylaniline, 4-amino-N-(3-carbamoylpropyl)-N-n-propyl-3-methylaniline, and 4-amino-N-ethyl-N-(β-hydroxyethyl)-3-methoxyaniline. Furthermore, the sulfate, chlorate, sulite, naphthalenedisulfonic acid and p-toluenesulfonic acid salts of these p-phenylenediamine derivatives may be used.

The addition amount of the aromatic primary amine developing agent is preferably 0.0002 to 0.2 mole, more preferably 0.001 to 0.1 mole per liter of the developing solution. A sulfite preservative may be added to the color developing solution as needed such as sodium sulfite, potassium sulfite, sodium bisulfite, potassium bisulfite, sodium metasulfite, potassium metasulfite and a carbonylsulfurous acid adduct.

The color developing solution preferably contains a compound which directly preserves the above described aromatic primary amine color developing agents such as the various hydroxylamines described, for example, in JP-A-63-5341 and 63-106655, and especially those compounds having a sulfo group and a carboxy group. Also preferably added to the color developing solution are the hydroxamic acids described in JP-A-63-43138, hydrazines and hydrazides described in JP-A-63-14604, phenols described in JP-A-63-44657 and JP-A-63-58443, α-hydroxyketones and α-aminoketones described in JP-A-63-44656, and/or the various sugars described in JP-A-63-36244. Also preferably used in combination with the above compounds are the monoamines described in JP-A-63-4235, JP-A-63-24254, JP-A-63-21647,JP-A-63-146040, JP-A-63-27841, and JP-A-63-25654, diamines described in JP-A-63-30845, JP-A-63-14640, and JP-A-63-43139, polyamines described in JP-A-63-21647, JP-A-63-26655, and JP-A-63-44655, nitroxy radicals described in JP-A-63-53551, alcohols described in JP-A-63-43140 and JP-A-63-53549, oximes described in JP-A-63-56654, and tertiary amines described in JP-A-63-239447.

Other preservatives as needed may be added to the color developing solution such as the various metal compounds described in JP-A-57-44148 and JP-A-57-53749, the salicylic acids described in JP-A-59-180588, alkanolamines described in JP-A-54-3582, polyethyleneimines described in JP-A-56-94349, and aromatic polyhydroxy compounds described in U.S. Pat. No. 3,746,544. The aromatic polyhydroxy compounds are preferable used. The addition amount of these preservatives is 0.005 to 0.2 mole, preferably 0.01 to 0.05 mole per liter of the color developing solution.

The color developing solution for use in the present invention has a pH of 9.0 to 12.0, preferably 9.5 to 11.5.

In addition to the above compounds, the color developing solution can contain other known additives generally employed in a color developing solution.

Various buffer agents are preferably added to maintain the pH of the color developing solution to within the above range. Useful examples of the buffer agent include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds. The addition amount of the buffer agent to a color developing solution is preferably 0.1 mole/liter or more, particularly preferably 0.1 to 0.4 mole/liter.

In addition to the above compounds, various chelating agents other than the compounds of the present invention represented by formula (I) can be added as a precipitation inhibitor for calcium and magnesium contained in a color developing solution, or for improving the stability of the color developing solution.

Organic acid compounds are preferred as the chelating agent, such as aminopolycarboxylic acids, organic phosphonic acid and phosphonocarboxylic acids. Representative examples of the organic acid compound include nitrilotriacetic acid, diethylenetriaminepentacetic acid, ethylenediaminetetracetic acid, N,N,N-trimethylenephosphonic acid, ethylenediamine-N,N, N',N'-tetramethylenephosphonic acid, transcyclohexanediamine-tetracetic acid, 1,2-diaminopropanetetracetic acid, hydroxyethyliminodiacetic acid, glycol ether diaminetetracetic acid, ethylenediamineorthohydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, nitrilodiacetic acid monopropionic acid, nitrilomonoacetic acid dipropionic acid, 2-hydroxy-3-aminopropionic acid-N,N-diacetic acid, serine-N,N-diacetic acid, 2-methyl-serine-N,N-diacetic acid, 2-hydroxymethyl-serine-N,N-diacetic acid, and ethylenediamine-N,N'-disuccinic acid. These chelating agents may be used in a combination of two or more kind thereof.

The addition amount of the chelating agent is that amount sufficient to mask metal ions, and is generally 0.001 to 0.05 mole, preferably 0.003 to 0.02 mole per liter of the color developing solution.

A development accelerator can be added to the color developing solution as needed. The type of development accelerator is not particularly limited. Examples of the development accelerator include the thioether compounds described in JP-B-37-16088, JP-B-37-5987, JP-B-38-7826, JP-B-44-12380, and JP-B-45-9019, and U.S. Pat. No. 3,818,247; the p-phenylenediamine compounds described in JP-A-52-49829 and JP-A-50-15554; the quaternary ammonium salts described in JP-A-50-137726, JP-B-44-30074, and JP-A-56-156826 and JP-A-52-43429; the amine compounds described in U.S. Pat. Nos. 2,494,903, 3,128,182, 4,230,796, and 3,253,919, JP-B-41-11431, and U.S. Pat. Nos. 2,482,546, 2,596,926, and 3,582,346; polyalkylene oxide described in JP-B-37-16088 and 42-25201, U.S. Pat. No. 3,128,183, JP-B-41-11431 and JP-B-42-23883, and U.S. Pat. No. 3,532,501; and imidazoles such as 2-methylimidazole and imidazole.

For rapid development, a 1-phenyl-3-pyrazolidone auxiliary developing agent is preferably added to the color developing solution as described in JP-A-56-64339, JP-A-57-144547 and JP-A-58-115438. An anti-foggant can further be added to a color developing solution used in the present invention as needed. The type of anti-foggant is not particularly limited. Examples of the anti-foggant include an alkali metal halide such as sodium chloride, potassium bromide and potassium iodide, and an organic anti-foggant. Useful examples of the organic anti-foggant include nitrogen-containing heterocyclic compounds such as benzotriazole, 6-nitrobenzimidazole, 5-nitrosoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, and adenine.

The color developing solution for use in the present invention may contain a fluorescent whitening agent.

The 4,4'-diamino-2,2'-disulfostilbene compounds are preferred as the fluorescent whitening agent. The addition amount thereof is 0 to 5 g, preferably 0.1 to 4 g per liter of the color developing solution. Furthermore, as needed, various kinds of surface active agents may be added such as alkylsulfonic acid, arylsulfonic acid, aliphatic carboxylic acid, and aromatic carboxylic acid.

The processing temperature of the color developing solution in accordance with the present invention is 20° to 55° C., preferably 30° to 55° C.

The processing time for the color developing step is 20 seconds to 5 minutes, preferably 30 seconds to 3 minutes and 20 seconds, and more preferably 1 minute to 2 minutes and 30 seconds for a light-sensitive material for photographing. It is 10 seconds to 1 minute and 20 seconds, preferably 10 to 60 seconds, and more preferably 10 to 40 seconds for a printing material.

The processing method of the present invention can applied to color reversal processing. A black-and-white developing solution is used for reversal processing of a conventional color light-sensitive material. Various well known compounds contained in a black-and-white developing solution used for processing a black-and-white silver halide light-sensitive material can be incorporated into the black-and-white developing solution used for reversal processing of a color light-sensitive material. In reversal processing, the black-and-white development preceeds color development. Representative additives to the black-and-white developing solution include a developing agent such as 1-phenyl-3-pyrozolidone, metol and hydroquinone, a preservative such as sulfite, an accelerator consisting of an alkali such as sodium hydroxide, sodium carbonate and potassium carbonate, an inorganic or organic inhibitor such as potassium bromide, 2-methylbenzimidazole and methylbenzthiazole, a water softening agent such as polyphosphoric acid, and a development inhibitor comprising a trace amount of iodide and a mercapto compound.

The effects of the present invention are also effectively demonstrated by adding the compound of the present invention represented by formula (I) to a rinsing water and/or a stabilizing solution.

Various surface active agents can be incorporated into the rinsing water for use in a rinsing step and/or a stabilizing solution in order to prevent watermarks from forming on the light-sensitive material in drying after processing. Useful surface active agents include a polyethylene glycol type nonionic surface active agent, a polyhydric alcohol type nonionic surface active agent, an alkylbenzenesulfonic acid salt type anionic surface active agent, a higher alcohol sulfuric acid ester salt type anionic surface active agent, an alkylnaphthalenesulfonic acid salt type anionic surface active agent, a quaternary ammonium salt type cationic surface active agent, an amine salt type surface active agent, an amino salt type amphoteric surface active agent, and a betaine type amphoteric surface active agent. Of these, the nonionic surface active agents are preferred. Particularly, the nonionic surface active agents in same cases combine with various ions introduced into the rinsing water and/or stabilizing solution during processing to form insoluble substances. Particularly preferred are the alkylphenolethylene oxide adducts where the alkylphenol is preferably an octyl-, nonyl-, dodecyl- or dinonylphenol. The adduct molar number of ethylene oxide is particularly preferably 8 to 14. Furthermore, a silicon type surface active agent having a high defoaming effect is preferably used as well.

Various bactericide and fungicide can be incorporated into the rinsing water and/or a stabilizing solution in order to prevent water grime and a mold from forming on a light-sensitive material after processing. Examples of such bactericides and fungicides are the thiazolylbenzimidazole type compounds described in JP-A-57-157244 and JP-A-58-105145; the isothiazolone type compounds described in JP-A-54-27424 and JP-A-57-8542; the chlorophenol type compounds represented by trichlorophenol; bromophenol type compounds; organic tin and organic zinc compounds; thiocyanic acid and isothiocyanic acid compounds; acid amide compounds; diazine and triazine compounds; thiourea compounds; benzotriazole alkylguanidine compounds; quaternary ammonium compounds represented by benzoalconium chloride; antibiotics represented by penicillin; and the conventional fungicides described in the *Journal of Antibacteria and Antifungus Agents,* vol. 1, No. 5, pp. 207 to 223 (1983). The bactericides and fungicides may be used in a combination of two or more kinds thereof. Also, the various fungicides described in JP-A-48-83820 can be used.

Furthermore, various chelating agents can be incorporated into the rinsing water and/or a stabilizing solution as long as the effects of the compounds of the present invention represented by formula (I) are not adversely affected.

Examples of preferred chelating agents include aminopolycarboxylic acids such as ethylenediaminetetracetic acid, diethylenetriaminepentacetic acid, 2-hydroxy.-3-aminopropionic acid-N,N-diacetic acid, serine-N,N-diacetic acid, 2-methylserine-N,N-diacetic acid, 2-hydroxymethyl-serine-N,N-diacetic acid, and ethylenediamine-N,N'-disuccinic acid, organic phosphonic acids such as 1-hydroxyethylidene-1,1-diphosphonic acid and ethylenetriamine-N,N,N',N'-tetramethylenephosphonic acid, and hydrolysis products of the maleic anhydride polymer described in EP Patent 345172 Al. Also, the preservatives which can be incorporated into the above fixing solution and bleach/fixing solution are preferably incorporated into the washing water.

A processing solution which can stabilize a dye image is used for the stabilizing solution. The stabilizing solution may have a buffer capability at pH 3 to 6, and may contain an organic acid, an aldehyde (for example, formalin and glutaric aldehyde), hexahydrotriazine, hexamethylenetetramine, an N-methylol compound, piperazine, pyrazole, 1,2,4-triazole, and an azolylmethylamine compound. As needed, the stabilizing solution may contain an ammonium compound such as ammonium chloride and ammonium sulfite, a metal compound such as Bi and Al, a fluorescent whitening agent, a hardener, and the alkanolamines described in U.S. Pat. No. 4,786,583.

The rinsing step and stabilizing step are preferably conducted using a multi-stage countercurrent system. The number of stages is preferably 2 to 4. The replenishing amount therefor is 1 to 50 times, preferably 2 to 30 times, and more preferably 2 to 15 times the amount carried over from a preceding bath per unit area of the photographic material processed.

The water for use in the rinsing step and stabilizing step may be municipal water, but is preferably water subjected to a deionization treatment of Ca and Mg ions with ion exchange resins to a concentration of 5 mg/liter or less, and water which is sterilized with halogen or ultraviolet sterilizing light. Municipal water may be added to compensate for evaporation. Deionized water or sterilized water is preferably for the above rinsing step or stabilizing step.

In the present invention, a suitable amount of water, a correction solution or a replenishing solution is preferably replenished not only to the bleaching solution and a bleach-fixing solution, but also to the other processing solutions in order to correct for concentration of these solutions due to evaporation.

Furthermore, the method in which the overflow solution from the rinsing step or stabilizing step is introduced into the bath having a fixing ability (i.e., the preceding bath) is preferably used to reduce the amount of waste solution.

Furthermore, in the present invention, the rinsing water and/or a stabilizing solution are preferably regenerated by processing with a reverse osmosis membrane at the rinsing step and/or a stabilizing step as described in JP-A-58-105150, JP-A-60-241053, JP-A-62-254151 and JP-A-3-121448. The amount of water supplied to the rinsing step and stabilizing step can be reduced to a large extent by regeneration of the rinsing water and/or stabilizing solution with the above described reverse osmosis membrane treatment.

The photographic light-sensitive material for use in the present invention includes a conventional black-and-white silver halide photographic light-sensitive material (for example, a black-and-white light-sensitive material for photographing, an X-ray black-and-white light-sensitive material and a black-and-white light-sensitive material for printing), a conventional multilayer silver halide color photographic light-sensitive material (for example, a color negative film, a color reversal film, a color positive film, a color negative film for cinema, a color photographic paper, a reversal color photographic paper, and a direct positive color photographic paper), an infrared light-sensitive material for laser scanning, a diffusion transfer light-sensitive material (for example, a silver diffusion transfer light-sensitive material and a color diffusion transfer light-sensitive material). The color reversal film may be either of an inner type (a coupler is contained in a light-sensitive material) or an outer type (a coupler is contained in a developing solution).

The photographic light-sensitive material for use in the present invention can have various layer structures on one side or both sides of the support (for example, silver halide emulsion layers sensitive to red, green and blue light, respectively, a subbing layer, an anti-halation layer, a filter layer, an intermediate layer, and a surface protective layer), and various arrangements of these layers.

There are no particular limitations as to a support for a photographic light-sensitive material for use in the present invention; the coating method; the composition of the silver halide used for the silver halide emulsion layers and a surface protective layer (for example, silver bromoiodide, silver bromochloroiodide, silver bromide, silver bromochloride, and silver chloride), the grain shapes thereof (for example, cube, plate and sphere), the grain sizes thereof, the variation in distribution of the grain sizes, the crystal structures thereof (for example, a core/shell structure, a multilayer structure, and a uniform layer structure), the manufacturing methods used to prepare the silver halide grains (for example, a single jet method and a double jet method), a binder (for example, gelatin), a hardener, an anti-foggant, a metal doping agent, a silver halide solvent, a thickener, an emulsion breaker, a dimension stabilizer, an anti-adhesion agent, a stabilizer, an anti-contamination agent, a dye image stabilizer, an anti-stain agent, a chemical sensitizer, a spectral sensitizer, a sensitivity improver, a super-sensitizer, a nucleus forming agent, a coupler (for example, the pivaloyl acetanilide type and benzoyl acetanilide type yellow couplers, the 5-pyrazolone type and pyrozoloazole type magenta couplers, the phenol type and naphthol type cyan couplers, a DIR coupler, a bleaching agent-releasing coupler, a competitive coupler, and a colored coupler), a coupler dispersing method (for example, an oil-in-water dispersing method using a high boiling solvent), a plasticizer, an anti-static agent, a lubricant, a coating aid, a surface active agent, a whitening agent, a formalin scavenger, a light scattering agent, a matting agent, a light absorber, a ultraviolet absorber, a filter dye, an irradiation dye, a development improver, a delustering agent, a fungicide (for example, 2-phenoxyethanol), and an anti-mold agent. The above additives and materials are described, for example, in *Product Licensing*, vol. 92, pp. 107 to 110 (December 1971), *Research Disclosure* (hereinafter referred to as RD) No. 17643 (December 1978), *RD* No. 18716 (November 1979), and *RD* No. 307105 (November 1989).

The present invention can be applied to any type of color light-sensitive material without particular limitation.

In accordance with the present invention, a dry thickness of all of the constituent layers of a color light-sensitive material excluding the support, the subbing layer and back layer provided on the support is preferably 20.0 μm or less, more preferably 18.0 μm or less in case of a color light-sensitive material for photographing, and preferably 16.0 μm or less, more preferably 13.0 μm or less in case of a printing material, for best achieving the objects of the present invention.

Outside the range of the above preferred layer thickness, bleaching fog and staining after processing are increased, attributable to residual color developing agent in the processed light-sensitive material. Particularly, the generation of the bleaching fog and stain is attributable to a green-sensitive layer, and consequently the density of the magenta color is liable to increase more than the cyan and yellow colors.

The total dry layer thickness may be reduced as defined above to the extent that the properties of the light-sensitive material are not adversely affected. The lower limit of the entire dry layer thickness of the constitutent layers excluding those of a support and a subbing layer provided on the support is 12.0 μm for a color light-sensitive material and is 7.0 μm for a printing material. In a light-sensitive material for photographing, a layer is usually provided between the light-sensitive layer closest to a support and a subbing layer, and the lower limit of the dry layer thickness of this layer (which may constitute plural layers) is 1.0 μm. The layer thickness may be reduced in either light-sensitive or non-light-sensitive layers.

The layer thickness of a multilayer color light-sensitive material is measured using the following method:

A color light-sensitive material to be measured is stored under conditions of 25° C. and 50% RH for 7 days following manufacture. First, the entire thickness of the color light-sensitive material is measured, and then the thickness thereof is measured once again after the coated layers on the support are removed. The layer thickness of all of the coated layers excluding the support is defined by the difference thereof. The thickness can be measured using a layer thickness measurement device having a piezoelectric crystal element (e.g., K-402B Stand. manufactured by Anritsu Electric Co., Ltd.). The coated layers on the support can be removed with a sodium hypochlorite aqueous solution. Subsequently, a sectional photograph of the above light-sensitive material is taken with a scanning type electron microscope (having a magnification of preferably 3,000 times or more), and the entire thickness of all of the layers on the support and the respective thicknesses thereof are measured. Thus, the value (the absolute value of the measured thickness) of the foregoing entire layer thickness measured (as measured with the layer thickness measurement device) can be compared therewith to calculate the thicknesses of the respective layers.

The swelling rate of the color light-sensitive material in accordance with the present invention is preferably 50 to 200%, more preferably 70 to 150%, wherein the swelling rate is defined by the following equation:

Swelling rate = [(equilibrium swollen layer thickness in water at 25° C.) − (entire dry layer thickness at 25° C. and 55% RH)] ÷ (entire dry layer thickness at 25° C. and 55% RH).

Furthermore, a swelling speed $T_{\frac{1}{2}}$ of the color light-sensitive material in accordance with the present invention is preferably 15 seconds or less, more preferably 9 seconds or less, wherein the swelling speed is defined by the time in which the layer thickness is swollen to ½ of a saturated swollen layer thickness defined by 90% of the maximum swollen layer thickness in a color developing solution (30° C., 3 minutes and 15 seconds).

The silver halide contained in a photographic emulsion layer of the color light-sensitive material for use in the present invention may comprise any silver halide composition. For example, the silver halide may comprise silver chloride, silver bromide, silver bromochloride, silver bromoiodide, silver chloroiodide, or silver bromochloroiodide.

For use in a color light-sensitive material for photographing and a color reversal light-sensitive material (for example, a color negative film, a reversal film and a color reversal paper), silver bromoiodide, silver chloroiodide or silver bromochloroiodide is preferred, each containing 0.1 to 30 mole % of silver iodide. Particularly preferred is silver bromoiodide containing 1 to 25 mole % of silver iodide.

For use in a direct positive light-sensitive material, silver bromide or silver bromochloride is preferred. Silver chloride is preferred as well for carrying out rapid processing.

For use in a light-sensitive material for paper, silver chloride or silver bromochloride is preferred. Particularly preferred is silver bromochloride containing 80 mole % or more, more preferably 95 mole % or more, most preferably 98 mole % or more of silver chloride.

Known photographic additives for use in the present invention are described in the following three Research Disclosure, bulletins, and the corresponding portions described therein are shown as follows:

| Kind of additives | RD 17643 (Dec.1978) | RD 18716 (Nov.1979) | RD 307105 (Nov.1989) |
|---|---|---|---|
| 1. Chemical sensitizer | pp. 23 | pp. 648, right colm. | pp. 866 |
| 2. Sensitivity improver | — | pp. 648, right colm. | — |
| 3. Spectral sensitizer | pp. 23 to 24 | pp. 648, right colm. to pp. 649, right colm. | pp. 866 to 868 |
| Super-sensitizer | — | | |
| 4. Whitening agent | pp. 24 | pp. 647, right colm. | pp. 868 |
| 5. Anti-foggant & stabilizer | pp. 24 to 25 | pp. 649, right colm. | pp. 868 to 870 |
| 6. Light absorber, filter dye, & UV absorber | pp. 25 to 26 | pp. 649, right colm. to pp. 650, left colm. | pp. 873 |
| 7. Anti-stain agent | pp. 25 right colm. | pp. 650, left colmn. to right colm. | pp. 872 |
| 8. Dye image stabilizer | pp. 25 | pp. 650, left colm. | pp. 872 |
| 9. Hardener | pp. 26 | pp. 651, left colm. | pp. 874 to 875 |
| 10. Binder | pp. 26 | pp. 651, left colm. | pp. 873 to 874 |
| 11. Plasticizer & lubricant | pp. 27 | pp. 650, right colm. | pp. 876 |
| 12. Coating aid & surfactant | pp. 26 to 27 | pp. 650, right colm. | pp. 875 to 876 |
| 13. Anti-static agent | pp. 27 | pp. 650, right colm. | pp. 876 to 877 |
| 14. Matting agent | — | — | pp. 878 to 879 |

Various color couplers can be used in the color light-sensitive material in accordance with the present invention. Useful examples thereof are described in the patents described in above *RD* No. 17643, VII-C to G and No. 307105, VII-C to G, and JP-A-62-215272, JP-A-3-33847 and JP-A-2-33144.

A suitable support for use in the photographic material of present invention is described in, for example, the above *Research Disclosure* (*RD*) No. 17643, pp. 28, and *RD* No. 18716, from the right column at pp. 647 to the left column at pp. 648.

EXAMPLES

The present invention is described in greater detail by reference to the following examples, but the present invention should not be construed as being limited thereto.

EXAMPLE 1

The layers having the following compositions were provided on a cellulose triacetate film support having thereon a subbing layer, to thereby prepare a negative type multi-layer color light-sensitive material A.

Composition of Light-sensitive Layer

The coated amounts are expressed in terms of g/m² of silver for silver halide and colloidal silver, in terms of g/m² for the couplers, additives and gelatin, and in terms of mole per mole of silver halide contained in the same layer for the spectral sensitizers.

| First layer: anti-halation layer | |
|---|---|
| Black colloidal silver | 0.20 |
| Gelatin | 2.20 |
| UV-1 | 0.11 |
| UV-2 | 0.20 |
| Cpd-1 | $4.0 \times 10^{-2}$ |

-continued

| | |
|---|---|
| Cpd-2 | $1.9 \times 10^{-2}$ |
| Solv-1 | 0.30 |
| Solv-2 | $1.2 \times 10^{-2}$ |
| Second layer: intermediate layer | |
| Silver bromoiodide fine grains (AgI: 1.0 mole %, circle-corresponding diameter: 0.07 μm) | 0.15 |
| Gelatin | 1.00 |
| ExC-4 | $6.0 \times 10^{-2}$ |
| Cpd-3 | $2.0 \times 10^{-2}$ |
| Third layer: first red-sensitive layer | |
| Silver bromoiodide emulsion (AgI: 5.0 mole %, high AgI content on surface of grains, circle-corresponding diameter: 0.9 μm, variation coefficient of circle-corresponding diameter: 21%, tabular grains, diameter/thickness ratio: 7.5) | 0.42 |
| Silver bromoiodide emulsion (AgI: 4.0 mole %, high internal AgI content, circle-corresponding diameter: 0.4 μm, variation coefficient of circle-corresponding diameter: 18%, tetradecahedral grains) | 0.40 |
| Gelatin | 1.90 |
| ExS-1 | $4.5 \times 10^{-4}$ |
| ExS-2 | $1.5 \times 10^{-4}$ |
| ExS-3 | $4.0 \times 10^{-5}$ |
| ExC-1 | 0.65 |
| ExC-3 | $1.0 \times 10^{-2}$ |
| ExC-4 | $2.3 \times 10^{-2}$ |
| Solv-1 | 0.32 |
| Fourth layer: second red-sensitive layer | |
| Silver bromoiodide emulsion (AgI: 8.5 mole %, high internal AgI content, circle-corresponding diameter: 1.0 μm, variation coefficient of circle-corresponding diameter: 25%, tabular grains, diameter/thickness ratio: 3.0) | 0.85 |
| Gelatin | 0.91 |
| ExS-1 | $3.0 \times 10^{-4}$ |
| ExS-2 | $1.0 \times 10^{-4}$ |
| ExS-3 | $3.0 \times 10^{-5}$ |
| ExC-1 | 0.13 |
| ExC-2 | $6.2 \times 10^{-2}$ |
| ExC-4 | $4.0 \times 10^{-2}$ |
| ExC-7 | $3.0 \times 10^{-2}$ |
| Solv-1 | 0.10 |
| Fifth layer: third red-sensitive layer | |
| Silver bromoiodide emulsion (AgI: 11.3 mole %, high internal AgI content, circle-corresponding diameter: 1.4 μm, variation coefficient of circle-corresponding diameter: 28%, tabular grains, diameter/thickness ratio: 6.0) | 1.50 |
| Gelatin | 1.20 |
| ExS-1 | $2.0 \times 10^{-4}$ |
| ExS-2 | $6.0 \times 10^{-5}$ |
| ExS-3 | $2.0 \times 10^{-5}$ |
| ExC-2 | $8.5 \times 10^{-2}$ |
| ExC-5 | $7.3 \times 10^{-2}$ |
| ExC-7 | $1.0 \times 10^{-2}$ |
| Solv-1 | 0.12 |
| Solv-2 | 0.12 |
| Sixth layer: intermediate layer | |
| Gelatin | 1.00 |
| Cpd-4 | $8.0 \times 10^{-2}$ |
| Solv-1 | $8.0 \times 10^{-2}$ |
| Seventh layer: first green-sensitive layer | |
| Silver bromoiodide emulsion (AgI: 5.0 mole %, high AgI content on surface of grains, circle-corresponding diameter: 0.9 μm, variation coefficient of circle-corresponding diameter: 21%, tabular grains, diameter/thickness ratio: 7.0) | 0.28 |
| Silver bromoiodide emulsion (AgI: 4.0 mole %, high internal AgI content, circle-corresponding diameter: 0.4 μm, variation coefficient of circle-corresponding diameter: 18%, tetradecahedral grains) | 0.16 |
| Gelatin | 1.20 |
| ExS-4 | $5.0 \times 10^{-4}$ |
| ExS-5 | $2.0 \times 10^{-4}$ |
| ExS-6 | $1.0 \times 10^{-4}$ |
| ExM-1 | 0.50 |

-continued

| | |
|---|---|
| ExM-2 | 0.10 |
| ExM-5 | $3.5 \times 10^{-2}$ |
| Solv-1 | 0.20 |
| Solv-3 | $3.0 \times 10^{-2}$ |
| Eighth layer: second green-sensitive layer | |
| Silver bromoiodide emulsion (AgI: 8.5 mole %, high internal AgI content, circle-corresponding diameter: 1.0 μm, variation coefficient of circle-corresponding diameter: 25%, tabular grains, diameter/thickness ratio: 3.0) | 0.57 |
| Gelatin | 0.45 |
| ExS-4 | $3.5 \times 10^{-4}$ |
| ExS-5 | $1.4 \times 10^{-4}$ |
| ExS-6 | $7.0 \times 10^{-5}$ |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| Ninth layer: intermediate layer | |
| Gelatin | 0.50 |
| Solv-1 | $2.0 \times 10^{-2}$ |
| Tenth layer: third green-sensitive layer | |
| Silver bromoiodide emulsion (AgI: 11.3 mole %, high internal AgI content, circle-corresponding diameter: 1.4 μm, variation coefficient of circle-corresponding diameter: 28%, tabular grains, diameter/thickness ratio: 6.0) | 1.30 |
| Gelatin | 1.20 |
| ExS-4 | $2.0 \times 10^{-4}$ |
| ExS-5 | $8.0 \times 10^{-5}$ |
| ExS-6 | $8.0 \times 10^{-5}$ |
| ExM-4 | $4.5 \times 10^{-2}$ |
| ExM-6 | $1.0 \times 10^{-2}$ |
| ExC-2 | $4.5 \times 10^{-3}$ |
| Cpd-5 | $1.0 \times 10^{-2}$ |
| Solv-1 | 0.25 |
| Eleventh layer: yellow filter layer | |
| Gelatin | 0.50 |
| Cpd-6 | $5.2 \times 10^{-2}$ |
| Solv-1 | 0.12 |
| Twelfth layer: intermediate layer | |
| Gelatin | 0.45 |
| Cpd-3 | 0.10 |
| Thirteenth layer: first blue-sensitive layer | |
| Silver bromoiodide emulsion (AgI: 2 mole %, uniform AgI content, circle-corresponding diameter: 0.55 μm, variation coefficient of circle-corresponding diameter: 25%, tabular grains, diameter/thickness ratio: 7.0) | 0.20 |
| Gelatin | 1.00 |
| ExS-7 | $3.0 \times 10^{-4}$ |
| ExY-1 | 0.60 |
| ExY-2 | $2.3 \times 10^{-2}$ |
| Solv-1 | 0.15 |
| Fourteenth layer: second blue-sensitive layer | |
| Silver bromoiodide emulsion (AgI: 19.0 mole %, high internal AgI content, circle-corresponding diameter: 1.0 μm, variation coefficient of circle-corresponding diameter: 16%, octahedral grains) | 0.19 |
| Gelatin | 0.35 |
| ExS-7 | $2.0 \times 10^{-4}$ |
| ExY-1 | 0.22 |
| Solv-1 | $7.0 \times 10^{-2}$ |
| Fifteenth layer: intermediate layer | |
| Silver bromoiodide fine grains (AgI: 2 mole %, uniform AgI content, circle-corresponding diameter: 0.13 μm) | 0.20 |
| Gelatin | 0.36 |
| Sixteenth layer: third blue-sensitive layer | |
| Silver bromoiodide emulsion (AgI: 14.0 mole %, high internal AgI content, circle-corresponding diameter: 1.7 μm, variation coefficient of circle-corresponding diameter: 28%, tabular grains, diameter/thickness ratio: 5.0) | 1.55 |
| Gelatin | 1.00 |
| ExS-8 | $1.5 \times 10^{-4}$ |
| ExY-1 | 0.21 |
| Solv-1 | $7.0 \times 10^{-2}$ |

-continued

| | |
|---|---|
| Seventeenth layer: first protective layer | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| Eighteenth layer: second protective layer | |
| Silver chloride fine grains (circle-corresponding diameter: 0.07 μm) | 0.36 |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |

-continued

| | |
|---|---|
| H-1 | 0.35 |
| Cpd-7 | 1.00 |

The sample further contained 1,2-benzoisothiazoline-3-one (average 200 ppm based on gelatin), n-butyl p-hydroxybenzoate (about 1,000 ppm based on gelatin), and 2-phenoxyethanol (about 10,000 ppm based on gelatin). Furthermore, the sample contained B-4, B-5, W-2, W-3, F-1, F-2, F-3, F-4, F-5, F-6, F-,7, F-8, F-9, F-10, F-11, F-12, F-13, an iron salt, a lead salt, a gold salt, a platinum salt, an iridium salt, and a rhodium salt.

The following compounds were used in preparation of the sample.

UV-1

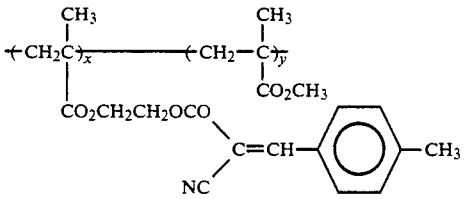

x/y = 7/3 (Weight ratio)

UV-2

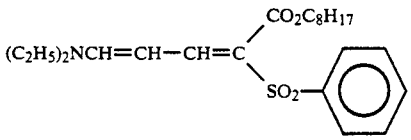

ExC-1

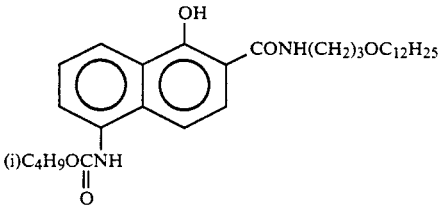

ExC-2

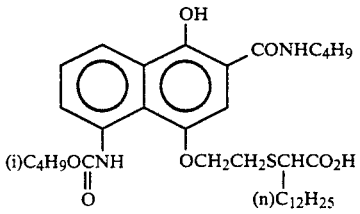

ExC-3

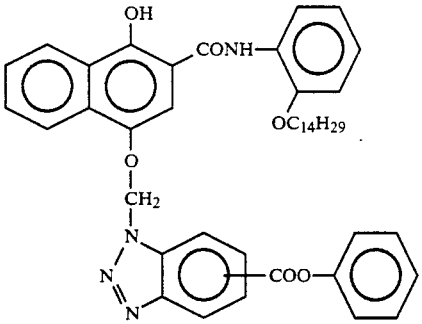

ExC-4

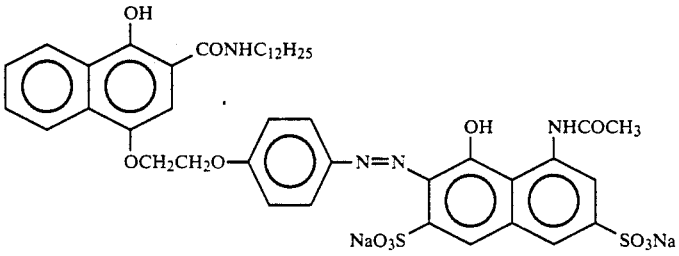

ExC-5

-continued
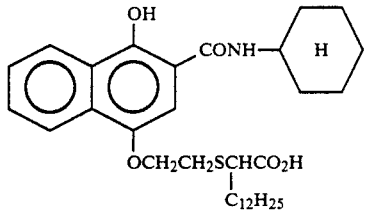
ExC-7
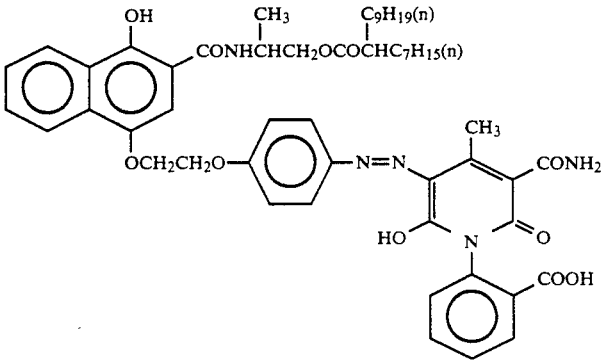
ExM-1
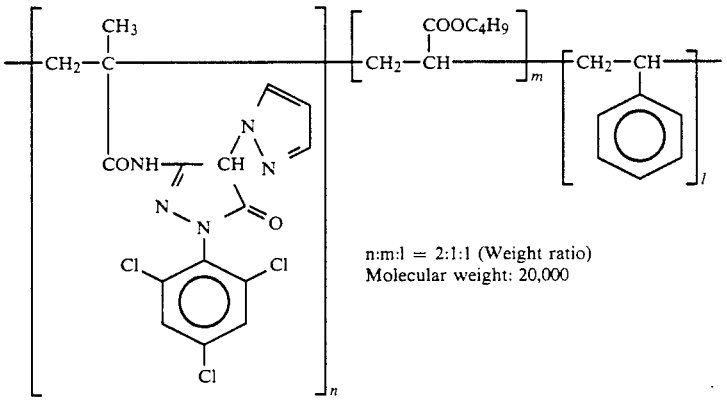
ExM-2
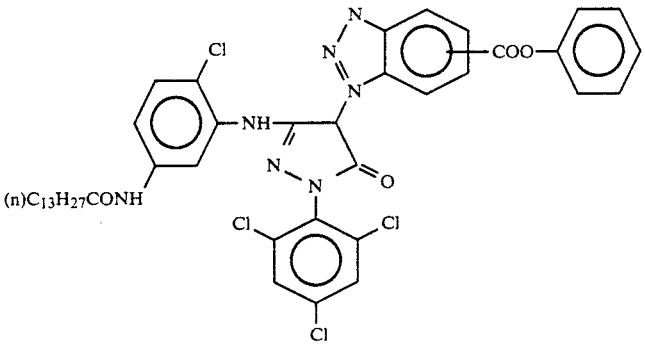
ExM-3

-continued
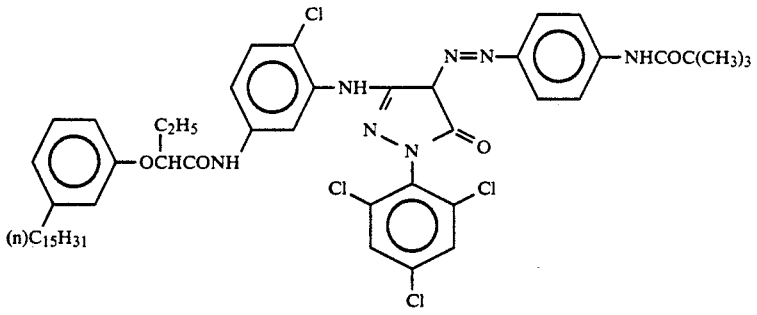
ExM-4
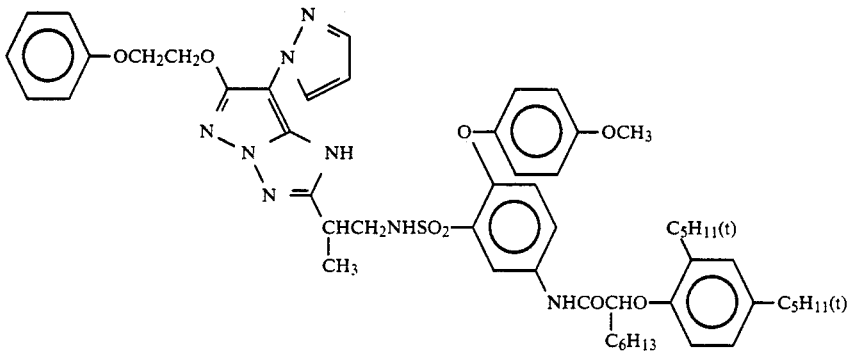
ExM-5
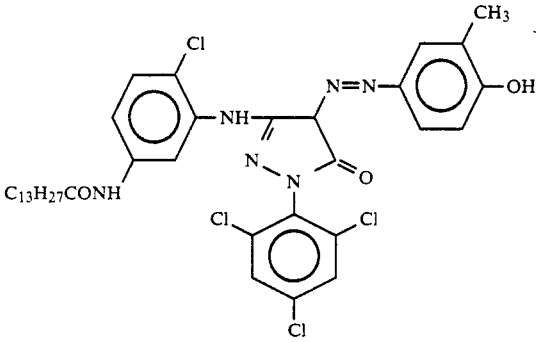
ExM-6
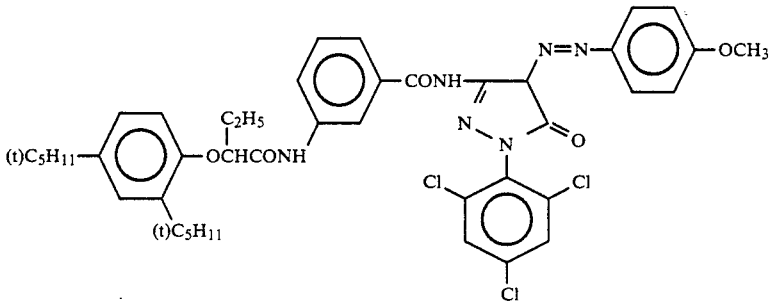
ExY-1

-continued
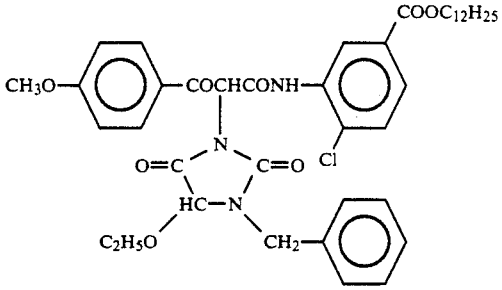
ExY-2
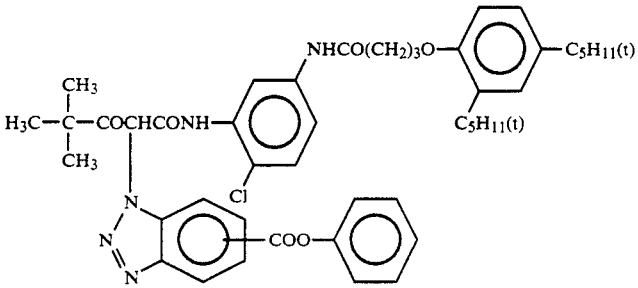
Cpd-1
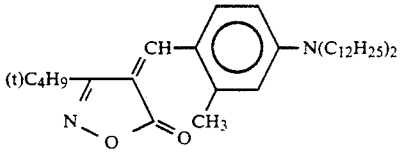
Cpd-2
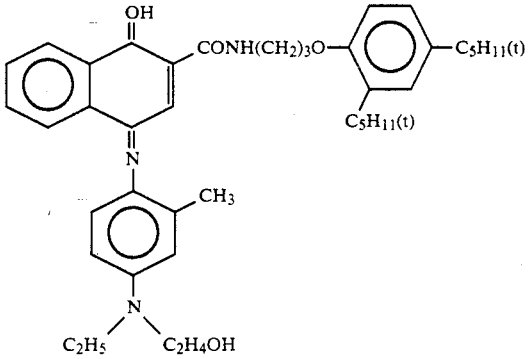
Cpd-3
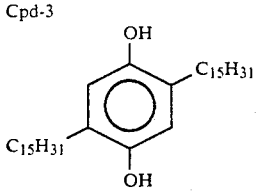
Cpd-4
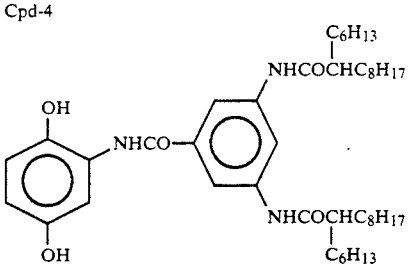
Cpd-5
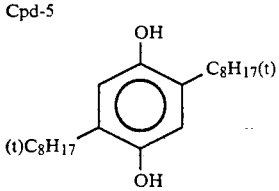
Cpd-6
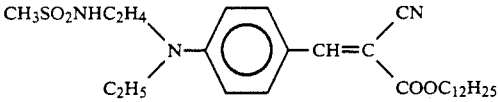
Cpd-7
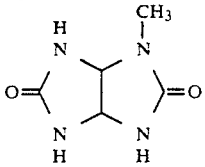
Solv-1
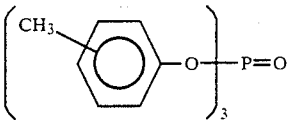

-continued
Solv-2
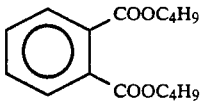
Solv-3
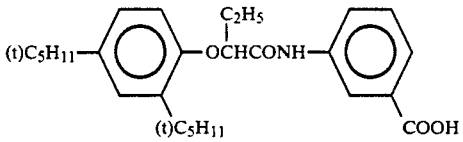
ExS-1
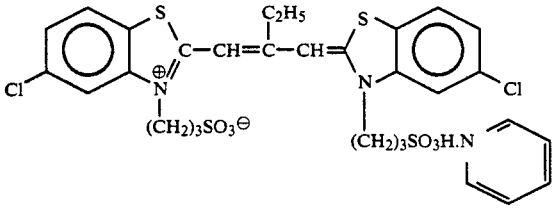
ExS-2
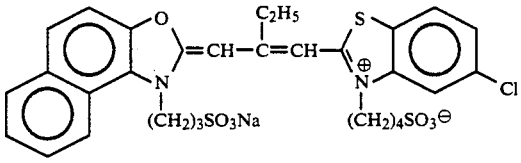
ExS-3
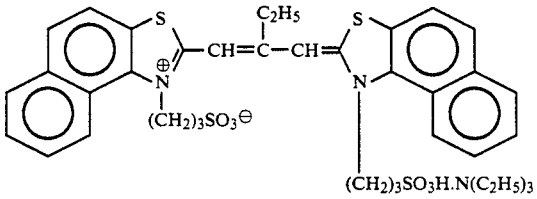
ExS-4
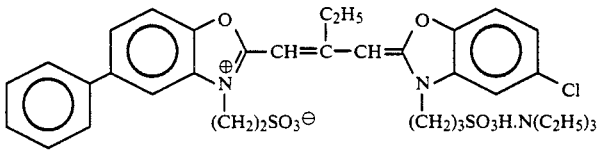
ExS-5
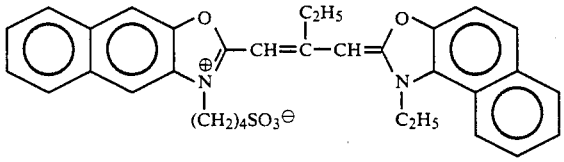
ExS-6
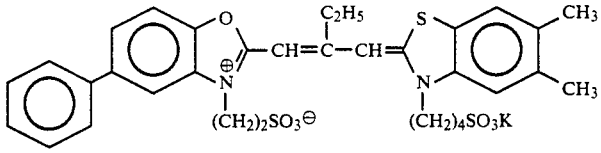
ExS-7
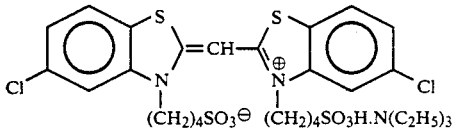
ExS-8
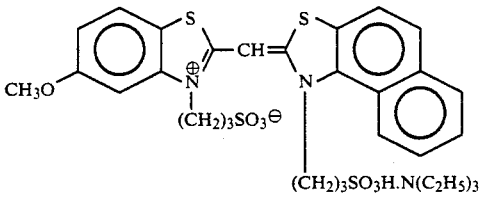
B-1
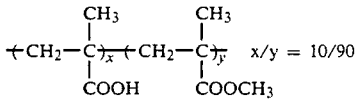
x/y = 10/90
B-2
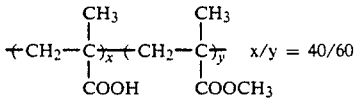
x/y = 40/60
B-3
B-4

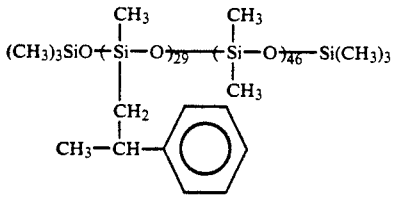
B-5
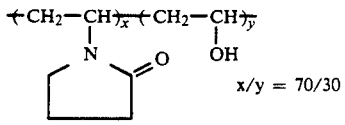
x/y = 70/30
W-2
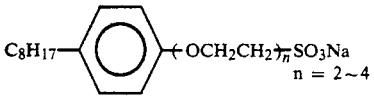
H-1
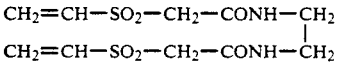
F-2
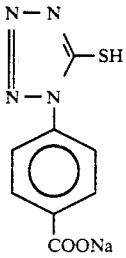
F-4
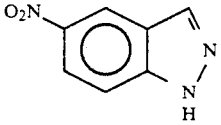
F-6
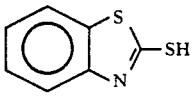
F-8
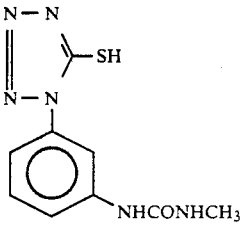
-continued
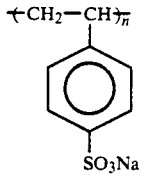
W-1
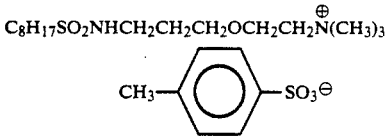
W-3
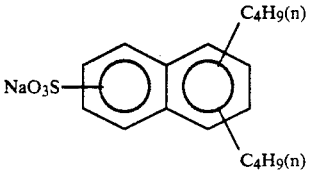
F-1
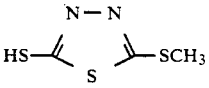
F-3
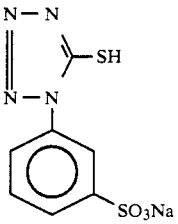
F-5
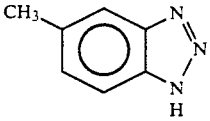
F-7
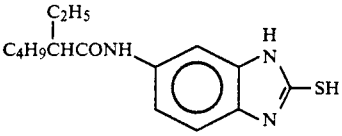
F-9
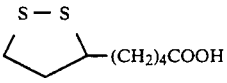
F-10
F-11

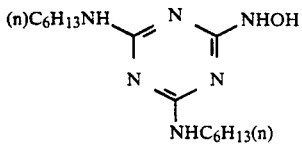

F-12

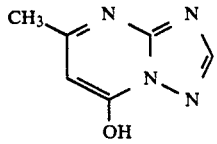

-continued

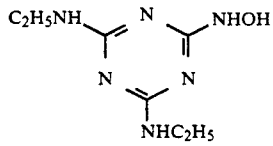

F-13

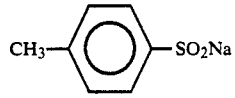

The multilayer color light-sensitive material A thus prepared was cut to a width of 35 mm, and exposed to white light (color temperature 4800° K.) through a step wedge. The exposed material was continuously processed using the following processing steps with a cine type automatic developing machine. The processed sample was evaluated for performance when the accumulated replenishing amount for the color developing solution reached three times the capacity of the mother solution tank. Aeration was carried out by discharging air at a rate of 200 ml/min. from a pipe provided on the bottom of the bleaching solution tank and having a plurality of fine holes having a diameter of 0.2 mm.

| | Processing steps | | | |
|---|---|---|---|---|
| Step | Processing time | Processing temperature | Replenishing amount | Tank capacity |
| Color developing | 3 minutes & 15 seconds | 37.8° C. | 23 ml | 10 l |
| Bleaching | 50 seconds | 38.0° C. | 5 ml | 5 l |
| Fixing | 1 minute & 40 seconds | 38.0° C. | 30 ml | 10 l |
| Rinsing (1) | 30 seconds | 38.0° C. | — | 5 l |
| Rinsing (2) | 20 seconds | 38.0° C. | 30 ml | 5 l |
| Stabilizing | 20 seconds | 38.0° C. | 20 ml | 5 l |
| Drying | 1 minute | 55° C. | | |

Replenishing amount is per meter of 35 mm width.

Rinsing was carried out in a counter current system from (2) to (1).

The carry over amount of the developing to the bleaching bath and the fixing solution to the rinsing bath were 2.5 and 2.0 ml per meter of the light-sensitive material of a 35 mm width, respectively.

The crossover time was each 5 seconds and this time was included in the processing time of the preceding step.

The compositions of the processing solutions (A: mother solution, B; replenishing solution) are shown below:

| | A | B |
|---|---|---|
| Color developing solution | | |
| Diethylenetriaminepentacetic acid | 1.0 g | 1.1 g |
| 1-Hydroxyethylidene-1,1-diphosphonic acid | 3.0 g | 3.2 g |
| Sodium sulfite | 4.0 g | 4.9 g |
| Potassium carbonate | 30.0 g | 30.0 g |
| Potassium bromide | 1.4 g | 0.4 g |
| Potassium iodid | 1.5 mg | — |
| Hydroxylamine sulfate | 2.4 g | 3.6 g |
| 4-(N-ethyl-N-β-hydroxyethylamino)-2-methylaniline sulfate | 4.5 g | 6.4 g |
| Water was added to make total volume of | 1000 ml | 1000 ml |

-continued

| | A | B |
|---|---|---|
| pH | 10.05 | 10.10 |
| Bleaching solution | | |
| Iron nitrate nonahydrate | 0.35 mol | 0.53 mol |
| Chelating compound (shown in TABLE A) | 0.55 mol | 0.83 mol |
| Ammonium bromide | 100 g | 150 g |
| Ammonium nitrate | 20 g | 30 g |
| Glycolic acid | 55 g | 83 g |
| Water was added to make a total volume of | 1000 ml | 1000 ml |
| pH | 5.0 | 5.0 |

Note: the chelating compound used herein means organic acid constituting a ferric ammonium salt of an organic acid which is formed by the reaction with iron nitrate in the bleaching solution.

| Fixing solution (common to both the mother solution and replenishing solution) | |
|---|---|
| Diammonium ethylenediaminetetracetate | 1.7 g |
| Ammonium sulfite | 14.0 g |
| Ammonium thiosulfate aqueous solution (700 g/liter) | 260.0 ml |
| Water was added to make a total volume of | 1000 ml |
| pH | 7.0 |

Rinsing water (common to both of the mother solution and replenishing solution)

Municipal water was introduced into a mixed bed type column filled with H type strong acidic cation exchange resins (Amberlite IR-120B) and OH type strong base anion exchange resins (Amberlite IRA-400), each manufactured by Rohm & Haas Co., Ltd. to reduce the concentrations of calcium and magnesium ions to 3 mg/liter or less. Subsequently, sodium dichloroisocyanurate 20 mg/liter and sodium sulfate 150 mg/liter were added thereto. The pH range of this solution was 6.5 to 7.5.

| Stabilizing solution (common to both the mother solution and replenishing solution) | |
|---|---|
| Formalin (37 wt %) | 1.2 ml |
| Polyoxyethylene-p-monononylphenyl ether (average polymerization degree: 10) | 0.4 g |
| Ethylene glycol | 1.0 g |
| Water was added to make a total volume of | 1000 ml |
| pH | 5.0 to 7.0 |

The respective multilayer color light-sensitive materials A processed as described above were evaluated for residual silver in the maximum color density portion using X-ray fluoresence analysis. The results are shown in Table A.

Further, the light-sensitive materials A thus processed were each evaluated for the Dmin values of the magnetic image using green light, respectively.

Next, the bleaching solution was replaced by a standard bleaching solution free from a bleaching fog and having the following composition. The bleaching was carried out at the bleaching time of 390 seconds, a processing temperature of 38° C and a replenishing amount of 25 ml per meter of the light-sensitive material of a 35 mm width, while the other processing steps remained unchanged.

| Standard bleaching solution | A | B |
|---|---|---|
| Ferric sodium diethylenediamine-tetracetate trihydrate | 100.0 g | 120.0 g |
| Disodium ethylenediamine-tetracetate | 10.0 g | 11.0 g |
| Ammonium bromide | 100 g | 120 g |
| Ammonium nitrate | 30.0 g | 35.0 g |
| Ammonia water (27 wt %) | 6.5 ml | 4.0 ml |
| Water was added to make a total volume of | 1000 ml | 1000 ml |
| pH | 6.0 | 5.7 |

The light-sensitive materials obtained by processing with the above standard bleaching solution were likewise evaluated for Dmin.

The bleaching fog (ΔDmin) was calculated as the difference of the Dmin obtained above and the Dmin obtained with the standard bleaching solution. The Dmin value obtained with the standard bleaching solution was 0.60.

Bleaching fog (ΔDmin)=(Dmin of the respective samples)−(standard Dmin)

The results are shown in Table A.

Next, the increase in staining of the above multilayer color light-sensitive material upon storage after processing was obtained from the density difference of Dmin in a non-color developed portion before and after storage under the following conditions:

60° C. and 70 % RH in a dark room for 4 weeks

Increase in stain=Dmin after storage−Dmin before storage

The results are also shown in Table A.

TABLE A

| Sample No. | Chelating compound*2 | Residual*1 silver amount | Bleaching fog ΔDmin(G) | Increase in stain ΔD(G) |
|---|---|---|---|---|
| 101 (Comp.) | Comp. A | 15.2 | 0.00 | 0.35 |
| 102 (Comp.) | Comp. B | 4.3 | 0.25 | 0.17 |
| 103 (Comp.) | Comp. C | 7.0 | 0.22 | 0.20 |
| 104 (Comp.) | Comp. D | 8.2 | 0.03 | 0.18 |
| 105 (Inv.) | 1 | 3.6 | 0.08 | 0.07 |
| 106 (Inv.) | 2 | 3.8 | 0.06 | 0.09 |
| 107 (Inv.) | 3 | 3.8 | 0.06 | 0.08 |
| 108 (Inv.) | 5 | 4.0 | 0.04 | 0.06 |
| 109 (Inv.) | 9 | 4.0 | 0.04 | 0.07 |
| 110 (Inv.) | 11 | 3.0 | 0.12 | 0.05 |
| 111 (Inv.) | 12 | 3.2 | 0.13 | 0.06 |
| 112 (Inv.) | 13 | 3.0 | 0.12 | 0.06 |
| 113 (Inv.) | 14 | 3.3 | 0.13 | 0.08 |
| 114 (Inv.) | 15 | 3.6 | 0.10 | 0.08 |
| 115 (Inv.) | 21 | 3.4 | 0.09 | 0.07 |
| 116 (Inv.) | 27 | 4.0 | 0.03 | 0.08 |
| 117 (Inv.) | 29 | 3.8 | 0.07 | 0.08 |
| 118 (Inv.) | 30 | 3.5 | 0.08 | 0.07 |
| 119 (Inv.) | 31 | 3.9 | 0.06 | 0.07 |
| 120 (Inv.) | 35 | 3.2 | 0.09 | 0.07 |

TABLE A-continued

| Sample No. | Chelating compound*2 | Residual*1 silver amount | Bleaching fog ΔDmin(G) | Increase in stain ΔD(G) |
|---|---|---|---|---|
| 121 (Inv.) | 36 | 3.6 | 0.07 | 0.08 |
| 122 (Inv.) | 37 | 3.6 | 0.07 | 0.07 |
| 123 (Inv.) | 38 | 3.8 | 0.05 | 0.06 |
| 124 (Inv.) | 39 | 3.8 | 0.05 | 0.06 |
| 125 (Inv.) | 41 | 3.4 | 0.10 | 0.05 |
| 126 (Inv.) | 48 | 3.0 | 0.13 | 0.05 |
| 127 (Inv.) | 53 | 2.9 | 0.13 | 0.06 |
| 128 (Inv.) | 66 | 3.1 | 0.14 | 0.07 |
| 129 (Inv.) | 67 | 3.4 | 0.11 | 0.07 |
| 130 (Inv.) | 68 | 4.0 | 0.04 | 0.06 |

*1Unit: mg/cm²

*2Comparative Compound A

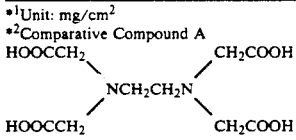

Comparative Compound B

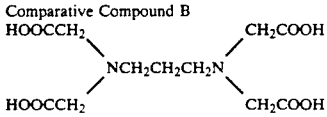

Comparative Compound C

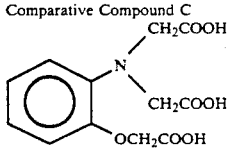

(described in W. German Patent Application (OLS) 3,912,551)

Comparative Compound D

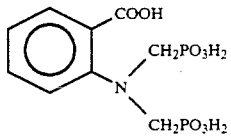

(described in U.S. Pat. No. 3,615,508)

It is clearly seen from the results summarized in Table A that metal chelating compounds of the compounds of formula (I) of the present invention reduced the residual silver amount as compared to metal chelating compounds of the comparative chelating compounds. Furthermore, the metal chelating compounds of the present invention effectively reduced bleaching fog as well as staining of the processed photographic material upon storage.

EXAMPLE 2

"Sample 311" as described in European Patent Application 0337370A (a negative-type multi-layer color light-sensitive material using emulsions of silver bromoiodide containing 4 to 16 mol % of silver iodide) was imagewise exposed and processed as follows:

| | Processing Steps | | | |
|---|---|---|---|---|
| Step | time | Temperature | Replenishing amount | Tank capacity |
| Color developing | 1 minute & 45 seconds | 43° C. | 25 ml | 10 l |
| Bleaching | 20 seconds | 40° C. | 5 ml | 4 l |
| Bleach-fixing | 20 seconds | 40° C. | — | 4 l |
| Fixing | 20 seconds | 40° C. | 16 ml | 4 l |
| Rinsing (1) | 20 seconds | 40° C. | — | 2 l |
| Rinsing (2) | 10 seconds | 40° C. | 30 ml | 2 l |
| Stabilizing | 20 seconds | 40° C. | 20 ml | 2 l |
| Drying | 1 minute | 60° C. | | |

Replenishing amount is per meter of 35 mm width.

The rinsing step comprised a countercurrent system from (2) to (1), and all of the bleaching solution overflow was introduced into the bleach-fixing bath.

Furthermore, all of the overslow solution from Rinsing (1) was introduced into the fixing bath, and all of the overflow solution from the fixing bath was introduced into the bleach-fixing bath.

The amount of fixing solution carried over to the rinsing bath in the above processing was 2 ml per meter of the light-sensitive material having a 35 mm width.

| Color developing solution | A | B |
|---|---|---|
| Diethylenetriaminepentacetic acid | 2.0 g | 2.0 g |
| 1-Hydroxyethylidene-1,1-diphosphonic acid | 3.0 g | 3.2 g |
| Sodium sulfite | 4.0 g | 5.8 g |
| Potassium carbonate | 40.0 g | 40.0 g |
| Potassium bromide | 1.3 g | — |
| Potassium iodide | 1.5 mg | — |
| Hydroxylamine sulfate | 2.4 g | 3.6 g |
| 2-methyl-4-[N-ethyl-N-(β-hydroxyethyl) amino]aniline sulfate | 9.2 g | 13.4 g |
| Water was added to make a total volume of | 1000 ml | 1000 ml |
| pH (adjusted with a 50 wt % potasssium hydroxide aqueous solution) | 10.20 | 10.35 |

| Bleaching solution | A | B |
|---|---|---|
| Chelating compound (shown in Table B) | 0.50 mol | 0.70 mol |
| Iron nitrate nonahydrate | 0.45 mol | 0.63 mol |
| Ammonium bromide | 100.0 g | 140.0 g |
| Ammonium nitrate | 17.5 g | 25.0 g |
| Water was added to make a total volume of | 1000 ml | 1000 ml |
| pH | 4.5 | 4.5 |

Note: The chelating compound used herein means organic acid constituting a ferric ammonium salt of an organic acid which is formed by the reaction with iron nitrate in in the bleaching solution.

| Fixing solution | A | B |
|---|---|---|
| Ammonium thiosulfate aqueous solution (700 g/liter) | 280 ml | 840 ml |
| Ethylenediaminetetracetic acid | 12.6 g | 38 g |
| Ammonium sulfite | 27.5 g | 82.5 g |
| Imidazole | 28 g | 84 g |
| Water was added to make a total volume of | 1000 ml | 1000 ml |
| pH | 7.8 | 8.0 |

Bleach-fixing Solution

The bleaching solution, fixing solution and rinsing solution were mixed in the ratio of 5:16:30, respectively (by volume).

RINSING SOLUTION (common to both the mother solution and replenishing solution)

The same rinsing water was the same as used in Example 1.

| Stabilizing solution (common to both of the mother solution and replenishing solution) | |
|---|---|
| Formalin (37 wt %) | 2.0 ml |
| Polyoxyethylene-p-monononylphenyl ether (average polymerization degree: 10) | 0.3 g |

-continued

| Stabilizing solution (common to both of the mother solution and replenishing solution) | |
|---|---|
| Disodium ethylenediaminetetracetate | 0.05 g |
| Water was added to make a total volume of | 1.0 l |
| pH | 5.0 to 8.0 |

The processed light-sensitive material "Sample 311" thus obtained was evaluated with respect to the Dmin value of the magenta image using green light.

Furthermore, the light-sensitive material "Sample 11" described in European Patent Application 0337370A was processed with the standard bleaching solution used in Example 1 to obtain the Dmin value in the same manner as described above. The bleaching fog and ΔDmin value were calculated based on the standard Dmin value with this standard bleaching solution in the same manner as Example The Dmin value obtained with the standard bleaching solution was 0.57. The results are shown in Table B.

Subsequently, the above processed light-sensitive material "Sample 311" was evaluated for image staining upon storage under the same conditions and in the same manner as Example 1. The results are shown in Table B as well.

Furthermore, the above samples were uniformly exposed and processed a described above to obtain a gray density of 1.5, and the residual silver was measured using X-ray fluorescence. These results are shown in Table B as well.

TABLE B

| Sample No. | Chelating compound | Residual* silver amount | Bleaching fog ΔDmin(G) | Increase in stain ΔD(G) |
|---|---|---|---|---|
| 201 (Comp.) | Comp. A | 21.0 | 0.05 | 0.38 |
| 202 (Comp.) | Comp. B | 3.5 | 0.43 | 0.26 |
| 203 (Comp.) | Comp. C | 4.2 | 0.20 | 0.19 |
| 204 (Comp.) | Comp. D | 5.3 | 0.15 | 0.20 |
| 205 (Inv.) | 1 | 3.4 | 0.10 | 0.07 |
| 206 (Inv.) | 2 | 3.6 | 0.08 | 0.08 |
| 207 (Inv.) | 3 | 3.6 | 0.08 | 0.07 |
| 208 (Inv.) | 5 | 3.8 | 0.06 | 0.05 |
| 209 (Inv.) | 9 | 3.8 | 0.06 | 0.07 |
| 210 (Inv.) | 11 | 3.0 | 0.14 | 0.05 |
| 211 (Inv.) | 12 | 3.1 | 0.15 | 0.05 |
| 212 (Inv.) | 13 | 3.0 | 0.15 | 0.06 |
| 213 (Inv.) | 14 | 3.1 | 0.16 | 0.07 |
| 214 (Inv.) | 15 | 3.5 | 0.12 | 0.08 |
| 215 (Inv.) | 27 | 3.9 | 0.05 | 0.07 |
| 216 (Inv.) | 35 | 2.9 | 0.13 | 0.06 |
| 217 (Inv.) | 36 | 3.4 | 0.10 | 0.07 |
| 218 (Inv.) | 37 | 3.4 | 0.10 | 0.06 |
| 219 (Inv.) | 38 | 3.6 | 0.08 | 0.05 |
| 220 (Inv.) | 39 | 3.6 | 0.08 | 0.06 |
| 221 (Inv.) | 41 | 3.2 | 0.14 | 0.05 |
| 222 (Inv.) | 48 | 2.9 | 0.16 | 0.05 |
| 223 (Inv.) | 53 | 2.8 | 0.16 | 0.06 |
| 224 (Inv.) | 66 | 2.9 | 0.17 | 0.06 |
| 225 (Inv.) | 67 | 3.3 | 0.14 | 0.07 |
| 226 (Inv.) | 68 | 3.8 | 0.06 | 0.08 |

*Unit: mg/cm$^2$

The comparative compounds A, B, C and D were the same as used in Example 1.

It is clearly seen from the results summarized in Table B that metal chelating compounds of the compounds of formula (I) of the present invention reduced the residual silver amount as compared to metal chelating compounds of the comparative chelating compounds. Furthermore, the metal chelating compounds of the present invention effectively reduce bleaching fog as well as staining of the processed photographic material upon storage.

EXAMPLE 3

A paper support laminated on the both sides thereof with polyethylene was subjected to a corona discharge treatment. The support was further provided with a gelatin subbing layer containing sodium dodecylbenzenesulfonate, and was coated with the various photographic constituent layers, to obtain a multilayer color photographic paper B having the following layer compositions. The coating solutions were prepared in the following manner.

The coating solutions for the 1st layer to 4th layer, the 6th layer and the 7th layer were prepared in the same manner as the 5th layer coating solution as shown below.

PREPARATION OF THE FIFTH LAYER COATING SOLUTION

Ethyl acetate 50.0 ml and a solvent (Solv-6) were added to a cyan coupler (ExC) 32.0 g, a dye image stabilizer (Cpd-2) 3.0 g, a dye image stabilizer (Cpd-4) 2.0 g, a dye image stabilizer (Cpd-6) 18.0 g, a dye image stabilizer (Cpd-7) 40.0 g, and a dye image stabilizer (Cpd-8) 5.0 g to dissolve the same. This solution was added to a 20 wt % gelatin aqueous solution 500 ml containing sodium dodecylbenzenesulfonate 8 g, and then was dispersed with a supersonic homogenizer to thereby prepare an emulsified dispersion.

Meanwhile, a silver bromochloride emulsion was prepared (cubic, a 1:4 mixture by Ag mole ratio of a large size emulsion with an average grain size of 0.58 μm and a small size emulsion with an average grain size of 0.45 μm, having variation coefficients of 0.09 and 0.11, respectively, wherein both emulsions comprised grains having AgBr 0.6 mol % partially located on the surface thereof). The following red-sensitive sensitizing dye E was added to this emulsion in an amount of $0.9\times10^{-4}$ mole per mole of silver based on the large size emulsion, and $1.1\times10^{-4}$ mole per mole of silver based on the small size emulsion. Furthermore, the emulsion was subjected to chemical ripening after adding a sulfur sensitizer and a gold sensitizer.

The foregoing emulsified dispersion and the red-sensitive silver bromochloride emulsion were mixed and dissolved, to thereby prepare the fifth layer coating solution having the composition described below.

Sodium 1-oxy-3,5-dichloro-s-triazine was used as a hardener for each of the layers. Furthermore, Cpd-10 and Cpd-11 were added to each of the layers in a total amount (for all layers) of 25.0 mg/m$^2$ and 50.0 mg/m$^2$, respectively.

The following spectral sensitizing dyes were used for the silver bromochloride emulsions contained in the respective light-sensitive emulsion layers.

Blue-sensitive emulsion layer

Sensitizing dye A

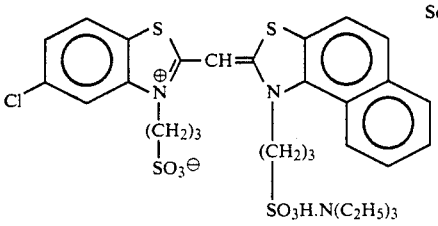

-continued

Blue-sensitive emulsion layer and

Sensitizing dye B

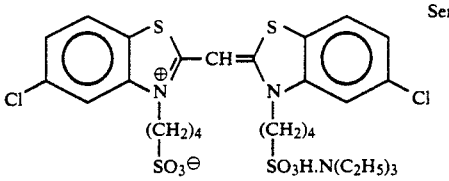

(each in an amount of $2.0\times10^{-4}$ mole per mole of silver to the large size emulsion and $2.5\times10^{-4}$ mole per mole of silver to the small size emulsion).

Green-sensitive emulsion layer

Sensitizing dye C

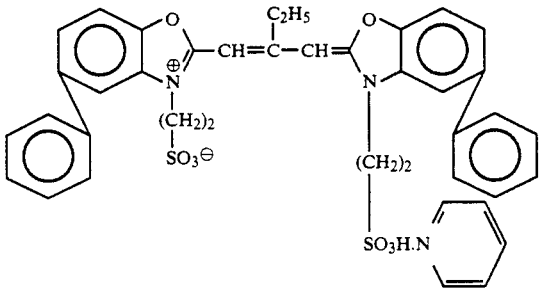

(each in an amount of $4.0\times10^{-5}$ mole per mole of silver to the large size emulsion and $5.6\times10^{-5}$ mole per mole of silver to the small size emulsion), and Sensitizing dye D

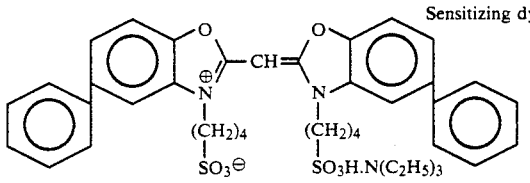

(each in an amount of $7.0\times10^{-5}$ mole per mole of silver to the large size emulsion and $1.0\times10^{-5}$ mole of silver to the small size emulsion).

Red-sensitive emulsion layer

Sensitizing dye E

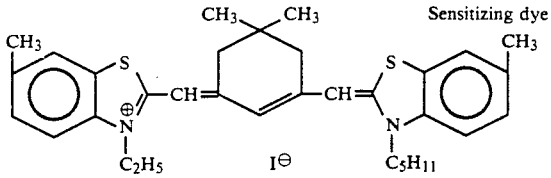

(each in an amount of $0.9\times10^{-4}$ mole per mole of silver to the large size emulsion and $1.1\times10^{-4}$ mole per mole of silver to the small size emulsion), and Furthermore, the following compound was added in an amount of $2.6\times10^{-3}$ mole per mole of silver.

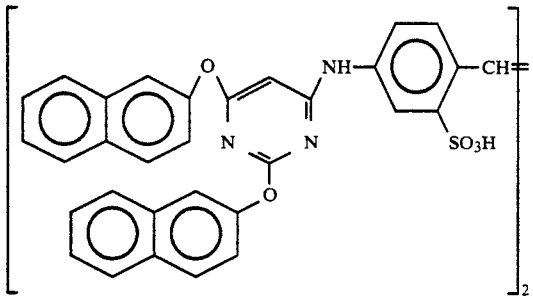

To the blue-sensitive layer, green-sensitive layer and red-sensitive layer, 1-(5-methylureidophenyl)-5-mercaptotetrazole was added in amounts of $8.5\times10^{-5}$ mole, $7.7\times10^{-4}$ mole and $2.5\times10^{-4}$ mole per mole of silver halide, respectively.

To the blue-sensitive layer and green-sensitive layer, 4-hydroxy-6-methyl-1,3,3a,7-tetrazaindene was added in amounts of $1\times10^{-4}$ mole and $2\times10^{-4}$ mole per mole of silver halide, respectively.

The following dye (the number in the parenthesis represents the coated amount) was added to an emulsion layer for preventing irradiation:

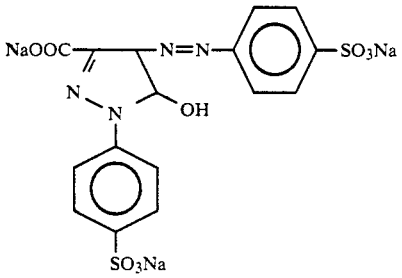

(10 mg/m²)

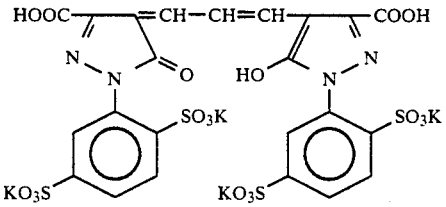

(10 mg/m²)

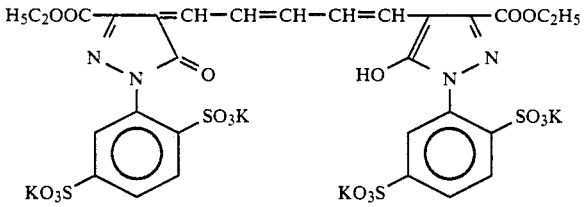

(40 mg/m²)

and

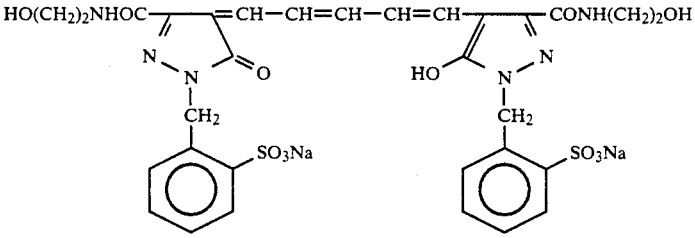

(20 mg/m²)

Layer Constitution

The compositions of the respective layers are shown below. The numbers represent the coated amounts (g/m²). The coated amounts of the silver halide emulsions are expressed in terms of silver.

Support

Polyethylene laminated paper (polyethylene coated on the 1st layer side and containing a white pigment ($TiO_2$) and a blue dye (ultramarine).

| | |
|---|---|
| First layer: blue-sensitive emulsion layer | |
| Silver bromochloride emulsion (cubic; 3:7 mixture (silver mole ratio) of a large size emulsion having an average grain size of 0.88 μm and a small size emulsion having an average grain size of 0.70 μm, having variation coefficients of the grain size distributions of 0.08 and 0.10, respectively, wherein both types of emulsions comprised grains having AgBr 0.3 mol % partially located on the surface thereof) | 0.30 |
| Gelatin | 1.22 |
| Yellow coupler (ExY) | 0.82 |
| Dye image stabilizer (Cpd-1) | 0.19 |
| Solvent (Solv-3) | 0.18 |
| Solvent (Solv-7) | 0.18 |
| Dye image stabilizer (Cpd-7) | 0.06 |
| Second layer: color mixing prevention layer | |
| Gelatin | 0.64 |
| Color mixing prevention agent (Cpd-5) | 0.10 |
| Solvent (Solv-1) | 0.16 |
| Solvent (Solv-4) | 0.08 |
| Third layer: green-sensitive emulsion layer | |
| Silver bromochloride emulsion (cubic; 1:3 mixture (silver mole ratio) of a large size emulsion having an average grain size of 0.55 μm and a small size emulsion having an average grain size of 0.39 μm, having variation coefficients of the grain size distributions of 0.10 and 0.08, respectively, and where in both type of emulsions comprised grains having AgBr 0.8 mol % partially located on the surface thereof) | 0.12 |
| Gelatin | 1.28 |

-continued

| | |
|---|---|
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| Fourth layer: UV absorbing layer | |
| Gelatin | 1.41 |
| UV absorber (UV-1) | 0.47 |
| Color mixing prevention agent (Cpd-5) | 0.05 |
| Solvent (Solv-5) | 0.24 |
| Fifth layer: red-sensitive emulsion layer | |
| Silver bromochloride emulsion (cubic; 1:4 mixture (silver mole ratio) of a large size emulsion having an average grain size of 0.58 μm and a small size emulsion having an average grain size of 0.45 μm, having variation coefficients of the grain size distributions of 0.09 and 0.11, respectively, wherein both types of emulsions comprised grains having AgBr 0.6 mol % partially located on the surface thereof) | 0.23 |
| Gelatin | 1.04 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| Sixth layer: UV absorbing layer | |
| Gelatin | 0.48 |
| UV absorber (UV-1) | 0.16 |
| Color mixing prevention agent (Cpd-5) | 0.02 |
| Solvent (Solv-5) | 0.08 |
| Seventh layer: protective layer | |
| Gelatin | 1.10 |
| Acryl-modified copolymer of polyvinyl alcohol (a modification degree: 17%) | 0.17 |
| Liquid paraffin | 0.03 |

The following compounds were used in praparation of the sample.

ExY

A mixture of (i) and (ii) in the mixing molar ratio ((i)/(ii)) of 1/1

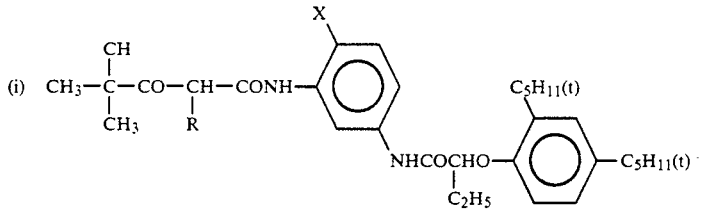

wherein R is

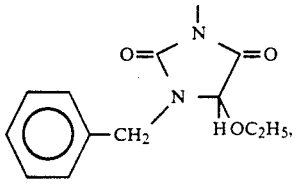

and X is Cl, and (ii) that wherein R is

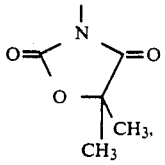

and X is $OCH_3$

ExM

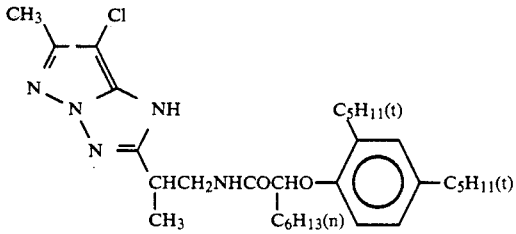

Exc

A mixture of (i) and (ii) having a molar ratio ((i)/(ii)) of 1/1

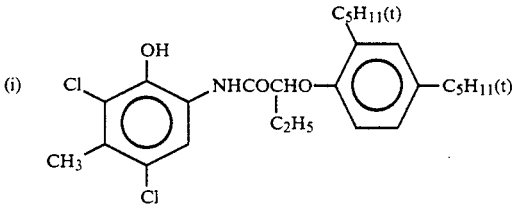

and

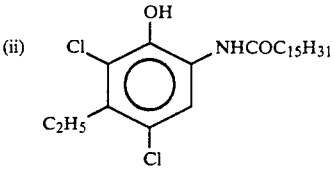

Cpd-1

-continued
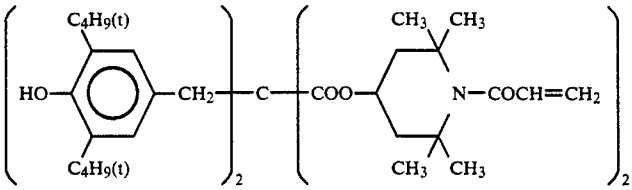
Cpd-2
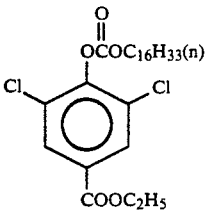
Cpd-3
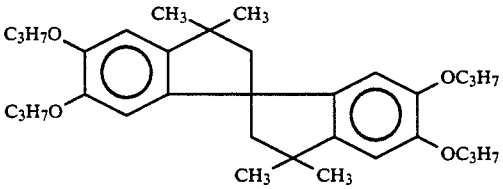
Cpd-4
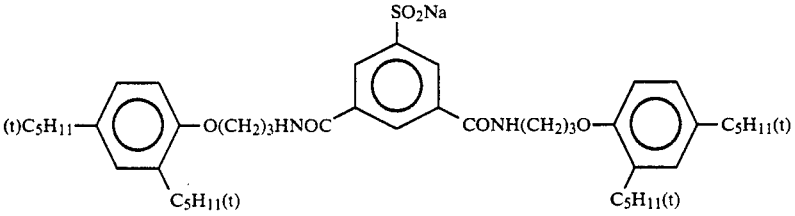
Cpd-5
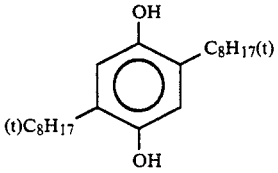
Cpd-6
A mixture of (i), (ii) and (iii) in the mixing weight ratio ((i)/(ii)/(iii)) of 2/4/4
(i)
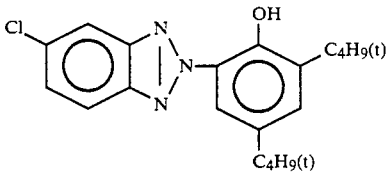
(ii)
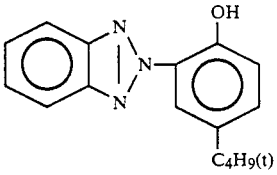
and
(iii)
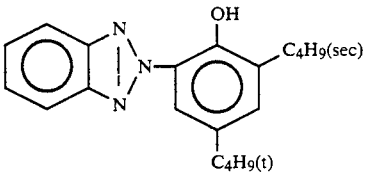
Cpd-7 $\leftarrow CH_2-\underset{\underset{CONHC_4H_9(t)}{|}}{CH}\rightarrow_n$
average molecular weight: 60,000
Cpd-8
A mixture of (i) and (ii) in the mixing weight ratio ((i)/(ii)) of 1/1
(i)
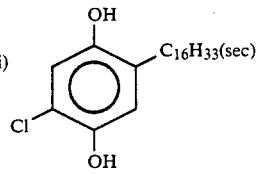
and
(ii)
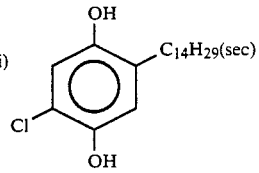
Cpd-9
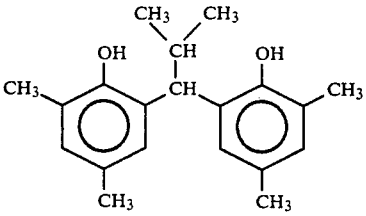
Cpd-10
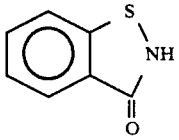
Cpd-11
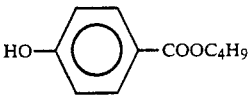

UV-1

A mixture of (i), (ii) and (iii) in the mixing weight ratio ((i)/(ii)/(iii)) of 4/2/4

(i)

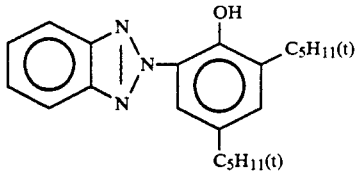

(ii)

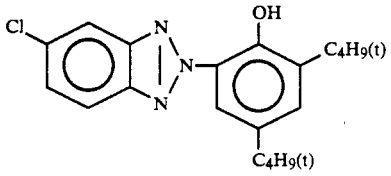

and (iii)

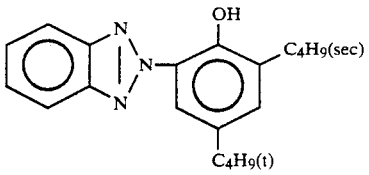

Solv-1

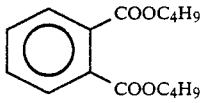

Solv-2

A mixture of (i) and (ii) in the mixing volume ratio ((i)/(ii)) of 1/1

(i)

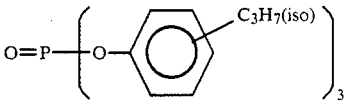

and (ii)

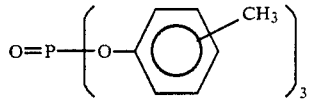

Solv-3 $O{=}P{\leftarrow}O{-}C_9H_{19}(iso))_3$

Solv-4

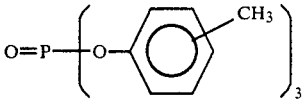

Solv-5

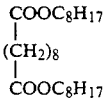

Solv-6

A mixture of (i) and (ii) in the mixing volume ratio ((i)/(ii)) of 4/1

(i)

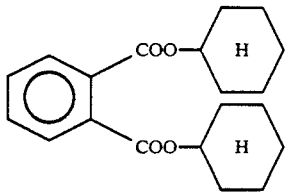

and (ii) $C_8H_{17}CHCH(CH_2)_7COOC_8H_{17}$

Solv-7 $C_8H_{17}CHCH(CH_2)_7COOC_8H_{17}$

Next, processing solutions having the following compositions were prepared.

| | |
|---|---|
| Color developing solution | |
| Water | 600 ml |
| Ethylenediamine-N,N,N',N'-tetramethylene-phosphonic acid | 2.0 g |
| Potassium bromide | 0.015 g |
| Potassium chloride | 3.1 g |
| Triethanolamine | 10.0 g |
| Potassium carbonate | 27 g |
| Fluorescent whitening agent (Whitex 4B, manufactured by Sumitomo Chemical Co.) | 1.0 g |
| Diethylhydroxylamine | 4.2 g |
| N-ethyl-N-(β-methanesulfonamidoethyl) 3-methyl-4-aminoaniline sulfate | 5.0 g |
| Water was added to make a total volume of | 1000 ml |
| pH (25° C.) | 10.05 |
| Bleach-fixing solution | |
| Water | 400 ml |
| Ammonium thiosulfate (700 g/liter) | 100 ml |
| Sodium sulfite | 17 g |
| Ferric chloride | 0.50 mol |
| Chelating compound (shown in Table C) | 0.55 mol |
| Ammonium bromide | 40 g |
| Water was added to make a total volume of | 1000 ml |
| pH (25° C.) | 6.8 |

Note: The chelating compound used herein means organic acid constituting a ferric ammonium salt of an organic acid which is formed by the reaction with iron Rinsing Solution Ion-exchange treated water (calcium and magnesium content each 3 ppm or less)

The above multilayer color photographic paper B was processed as follows:

| Processing step | Temperature | Time |
|---|---|---|
| Color developing | 38° C. | 45 seconds |
| Bleach-fixing | 35° C. | 25 seconds |
| Rinsing (1) | 35° C. | 20 seconds |
| Rinsing (2) | 35° C. | 20 seconds |
| Rinsing (3) | 35° C. | 20 seconds |
| Drying | 80° C. | 60 seconds |

Furthermore, the samples were uniformly exposed to obtain a gray density of 1.5, and were processed as described above. The residual silver in the maximum density portions were quantitatively measured using a fluorescent X-ray method. The results are shown in Table C.

TABLE C

| Sample No. | Chelating compound*2 | Residual*1 silver amount |
|---|---|---|
| 301 (Comp.) | Comp. E | 14.0 |
| 302 (Inv.) | 1 | 2.4 |
| 303 (Inv.) | 2 | 2.6 |
| 304 (Inv.) | 3 | 2.6 |
| 305 (Inv.) | 5 | 2.8 |
| 306 (Inv.) | 9 | 2.7 |
| 307 (Inv.) | 11 | 2.0 |
| 308 (Inv.) | 12 | 2.1 |
| 309 (Inv.) | 13 | 2.0 |
| 310 (Inv.) | 14 | 2.2 |
| 311 (Inv.) | 15 | 2.5 |
| 312 (Inv.) | 35 | 1.9 |
| 313 (Inv.) | 36 | 2.4 |
| 314 (Inv.) | 37 | 2.4 |
| 315 (Inv.) | 38 | 2.6 |
| 316 (Inv.) | 39 | 2.5 |
| 317 (Inv.) | 41 | 2.3 |
| 318 (Inv.) | 48 | 2.0 |
| 319 (Inv.) | 53 | 1.9 |
| 320 (Inv.) | 66 | 2.1 |
| 321 (Inv.) | 67 | 2.3 |

*1Unit: mg/cm²

*2Comparative Compound E

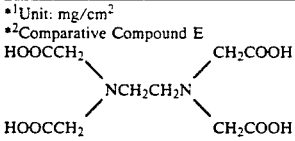

It is clearly seen from the above results that use of metal chelating compounds of the compounds of formula (I) of the present invention reduce the residual silver amount as compared with a metal chelating compound of the comparative compound E.

EXAMPLE 4

The multilayer color light-sensitive material A of Example 1 was exposed to a white light having a color temperature of 4800° K. via a step wedge, and was processed using the following processing steps.

| | Processing steps | | | |
|---|---|---|---|---|
| Step | Processing time | Processing temperature | Replenishing amount | Tank capacity |
| Color developing | 60 seconds | 48° C. | 10 ml | 2 l |
| Bleaching | 20 seconds | 48° C. | 10 ml | 1 l |
| Fixing | 40 seconds | 48° C. | 30 ml | 1 l |
| Rinsing | 20 seconds | 40° C. | 30 ml | 1 l |
| Drying | 40 seconds | 60° C. | | |

Replenishing amount is per meter of 35 mm width.

| | A | B |
|---|---|---|
| Color developing solution | | |
| Diethylenetriaminepentacetic acid | 2.2 g | 2.2 g |
| 1-Hydroxyethylidene-1,1-diphosphonic acid | 3.0 g | 3.2 g |
| Sodium sulfite | 4.1 g | 4.9 g |
| Potassium carbonate | 40 g | 40 g |
| Potassium bromide | 1.4 g | 0.4 g |
| Potassium iodide | 1.3 mg | — |
| 2-Methoxy-4-[N-ethyl-N-(β-hydroxyethylamino)]aniline sulfate | 6.9 g | 9.2 g |
| Water was added to make a total volume of | 1000 ml | 1000 ml |
| pH (adjusted with 50 wt % KOH) | 10.05 | 10.25 |
| Bleaching solution | | |
| Chelating compound shown in Table D | 0.47 mol | 0.67 mol |
| Iron nitrate nonahydrate | 0.3 mol | 0.43 mol |
| Ammonium bromide | 80 g | 114 g |
| Ammonium nitrate | 15 g | 21.4 g |
| Acetic acid (90 wt %) | 42 g | 60 g |
| Water was added to make a total volume of | 1000 ml | 1000 ml |
| pH | 4.3 | 3.8 |

Note: the chelating compound used herein means organic acid constituting a ferric ammonium salt of an organic acid which is formed by the reaction with iron nitratein in the bleaching solution

| Fixing solution (common to both of the mother solution and replenishing solution) | |
|---|---|
| Ammonium thiosulfate aqueous solution (700 g/liter) | 280 ml |
| 1-Hydroxyethylidene-1,1-diphosphonic acid | 10 g |
| Ammonium sulfite | 28 g |
| Water was added to make a total volume of | 1000 ml |
| pH | 7.8 |

The processing was continued until the accumulated replenishing amount reached twice the capacity of the developing tank. The photographic properties were then evaluated at that stage of the continuous processing. The following photographic properties were evaluated in the same manner as described above: residual silver amount in the maximum developed color density portion; bleaching fog, increase in staining of the processed photographic material upon storage in a dark room and under conditions of high humidity and temperature. The results obtained are shown in Table D.

TABLE D

| Sample No. | Chelating compound | Residual* silver amount | Bleaching fog ΔDmin(G) | Increase in stain ΔD(G) |
|---|---|---|---|---|
| 401 (Comp.) | Comp. A | 30.0 | 0.03 | 0.32 |
| 402 (Comp.) | Comp. B | 7.1 | 0.35 | 0.28 |
| 403 (Comp.) | Comp. C | 12.5 | 0.31 | 0.30 |
| 404 (Comp.) | Comp. D | 13.1 | 0.04 | 0.30 |
| 405 (Inv.) | 1 | 5.4 | 0.12 | 0.10 |
| 406 (Inv.) | 2 | 5.4 | 0.09 | 0.13 |
| 407 (Inv.) | 3 | 5.7 | 0.09 | 0.12 |
| 408 (Inv.) | 5 | 5.8 | 0.06 | 0.09 |
| 409 (Inv.) | 9 | 4.5 | 0.06 | 0.10 |
| 410 (Inv.) | 11 | 4.5 | 0.15 | 0.09 |
| 411 (Inv.) | 12 | 4.7 | 0.17 | 0.09 |
| 412 (Inv.) | 13 | 4.8 | 0.14 | 0.10 |
| 413 (Inv.) | 14 | 5.3 | 0.15 | 0.12 |
| 414 (Inv.) | 15 | 5.4 | 0.12 | 0.12 |
| 415 (Inv.) | 35 | 4.4 | 0.13 | 0.09 |
| 416 (Inv.) | 36 | 5.2 | 0.11 | 0.11 |
| 417 (Inv.) | 37 | 5.5 | 0.11 | 0.10 |
| 418 (Inv.) | 38 | 5.6 | 0.08 | 0.09 |
| 419 (Inv.) | 39 | 4.4 | 0.08 | 0.10 |
| 420 (Inv.) | 41 | 5.2 | 0.12 | 0.09 |
| 421 (Inv.) | 48 | 4.5 | 0.18 | 0.09 |
| 422 (Inv.) | 53 | 4.6 | 0.15 | 0.10 |
| 423 (Inv.) | 66 | 5.1 | 0.17 | 0.11 |
| 424 (Inv.) | 67 | 5.2 | 0.14 | 0.11 |

*Unit: mg/cm²

The comparative compounds A, B, C and D are the same as used in Example 1.

It is clearly seen from the results summarized in Table D that the bleaching solution containing metal chelating compounds of the compounds of formula (I) of the present invention as the bleaching agent provides an excellent desilvering property, and effectively reduces bleaching fog and staining of the processed photographic material upon storage.

EXAMPLE 5

The multilayer color light-sensitive material A prepared in Example 1 was exposed via an optical wedge and processed using the following steps. In order to assess aptitude for rapid bleach processing, the rack of the automatic developing machine was replaced with a shortened rack to allow for a shortened processing time.

In the processing (1), the processing time was 50 seconds at the bleaching step, bleach-fixing step and fixing step, and in the processing (2), the processing time was shortened to 20 seconds at the bleaching step and bleach-fixing step and to 30 seconds at the fixing step.

| | Processing steps | | | |
|---|---|---|---|---|
| Step | time | Temperature | Replenishing amount | Tank capacity |
| Color developing | 3 minute & 15 seconds | 38.0° C. | 23 ml | 15 l |
| Bleaching | (1) 50 sec. | 38.0° C. | 5 ml | 5 l |
| | (2) 20 sec. | 38.0° C. | 5 ml | 5 l |
| Bleach-fixing | (1) 50 sec. | 38.0° C. | — | 5 l |
| | (2) 20 sec. | 38.0° C. | — | 5 l |
| Fixing | (1) 50 sec. | 38.0° C. | 16 ml | 5 l |
| | (2) 30 sec. | 38.0° C. | 16 ml | 5 l |
| Rinsing (1) | 30 seconds | 38.0° C. | — | 3 g |
| Rinsing (2) | 20 seconds | 38.0° C. | 34 ml | 3 l |
| Stabilizing | 20 seconds | 38.0° C. | 20 ml | 3 l |
| Drying | 1 minute | 55° C. | | |

Replenishing amount is per meter of 35 mm width.

The rinsing step comprised a countercurrent system from (2) to (1), and the entire overflow solution from the rinsing bath was introduced into the fixing bath. The bleach-fixing solution was replenished in such a manner that the upper part of the bleaching bath of the automatic developing machine was connected to the bottom of the bleach-fixing bath, and the upper part of the fixing bath to the bottom of the bleach-fixing bath. Thus, the entire overflow generated by replenishing the bleaching bath and fixing bath was used to replenish the bleach-fixing bath. The amounts of the developing solution carried over to the bleaching bath, the bleaching solution carried over to the fixing bath, and the fixing solution carried over to the rinsing bath were 2.5 ml, 2.0 ml and 2.0 ml per meter of the light-sensitive material of 35 mm width, respectively. The crossover time was 5 seconds for all steps, and this time is included in the processing time of the preceding step.

The processing was started with the following composition of the mother solution, and thereafter the processing was continued while supplying the replenishing solutions thereto in accordance with the quantity of the light-sensitive material processed, until the accumulated replenishing amount reached three times the tank capacity of the developing bath.

The compositions of the processing solutions are shown below:

| | A | B |
|---|---|---|
| Color developing solution | | |

-continued

| | A | B |
|---|---|---|
| Diethylenetriaminepentacetic acid | 2.0 g | 2.2 g |
| 1-Hydroxyethylidene-1,1-diphosphonic acid | 3.3 g | 3.3 g |
| Sodium sulfite | 3.9 g | 5.2 g |
| Potassium carbonate | 37.5 g | 39.0 g |
| Potassium bromide | 1.4 g | 0.4 g |
| Potassium iodide | 1.3 mg | — |
| Hydroxylamine sulfate | 2.4 g | 3.3 g |
| 2-methyl-4-[N-ethyl-N-(β-hydroxyethyl) amino]aniline sulfate | 4.5 g | 6.1 g |
| Water was added to make a total volume of | 1000 ml | 1000 ml |
| pH | 10.05 | 10.15 |
| Bleaching solution | | |
| Chelating compound (shown in Table E) | 0.47 mol | 0.67 mol |
| Iron nitrate nonahydrate | 0.3 mol | 0.43 mol |
| Ammonium bromide | 84.0 g | 120.0 g |
| Ammonium nitrate | 17.5 g | 25.0 g |
| Hydroxyacetic acid | 63.0 g | 90.0 g |
| Acetic acid | 33.2 g | 47.4 g |
| Water was added to make a total volume of | 1000 ml | 1000 ml |
| pH (adjusted with aqueous ammonia | 3.20 | 2.80 |

Note: The chelating compound used herein means organic acid constituting a ferric ammonium salt of an organic acid which is formed by the reaction with iron nitrate in the bleaching solution.

Bleach-fixing Solution

Mixed solution of the above bleaching mother solution and the following fixing mother solution in a volume ratio of 15:85.

| Fixing solution | A | B |
|---|---|---|
| Ammonium sulfite | 19.0 g | 57.0 g |
| Ammonium thiosulfate aqueous solution (700 g/liter) | 280 ml | 840 ml |
| Imidazole | 28.5 g | 85.5 g |
| Ethylenediaminetetracetic acid | 12.5 g | 37.5 g |
| Water was added to make a total volume of | 1.0 l | 1.0 l |
| pH (adjusted with aqueous ammonia and acetic acid) | 7.40 | 7.45 |

Rinsing Solution (common to both the mother solution and replenishing solution)

The same rinsing water was the same as used in Example 1.

Stabilizing Solution (common to both the mother solution and replenishing solution)

The same replenishing solution as used in Example 2.

The processed samples thus obtained were evaluated for image staining upon storage under the same conditions and in the same manner as in Example 1. The results are also shown in Table E.

Furthermore, samples uniformly exposed to provide a gray density of 2.0 were processed as described above. The residual silver was measured using X-ray fluorescence. These results are also shown in Table E. The photographic properties were evaluated both at the start of continuous processing, and after the continuous processing was carried out until the accumulated replenishing amount reached three times the tank capacity.

TABLE E

| Sample No. | Chelating compound | Processing | Residual silver amount*1 In start*2 | Residual silver amount*1 After processing*3 | Increase in stain ΔD(G) In start | Increase in stain ΔD(G) After processing |
|---|---|---|---|---|---|---|
| 501 (Comp.) | Comp. A | (1) | 12 | 18 | 0.16 | 0.36 |
| | | (2) | 20 | 75 | 0.22 | 0.44 |
| 502 (Comp.) | Comp. B | (1) | 3.2 | 4.3 | 0.07 | 0.18 |
| | | (2) | 6.5 | 7.1 | 0.12 | 0.25 |
| 503 (Comp.) | Comp. C | (1) | 3.0 | 6.5 | 0.06 | 0.20 |
| | | (2) | 6.2 | 12.4 | 0.11 | 0.40 |
| 504 (Comp.) | Comp. D | (1) | 3.2 | 7.0 | 0.07 | 0.22 |
| | | (2) | 6.6 | 13.2 | 0.13 | 0.41 |
| 505 (Inv.) | 1 | (1) | 2.6 | 3.0 | 0.08 | 0.10 |
| | | (2) | 3.0 | 3.4 | 0.08 | 0.10 |
| 506 (Inv.) | 2 | (1) | 2.8 | 3.2 | 0.08 | 0.10 |
| | | (2) | 3.2 | 3.6 | 0.10 | 0.13 |
| 507 (Inv.) | 3 | (1) | 3.3 | 3.3 | 0.07 | 0.09 |
| | | (2) | 3.0 | 3.8 | 0.08 | 0.10 |
| 508 (Inv.) | 5 | (1) | 3.4 | 3.3 | 0.06 | 0.08 |
| | | (2) | 3.1 | 3.6 | 0.06 | 0.09 |
| 509 (Inv.) | 9 | (1) | 3.7 | 3.6 | 0.07 | 0.09 |
| | | (2) | 2.0 | 3.9 | 0.08 | 0.10 |
| 510 (Inv.) | 11 | (1) | 2.3 | 2.4 | 0.05 | 0.07 |
| | | (2) | 2.2 | 2.8 | 0.07 | 0.09 |
| 511 (Inv.) | 12 | (1) | 2.5 | 2.6 | 0.06 | 0.08 |
| | | (2) | 2.1 | 3.0 | 0.10 | 0.11 |
| 512 (Inv.) | 13 | (1) | 2.4 | 2.5 | 0.06 | 0.08 |
| | | (2) | 2.3 | 3.0 | 0.08 | 0.09 |
| 513 (Inv.) | 14 | (1) | 2.6 | 2.7 | 0.08 | 0.10 |
| | | (2) | 2.6 | 3.1 | 0.11 | 0.12 |
| 514 (Inv.) | 15 | (1) | 2.9 | 3.0 | 0.08 | 0.10 |
| | | (2) | 2.0 | 3.4 | 0.10 | 0.12 |
| 515 (Inv.) | 35 | (1) | 2.3 | 2.8 | 0.08 | 0.09 |
| | | (2) | 2.7 | 3.2 | 0.08 | 0.10 |
| 516 (Inv.) | 36 | (1) | 3.1 | 3.0 | 0.08 | 0.10 |
| | | (2) | 2.7 | 3.4 | 0.09 | 0.11 |
| 517 (Inv.) | 37 | (1) | 3.2 | 3.1 | 0.06 | 0.09 |
| | | (2) | 2.9 | 3.6 | 0.08 | 0.11 |
| 518 (Inv.) | 38 | (1) | 3.3 | 3.1 | 0.06 | 0.07 |
| | | (2) | 3.0 | 3.4 | 0.07 | 0.09 |
| 519 (Inv.) | 39 | (1) | 3.5 | 3.4 | 0.06 | 0.08 |
| | | (2) | 2.5 | 3.7 | 0.07 | 0.09 |
| 520 (Inv.) | 41 | (1) | 2.9 | 2.2 | 0.05 | 0.07 |
| | | (2) | 2.0 | 2.6 | 0.06 | 0.08 |
| 521 (Inv.) | 48 | (1) | 2.3 | 2.4 | 0.06 | 0.07 |
| | | (2) | 2.0 | 2.8 | 0.09 | 0.09 |
| 522 (Inv.) | 53 | (1) | 2.3 | 2.3 | 0.06 | 0.08 |
| | | (2) | 2.1 | 2.8 | 0.08 | 0.10 |
| 523 (Inv.) | 66 | (1) | 2.4 | 2.5 | 0.07 | 0.09 |
| | | (2) | 2.4 | 2.9 | 0.10 | 0.12 |
| 524 (Inv.) | 67 | (1) | 2.4 | 2.8 | 0.07 | 0.10 |
| | | (2) | 2.7 | 3.2 | 0.09 | 0.12 |

*1 $\mu g/cm^2$
*2 Property evaluated at the beginning of continuous processing
*3 Property evaluated when the accumulated replenishing amount reached three times the tank capacity The comparative compounds A, B and C were same as used Example 1.

It is clearly seen from the results summarized in Table E that the metal chelating compounds of the present invention effectively reduce the residual silver amount and staining upon aging the processed samples as compared with the comparative compounds.

EXAMPLE 6

The same light-sensitive material as in Example 3 was prepared, and then were processed in the following processing solutions.

| | A | B |
|---|---|---|
| Color developing solution | | |
| Water | 700 ml | 700 ml |
| Diethylenediaminetriaminepentacetic acid | 0.4 g | 0.4 g |
| N,N,N-tris(methylenephosphonic acid) | 4.0 g | 4.0 g |
| Disodium 1,2-dihydroxybenzene-4,6-disulfonate | 0.5 g | 0.5 g |
| Triethanolamine | 12.0 g | 12.0 g |

-continued

| | A | B |
|---|---|---|
| Potassium chloride | 6.5 g | — |
| Potassium bromide | 0.03 g | — |
| Potassium carbonate | 27.0 g | 27.0 g |
| Fluorescent whitening agent (Whitex 4B, manufactured by Sumitomo Chemical Co.) | 1.0 g | 3.0 g |
| Sodium sulfite | 0.1 g | 0.1 g |
| N,N-bis(sulfoethyl)hydroxylamine | 10.0 g | 13.0 g |
| N-ethyl-N-(β-methanesulfonamidoethyl) 3-methyl-4-aminoaniline sulfate | 5.0 g | 11.5 g |
| Water was added to make a total volume of | 1000 ml | 1000 ml |
| pH (25° C.) | 10.10 | 11.10 |
| Bleach-fixing solution | | |
| Water | 600 ml | 600 ml |
| Ammonium thiosulfate (700 g/liter) | 100 ml | 250 ml |
| Ammonium sulfite | 40 ml | 100 ml |
| Chelating compound shown in Table F | 0.166 mol | 0.407 mol |
| Ferric nitrate nonahydrate | 0.138 mol | 0.339 mol |
| Ethylenediaminetetracetic acid | 5 g | 12.5 g |
| Ammonium bromide | 40 g | 75 g |
| Nitric acid (67 wt %) | 30 g | 65 g |
| Water was added to make a total | 1000 ml | 1000 ml |

-continued

| | A | B |
|---|---|---|
| volume of pH (adjusted with acetic acid or aqueous ammonia at 25° C.) | 5.8 | 5.6 |

Note: The chelating compound used herein means organic acid constituting a ferric ammonium salt of an organic acid which is formed by the reaction with iron nitrate in in the bleach-fixing solution.

In order to evaluate residual silver after processing, the above light-sensitive materials were uniformly exposed to provide a gray density of 2.2, and then processed using the following steps. The samples were quantitatively measured for residual silver amount using X-ray fluorescence.

Also, in order to evaluate the increase in aging fog after processing, the light-sensitive materials were subjected to gradational exposure via a step wedge, and then processed in the same manner as described above. The processed samples were aged at 80° C. and 70% RH for one week to determine the increase in staining ΔD before and after aging. The processing was carried out using the following steps with the above processing solutions. The tank solutions were placed in the respective processing tanks to start the processing. The processing was continued while supplying the replenishing solutions to the respective tanks in an amount corresponding to the quantity of the photographic material processed.

The processing was continued until the accumulated replenishing amount reached three times the tank capacity of the color developing bath. The light-sensitive materials thus processed were evaluated with respect to residual silver and increase in staining as described above the results of which are shown in Table F.

| | | Processing steps | | |
|---|---|---|---|---|
| Step | time | Temperature | Replenishing amount | Tank capacity |
| Color developing | 45 seconds | 39° C. | 70 ml | 20 l |
| Bleach-fixing | 45 seconds (or 20 seconds) | 35° C. | 60 ml | 20 l |
| Rinsing (1) | 20 seconds | 35° C. | — | 10 l |
| Rinsing (2) | 20 seconds | 35° C. | — | 10 l |
| Rinsing (3) | 20 seconds | 35° C. | 360 ml | 10 l |
| Drying | 60 seconds | 80° C. | | |

The replenishing amount is per meter of the light-sensitive material.

The rinsing step comprised a 3 tanks countercurrent system from Rinsing (3) to (1).

In addition to above noted replenishing amount of 60 ml, 120 ml per $m^2$ of the light-sensitive material were introduced into the bleach-fixing bath from Rinsing (1).

The same rinsing water as that used in Example 1 was used i the Rinsing.

TABLE F

| Sample No. | Chelating compound | Bleaching time | Residual* silver amount | Increase in stain ΔD |
|---|---|---|---|---|
| 601 (Comp.) | Comp. A | 45 sec | 2.6 | 0.11 |
| | | 20 sec | 8.0 | 0.20 |
| 602 (Comp.) | Comp. B | 45 sec | 10.0 | 0.03 |
| | | 20 sec | 20.2 | 0.04 |
| 603 (Comp.) | Comp. C | 45 sec | 12.4 | 0.06 |

TABLE F-continued

| Sample No. | Chelating compound | Bleaching time | Residual* silver amount | Increase in stain ΔD |
|---|---|---|---|---|
| | | 20 sec | 22.6 | 0.08 |
| 604 (Inv.) | 1 | 45 sec | 0.6 | 0.04 |
| | | 20 sec | 1.2 | 0.05 |
| 605 (Inv.) | 2 | 45 sec | 0.8 | 0.03 |
| | | 20 sec | 2.0 | 0.04 |
| 606 (Inv.) | 11 | 45 sec | 0.5 | 0.02 |
| | | 20 sec | 1.0 | 0.03 |
| 607 (Inv.) | 12 | 45 sec | 0.7 | 0.04 |
| | | 20 sec | 1.5 | 0.05 |
| 608 (Inv.) | 35 | 45 sec | 0.6 | 0.04 |
| | | 20 sec | 1.1 | 0.05 |
| 609 (Inv.) | 37 | 45 sec | 0.8 | 0.03 |
| | | 20 sec | 1.9 | 0.04 |
| 610 (Inv.) | 38 | 45 sec | 0.9 | 0.03 |
| | | 20 sec | 2.0 | 0.04 |
| 611 (Inv.) | 41 | 45 sec | 0.7 | 0.04 |
| | | 20 sec | 1.5 | 0.05 |

*Unit: $mg/cm^2$

The comparative compounds A, B and C are the same as used in Example 1. As shown in the results summarized in Table F, it is clearly seen that use of the metal chelating compounds of the present invention as a bleaching agent provides a remarkably enhanced desilvering property and reduced aging stain after processing as compared to the comparative bleaching agents. Particularly, the effects of the invention are pronounced when the bleach-fixing time is shortened. Namely, even when the bleach-fixing time shortened to a half or less, the residual silver is reduced and improved aging stain is demonstrated at the start of and after continuous processing. When the comparative metal chelating compounds B and C were used as shown in Comparative Samples 602 and 603, the desilvering property was markedly reduced. A precipitate formed during the course of continuous processing, despite that the residual silver amount was almost nil when determined at the start of continuous processing using fresh processing solutions.

EXAMPLE 7

Fuji Color SUPER HG400 (manufacturing No. 311130) and Fuji Color REALA (manufacturing No. 861016) were processed in the same manner as Samples 201 to 225 of Example 2 described above. The results confirmed the effects of the present invention as in Example 2.

EXAMPLE 8

The same light-sensitive materials as in Example 3 were prepared and processed in the following processing solutions. The compositions thereof are shown below:

| Color developing solution | |
|---|---|
| Water | 600 ml |
| Potassium bromide | 0.015 g |
| Potassium chloride | 3.1 g |
| Triethanolamine | 10.0 g |
| Potassium carbonate | 27 g |
| Fluorescent whitening agent (Whitex 4B, manufactured by Sumitomo Chemical Co.) | 1.0 g |
| Preservative | 45 mmol |

-continued

| Color developing solution | |
|---|---|
| 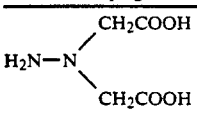 | |
| N-ethyl-N-(β-methanesulfonamidoethyl) 3-methyl-4-aminoaniline sulfate | 5.0 g |
| Water was added to make a total volume of | 1000 ml |
| pH (25° C.) | 10.05 |

The above color developing solution was designated as Sample 8A, and the developing solutions to which the compounds of the present invention represented by formula (I) or the comparative compounds were added were designated as Samples 8B to 8O.

| Bleach-fixing solution | |
|---|---|
| Water | 400 ml |
| Ammonium thiosulfate (70 g/liter) | 100 ml |
| Sodium sulfite | 17 g |
| Ferric ammonium ethylenediamine-tetracetate | 55 g |
| Disodium ethylenediaminetetracetate | 5 g |
| Ammonium bromide | 40 g |
| Water was added to make a total volume of | 1000 ml |
| pH (25° C.) | 6.0 |

Rinsing solution

Ion exchange treated water (calcium and magnesium content each 3 ppm or less)

Ferric ion 5 ppm and calcium ion 150 ppm were added to each of the above developing solutions, which solutions were aged at 38° C. for 20 days in a beaker having an aperture ratio of 0.10 $cm^{-1}$.

The above color light-sensitive materials were subjected to gradational exposure through three color separation filter for sensitometry with a sensitometer FWH Type (manufactured by Fuji Photo Film Co., Ltd.). The exposure was adjusted to 250 CMS at an exposure time of 0.1 second.

After exposing, the respective light-sensitive materials were processed according to the following processing steps with either a fresh color developing solution or the aged color developing solution.

| Processing step | Temperature | Time |
|---|---|---|
| Color developing | 38° C. | 45 seconds |
| Bleach-fixing | 35° C. | 45 seconds |
| Rinsing (1) | 35° C. | 20 seconds |
| Rinsing (2) | 35° C. | 20 seconds |
| Rinsing (3) | 35° C. | 20 seconds |
| Drying | 80° C. | 60 seconds |

The yellow minimum density (Dmin) and the magenta sensitivity (logarithm log E of the reciprocal of the exposure necessary to provide a density of 0.5) were measured where the processing was carried out with the fresh developing solution (the fresh solution), and the increase (ΔDmin) in the yellow minimum density (Dmin) and the variation (ΔS) of the magenta sensitivity were evaluated when the processing was carried out with the aged developing solution (the aged solution).

Furthermore, the residual amount of the developing agent contained in the aged solution was quantitatively measured using high speed liquid chromatography. Also, the presence of a precipitate generated in the developing solution after aging was observed. The results are summarized in Table G.

TABLE G

| Sample No. | Chelating agent | Yellow ΔDmin | Magenta ΔS | Developing agent residual amount | Generation* of precipitate |
|---|---|---|---|---|---|
| 8A (Comp.) | Not added | +0.07 | −0.11 | 61% | BBB |
| 8B (Comp.) | Sodium hexametaphosphate (1 g/liter) | +0.04 | −0.07 | 78% | BB |
| 8C (Comp.) | 1-Hydroxyethylidene-1,1-diphosphonic acid (60%) (1.6 g/liter) | +0.04 | −0.05 | 80% | BB |
| 8D (Comp.) | Ethylenediaminetetracetic acid (1 g/liter) | +0.06 | −0.08 | 65% | G |
| 8E (Comp.) | Nitrilotrimethylene phosphonic acid (1 g/liter) | +0.05 | −0.07 | 75% | B |
| 8F (Inv.) | 1 (1 g/liter) | +0.01 | −0.01 | 88% | G |
| 8G (Inv.) | 9 (1 g/liter) | +0.01 | −0.02 | 91% | G |
| 8H (Inv.) | 11 (1 g/liter) | ±0 | ±0 | 90% | G |
| 8I (Inv.) | 25 (1 g/liter) | +0.01 | ±0 | 93% | G |
| 8J (Inv.) | 29 (1 g/liter) | +0.01 | −0.01 | 90% | G |
| 8K (Inv.) | 31 (1 g/liter) | +0.02 | −0.02 | 88% | G |
| 8L (Inv.) | 35 (1 g/liter) | +0.01 | ±0 | 92% | G |
| 8M (Inv.) | 37 (1 g/liter) | +0.01 | −0.02 | 88% | G |
| 8N (Inv.) | 38 (1 g/liter) | ±0 | −0.01 | 90% | G |
| 8O (Inv.) | 68 | +0.01 | ±0 | 92% | G |

*G represents no generation of a precipitate.
B represents the generation of a precipitate.
BB and BBB represent the generation of an increasingly heavier precipitate.

It is clearly seen from the results summarized in Table G that the use of the compounds of formula (I) of the present invention reduces the values of ΔDmin and ΔS, and suppress the variation in photographic properties.

Also, it was found that the residual amount of the developing agent in the samples of the invention employing the compounds of formula (I) was sufficient to provide good photographic performance.

Furthermore, the present invention provided improved results with respect to the generation of a precipitate, as compared to the comparative samples.

Of the conventional compounds, those effective for preventing the generation of a precipitate exhibited poor preservability of the developing agent, while the use of these compounds resulting in less degredation of the developing agent were ineffective for preventing the generation of the precipitate.

On the other hand, the compounds of the present invention provide a stable color developing solution which does not generate a precipitate.

EXAMPLE 9

The following processing solutions were prepared.

| | A | B |
|---|---|---|
| Color developing solution | | |
| Diethylenetriaminepentacetic acid | 1.0 g | 1.0 g |
| Compound shown in Table H | 0.01 mol | 0.01 mol |
| Sodium sulfite | 4.0 g | 4.9 g |
| Potassium carbonate | 30.0 g | 30.0 g |
| Potassium bromide | 1.4 g | — |
| Potassium iodide | 1.5 mg | — |
| Hydroxylamine sulfate | 2.4 g | 3.6 g |
| 4-(N-ethyl-N-β-hydroxyethylamino)-2-methylaniline sulfate | 4.5 g | 6.4 g |
| Water was added to make a total volume of | 1000 ml | 1000 ml |
| pH | 10.05 | 10.10 |
| Bleaching solution | | |
| Iron (III) ammonium 1,3-propanediaminetetracetate | 0.55 mol | 0.83 mol |
| Ammonium bromide | 85 g | 125 g |
| Ammonium nitrate | 20 g | 30 g |
| Glycolic acid | 55 g | 83 g |
| Water was added to make a total volume of | 1000 ml | 1000 ml |
| pH | 4.0 | 3.8 |

Fixing solution (common to both the mother solution and replenishing solution)

| | |
|---|---|
| Diammonium ethylenediaminetetracetate | 1.7 g |
| Ammonium sulfite | 14.0 g |
| Ammonium thiosulfate aqueous solution (700 g/liter) | 260.0 ml |
| Water was added to make a total volume of | 1000 ml |

-continued

| | A | B |
|---|---|---|
| pH | 7.0 | |

Rinsing Water (common to both the mother solution and replenishing solution)

The same rinsing water as that used in Example 1.

Stabilizing Solution (common to both the mother solution and replenishing solution)

The same stabilizing solution as that used in Example 1.

Ferric ion 5 ppm and calcium ion 150 ppm were added to each of the above developing solutions to prepare the developing solution samples 9A to 9G, which were aged at 38° C. for 20 days in a circulation type liquid aging tester having an aperture ratio of 0.11 $cm^{-1}$.

The multilayer color light-sensitive material A prepared in Example 1 was cut to a 35 mm width and exposed to white light (color temperature of the light source: 4800° K.) via a step wedge.

After exposing, the respective light-sensitive materials were processed according to the following steps with either a fresh color developing solution or the aged color developing solution samples 9A to 9K.

| Processing steps | | |
|---|---|---|
| Step | Time | Temperature |
| Color developing | 3 minutes & 15 seconds | 37.8° C. |
| Bleaching | 50 seconds | 38.0° C. |
| Fixing | 1 minute & 40 seconds | 38.0° C. |
| Rinsing (1) | 30 seconds | 38.0° C. |
| Rinsing (2) | 20 seconds | 38.0° C. |
| Stabilizing | 20 seconds | 38.0° C. |

Relative to the maximum density (obtained when the color light-sensitive materials were processed with a fresh color developing solution), the density reduction (ΔDmax) in the magenta density of the respective light-sensitive materials using the aged developer was obtained. Also, the residual rate of the developing agent and hydroxylamine components after aging of the developing solution were quantitatively measured. Furthermore, the presence of a precipitate generated in the color developing solution after aging was visually observed. These results are shown in Table H.

TABLE H

| Sample No. | Chelating agent | ΔDmin | Developing agent residual rate | Hydroxylamine*2 residual rate | Precipitate*1 |
|---|---|---|---|---|---|
| 9A (Comp.) | Not added | −0.5 | 61% | 20% | BBB |
| 9B (Comp.) | Ethylenediaminetetracetic acid | −0.4 | 62% | 30% | G |
| 9C (Comp.) | Ethylenediaminetetramethylenephosphonic acid | −0.05 | 88% | 70% | B |
| 9D (Inv.) | 1 | −0.06 | 90% | 74% | G |
| 9E (Inv.) | 2 | −0.05 | 85% | 70% | G |
| 9F (Inv.) | 9 | −0.04 | 92% | 80% | G |
| 9G (Inv.) | 11 | −0.06 | 90% | 75% | G |
| 9H (Inv.) | 35 | −0.04 | 92% | 73% | G |
| 9I (Inv.) | 37 | −0.05 | 88% | 70% | G |
| 9J (Inv.) | 38 | −0.04 | 90% | 72% | G |

TABLE H-continued

| Sample No. | Chelating agent | ΔDmin | Developing agent residual rate | Hydroxylamine*2 residual rate | Precipitate*1 |
|---|---|---|---|---|---|
| 9K (Inv.) | 41 | −0.06 | 85% | 68% | G |

*1 G represents no generation of a precipitate.
B represents the generation of a precipitate.
BB and BBB represent the generation of an increasingly heavier precipitate.
*2 After oxidizing with iodine, a color (red) was developed by adding sulfanilic acid and a-naphthylamine to obtain the value by spectrophotometry.

It is clearly seen from the results summarized in Table H that the comparative samples not containing a chelating compound or containing a conventional compound resulted in the generation of a precipitate or decreased solution stability, whereas a marked improvement is obtained upon addition of the compound of formula (I) of the present invention.

EXAMPLE 10

The compound 1, 2, 9, 11, 35, 37, 38 or 41 of the present invention was added to the fixing solution used in Example 9 in an amount of 3 g/liter. Furthermore, ferric ion in an amount corresponding to the solution carried over from the bleaching solution in the preceding bath was added, to thereby prepare sample solutions 10A to 10H.

The samples were aged at 38° C. for 30 days in a vessel having an aperture of 0.1 $cm^{-1}$, and the turbidity of the solutions was observed. It was demonstrated that while a marked turbidity was generated in the fixing solutions not containing the compound of the invention after aging, whereas a transparent condition was maintained in the fixing solutions containing the compound of the present invention and without the generation of the precipitate.

EXAMPLE 11

The stabilizing solution prepared in Example 9 was used as a comparison. Meanwhile, the compound 1, 2, 9, 11, 35, 37, 38 or 41 was added to the above stabilizing solution, respectively, in an amount of 100 mg/liter, to prepare samples 11A to 11I. The stabilizing solutions thus prepared and the fresh solution sample 9A prepared in Example 9 (aside from the stabilizing solution) were used to carry out processing by the method described in Example 9. The films after processing were aged under conditions of 45° C. and 70% RH for one week to evaluate the increase (ΔDmin) in staining of the magenta image. The results thus obtained are shown in Table I.

TABLE I

| Sample No. | Chelating compound | ΔDmin |
|---|---|---|
| 11A (Comp.) | Not added | 0.25 |
| 11B (Inv.) | 1 | 0.07 |
| 11C (Inv.) | 2 | 0.08 |
| 11D (Inv.) | 9 | 0.05 |
| 11E (Inv.) | 11 | 0.10 |
| 11F (Inv.) | 35 | 0.06 |
| 11G (Inv.) | 37 | 0.09 |
| 11H (Inv.) | 38 | 0.07 |
| 11I (Inv.) | 41 | 0.10 |

It is clearly seen from the results summarized in Table 1 that the increase in staining can be controlled and image preservability can be improved by using a stabilizing solution of the present invention containing the compound of formula (I).

EXAMPLE 12

The bleaching solution having the following composition was prepared.

| | |
|---|---|
| Hydrogen peroxide (30 wt %) | 50 ml |
| KBr | 28 g |
| Potassium hydrogenphosphate | 10 g |
| Water was added to make a total volume of | 1 l |
| pH | 3.5 |

The above bleaching solution was designated as comparison 12A. Samples 12B to 12H were prepared containing a comparative compound or a compound of the present invention.

The same light-sensitive materials were used as in Example 9, the same developing solution 9A as prepared in Example 9, and the same fixing solution, stabilizing solution and rinsing solution as those used in Example 9 as well, to evaluate bleaching performance.

The processing was carried out with either fresh or aged bleaching solution samples 12A to 12H, aged for 3 days at 40° C. The light-sensitive materials thus processed were evaluated with respect to residual silver in the maximum density portion using X-ray fluorescence. Also, the residual amount of hydrogen peroxide in the aged solution sample was determined under acidic condition of sulfuric acid by titration with patassium permanganate. The results are shown in Table J.

| Step | Processing steps Time | Temperature |
|---|---|---|
| Color developing | 3 minutes & 15 seconds | 38° C. |
| Bleaching | 5 minutes | 40° C. |
| Fixing | 1 minute & 40 seconds | 38° C. |
| Rinsing (1) | 30 seconds | 38° C. |
| Rinsing (2) | 20 seconds | 38° C. |
| Stabilizing | 20 seconds | 38° C. |

TABLE J

| Sample No. | Chelating agent | Residual silver amount* New sol. | After aging | $H_2O_2$ residual rate (after aging) |
|---|---|---|---|---|
| 12A | Not added | 2 | 30 | 42% |
| 12B | Ethylenediamine-tetracetic acid | 3 | 16 | 61% |
| 12C | 1 | 3 | 6 | 84% |
| 12D | 2 | 4 | 9 | 80% |
| 12E | 11 | 3 | 7 | 82% |
| 12F | 35 | 3 | 6 | 84% |
| 12G | 37 | 4 | 9 | 78% |
| 12H | 41 | 3 | 8 | 81% |

*Unit: $mg/cm^2$

It is clearly seen from the results summarized in Table J that even in the bleaching solutions containing hydrogen peroxide as an oxidizing agent, addition of the compound of the present invention improved the stability of these solutions.

EXAMPLE 13

"Sample 201" of Example 2 of JP-A-2-90151 and "light-sensitive material 9" of Example 3 of U.S. Pat. No. 5,071,736 (each being a negative-type multi-layer color photographic light-sensitive material using emulsions of silver bromoiodide containing 3 to 10 mol % of silver iodide) were used to carry out the same evaluation as in Example 9. Similar results were obtained.

EXAMPLE 14

"Sample 1" of Example 1 of JP-A-2-58041 (black-and-white silver halide photographic material) was processed according to the Example 1 of JP-A-2-58041, except that sodium ethylenediaminetetracetate contained in the developing solution (A) used therein was replaced with an equimolar amount of the compound 1 or 35 of the present invention. After ageing the respective developing solutions at 40° C. for 4 days, the aged solutions were employed in continuous processing to thereby confirm the improvement in the precipitation property.

EXAMPLE 15

"Sample 518" prepared in Example 5 of European Patent Application 0456181Al (negative-type multi-layer color photographic light-sensitive material using emulsions of silver bromoiodide containing 2 to 10 mol % of silver iodide) was cut to a 35 mm width. The sample was exposed to white light (color temperature of light source: 4800° K.) via a step wedge and processed with an automatic developing machine using the following steps until the accumulated developing solution reached five times the tank capacity thereof.

| Processing steps | | | | |
|---|---|---|---|---|
| Step | Time | Temperature | Replenishing amount | Tank capacity |
| Color developing | 3 minutes & 15 seconds | 38° C. | 22 ml | 20 l |
| Bleaching | 3 minutes | 38° C. | 25 ml | 40 l |
| Washing | 30 seconds | 24° C. | 1200 ml | 20 l |
| Fixing | 30 minutes | 38° C. | 25 ml | 30 l |
| Rinsing (1) | 30 seconds | 24° C. | — | 10 l |
| Rinsing (2) | 30 seconds | 24° C. | 1200 ml | 10 l |
| Stabilizing | 30 seconds | 38° C. | 25 ml | 10 l |
| Drying | 4 minutes & 20 seconds | 55° C. | | |

Replenishing amount is per meter of 35 mm width.

The rinsing step comprised a countercurrent system from (2) to (1).

| | A | B |
|---|---|---|
| Color developing solution | | |
| Diethylenetriaminepentacetic acid | 1.0 g | 1.1 g |
| 1-Hydroxyethylidene-1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.3 g |
| Potassium iodide | 1.5 mg | — |
| Hydroxylamine sulfate | 2.4 g | 2.8 g |
| 2-methyl-4-[N-ethyl-N-(β-hydroxyethyl) amino]aniline sulfate | 4.5 g | 6.2 g |
| Water was added to make a total volume of | 1000 ml | 1000 ml |
| pH (adusted with a 50 wt % potassium hydroxide aqueous solution) | 10.05 | 10.15 |
| Fixing solution | | |
| Ammonium thiosulfate aqueous solution (700 g/liter) | 290 ml | 320 ml |
| Disodium ethylenediaminetetracetate | 0.5 g | 0.7 g |
| Ammonium sulfite | 20.0 g | 22.0 g |
| Water was added to make a total volume of | 1000 ml | 1000 ml |
| pH | 6.7 | 7.0 |

Rinsing Solution

The same rinsing solution as used in Example 1.

| Stabilizing solution (common to both the mother solution and replenishing solution) | |
|---|---|
| Sodium p-toluenesulfinate | 0.03 g |
| Polyoxyethylene-p-monononylphenyl ether | 0.2 g |
| Polyoxyethylene-p-monononylphenyl ether (average polymerization degree: 10) | 0.2 g |
| Disodium ethylenediaminetetracetate | 0.05 g |
| 1,2,4-Triazole | 1.3 g |
| 1,4-Bis(1,2,4-triazole-1-yl-methyl)piperazine | 0.75 g |
| Water was added to make a total volume of | 1.0 l |
| pH | 8.5 |

The following eleven kinds of the bleaching solutions prepared as described below were used to carry out the processing therewith, respectively. The processing was continued while supplying a replenishing solution prepared by adjusting the composition of the overflow solution from the bleaching bath to compensate for the components consumed in the processing.

| | A | B |
|---|---|---|
| Bleaching solution 15-1 | | |
| Water | 800 ml | 800 ml |
| Ethylenediaminetetracetic acid | 0.26 mol | 0.29 mol |
| Iron nitrate nonahydrate | 0.25 mol | 0.28 mol |
| Potassium bromide | 1.4 mol | 1.6 mol |
| Water was added to make a total volume of | 1000 ml | 1000 ml |
| pH | 6.0 | 5.7 |
| Bleaching solution 15-2 to 15-11 | | |
| Water | 800 ml | 800 ml |
| Chelating compound (refer to Table K) | 0.082 mol | 0.093 mol |
| Iron nitrate nonahydrate | 0.08 mol | 0.09 mol |
| Potassium bromide | 0.5 mol | 0.6 mol |
| Acetic acid | 0.8 mol | 0.9 mol |
| Water was added to make a total volume of | 1000 ml | 1000 ml |
| pH | 4.3 | 3.9 |

Note: The chelating compound used herein means organic acid constituting a ferric ammonium salt of an organic acid which, is formed by the reaction with iron nitrate in in the bleaching solution.

The light-sensitive materials "Sample 518" processed by the above method were evaluated with respect to residual silver amount as well as those in Example 1. The results are shown in Table K.

TABLE K

| Bleaching solution | Chelating compound | Residual silver amount |
|---|---|---|
| 15-1 (Comp.) | Ethylenediamine-tetracetic acid | 8.5 mg/cm$^2$ |
| 15-2 (Comp.) | 1,3-Diaminopropane- | 6.1 |

TABLE K-continued

| Bleaching solution | Chelating compound | Residual silver amount |
|---|---|---|
| | tetracetic acid | |
| 15-3 (Comp.) | Comp. Compound F | 7.0 |
| 15-4 (Comp.) | Comp. Compound G | 6.5 |
| 15-5 (Inv.) | 1 | 2.3 |
| 15-6 (Inv.) | 2 | 3.4 |
| 15-7 (Inv.) | 24 | 3.0 |
| 15-8 (Inv.) | 35 | 2.5 |
| 15-9 (Inv.) | 37 | 2.7 |
| 15-10 (Inv.) | 77 | 2.9 |
| 15-11 (Inv.) | 78 | 4.0 |

Comparative Compound F

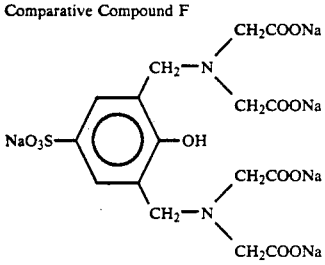

(described in JP-A-3-216650)

Comparative Compound G

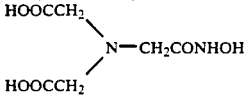

(described in European Patent Application 0458131)

It is clearly seen from the results summarized in Table K that the diluted bleaching composition according to the present invention is a preferable in terms of environmental considerations such as biodegradability, nitrogen content and oxidizing agent concentration. Furthermore, a sufficient desilvering property is obtained even in a diluted concentration.

EXAMPLE 16

Based on a 302A revised SCAS method regulated in an OECD chemical-test guideline, a biodegradability test was carried out to confirm that the compounds 1 and K-1 of the present invention were degraded at the degradation rate of 70% and it was confirmed that they exhibited excellent biodegradability. On the other hand, ferric ammonium ethylenediaminetetracetate and ethylenediaminetetracetic acid were not degraded.

Effects of the Invention

The processing composition of the present invention provides the following excellent effects:

(1) Use of the compound represented by formula (I) of the present invention suppresses oxidation or degradation of the components of a processing solution attributable to the action of a metal ion, and maintains the performance of the processing solution over a long period of time;

(2) A precipitate is not generated in a solution even with the accumulation of metal ions, and therefore undesirable film staining and a clogging of the filter in an automatic developing machine are prevented;

(3) Image preservability of a light-sensitive material after processing is improved;

(4) The use of metal chelating compounds of the compounds of formula (I) of the present invention provides for rapid processing free from bleaching fog, generates less staining after processing, and provides an excellent desilvering property; and (5) The variation in photographic properties prior to and after continuous processing is reduced.

(6) The compound represented by formula (I) is biodegradable, and thereby contributes to environmental conservation.

While the invention has been described in detail and with reference to specific embodiments thereof, it will be apparent to one skilled in the art that various changes and modifications can be made therein without departing from the spirit and scope thereof.

What is claimed is:

1. A method for processing an imagewise exposed silver halide photographic light-sensitive material comprising a support having thereon at least one light-sensitive silver halide emulsion layer, which comprises developing in a developing solution and processing said light-sensitive material with a bleaching or bleach-fixing solution containing as a bleaching agent a Fe (III) chelating compound of a monoamine compound or salt thereof represented by formula (I-a') or (I-b'):

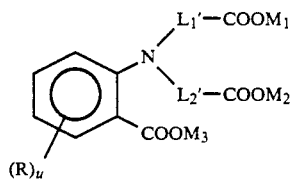

(I-a')

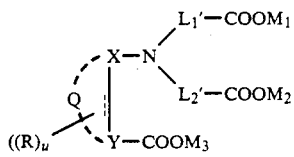

(I-b')

wherein R represents a substituent; Q represents a group of non-metal atoms necessary to form a heterocyclic ring; X and Y each represents a carbon atom or a nitrogen atom; $L_1'$ and $L_2'$ each represents an alkylene group; $M_1$, $M_2$ and $M_3$ each represent a hydrogen atom or a cation; and u represents 0, 1, 2, 3 or 4.

2. The method of claim 1, wherein said at least one silver halide emulsion layer contains an emulsion of silver halide comprising 0.1 to 30 mole % of silver iodide, and the light-sensitive material is processed with said bleaching or bleach-fixing solution containing the metal chelating compound for 10 to 60 seconds.

3. The method of claim 1, wherein said at least one silver halide emulsion layer contains an emulsion of silver halide comprising silver chloride or silver bromochloride, and the light-sensitive material is processed with said bleaching or bleach-fixing solution containing the metal chelating compound for 5 to 30 seconds.

4. The method of claim 1, wherein said Fe(III) chelating compound is contained in an amount of from 0.005 to 1 mole per liter of the bleaching or bleach-fixing solution.

5. The method of claim 1, wherein said Fe(III) chelating compound is a Fe(III) chelating compound of a compound represented by

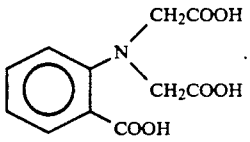

6. The method of claim 1, wherein said R is a substituent selected from the group consisting of an alkyl group, an aralkyl group, an alkenyl group, an alkynyl group, an alkoxy group, an aryl group, an acylamino group, a sulfonylamino group, a ureido group, a urethane group, an aryloxy group, a sulfamoyl group, a carbamoyl group, an alkylthio group, an arylthio group, a fulfonyl group, a sulfinyl group, a hydroxy group, a halogen atom, a cyano group, a sulfo group, a carboxy group, a phosphono group, an aryloxycarbonyl group, an acyl group, an alkoxycarbonyl group, an acyloxy group, a carbonamide group, a sulfonamide group, a nitro group, and a hydroxamic acid group.

7. A photographic processing composition containing as a bleaching agent at least one metal chelating compound formed from a metal salt of Fe (III) and a monoamine compound or salt thereof represented by formula (I-a') or (I-b'):

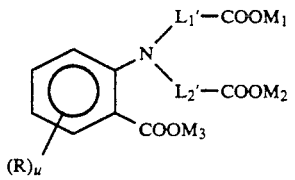

(I-a')

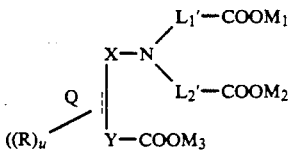

(I-b')

wherein R represents a substituent; Q represents a group of non-metal atoms necessary to form a heterocyclic ring; X and Y each represents a carbon atom or a nitrogen atom; $L_1'$ and $L_2'$ each represents an alkylene group; $M_1$, $M_2$ and $M_3$ each represents a hydrogen atom or a cation; and u represents 0, 1, 2, 3 or 4.

8. The photographic processing composition of claim 7, wherein said R is a substituent selected from the group consisting of an alkyl group, an aralkyl group, an alkenyl group, an alkynyl group, an alkoxy group, an aryl group, an acylamino group, a sulfonyl-amino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxy group, a phosphono group, an aryloxycarbonyl group, an acyl group, an alkoxycarbonyl group, an acyloxy group, a carbonamide group, a sulfonamide group, a nitro group, and a hydroxamic acid group.

9. The photographic processing composition of claim 7, wherein said metal chelating compound is contained in an amount of from 0.005 to 1 mole per liter of the processing composition.

* * * * *